US011772879B2

(12) United States Patent
Park

(10) Patent No.: US 11,772,879 B2
(45) Date of Patent: Oct. 3, 2023

(54) CONTENT RECEIVING DEVICE, OPENING/CLOSING MECHANISM, AND CONTAINER MECHANISM COMPRISING THE SAME

(71) Applicant: COLEDY INC., Seoul (KR)

(72) Inventor: Kyungdo Park, Seoul (KR)

(73) Assignee: COLEDY INC., Seoul (KR)

( * ) Notice: Subject to any disclaimer, the term of this patent is extended or adjusted under 35 U.S.C. 154(b) by 0 days.

(21) Appl. No.: 16/443,837

(22) Filed: Jun. 17, 2019

(65) Prior Publication Data

US 2019/0300269 A1 Oct. 3, 2019

Related U.S. Application Data

(63) Continuation of application No. 15/047,889, filed on Feb. 19, 2016, now abandoned, which is a (Continued)

(30) Foreign Application Priority Data

Aug. 27, 2013 (KR) ..... 10-2013-0101423
Dec. 2, 2013 (KR) ..... 10-2013-0148836
(Continued)

(51) Int. Cl.
*B65D 83/04* (2006.01)

(52) U.S. Cl.
CPC ..... *B65D 83/0427* (2013.01); *B65D 83/049* (2013.01)

(58) Field of Classification Search
CPC ..... B65D 83/049; B65D 83/0427
See application file for complete search history.

(56) References Cited

U.S. PATENT DOCUMENTS 1,810,491 A * 6/1931 McClure ..... A63B 47/00 280/DIG. 6
2,086,296 A 7/1937 Gilbert
(Continued)

FOREIGN PATENT DOCUMENTS

| | | |
|---|---|---|
| JP | 2016-531056 | 10/2016 |
| JP | 6413155 | 10/2018 |
| KR | 10-0978528 | 8/2010 |

OTHER PUBLICATIONS

Office Action dated Jul. 9, 2019 for Japanese Patent Application No. 2018-129754 and its English translation from Global Dossier.
(Continued)

*Primary Examiner* — Gene O Crawford
*Assistant Examiner* — Kelvin L Randall, Jr.
(74) *Attorney, Agent, or Firm* — Ladas & Parry, LLP

(57) ABSTRACT

The present invention relates to a content receiving device, an opening/closing mechanism, and a container mechanism comprising the same, the content receiving device comprising: a housing which opens to both sides applied to a container body; and an operating mechanism for controlling passage of content provided on the housing to move and guide contents, wherein the operating mechanism has an opening formed to communicate with a storage portion of the container body such that contents of the storage portion are moved. The present invention not only secures a content passage space, but also adjusts the passage space and a receiving space, thereby limiting reception of contents; passage of the demand amount of contents is stably induced within a predetermined range; and contents are prevented from remaining more than is needed, together with interlocked limitation of the content receiving space, such that the amount of received contents is adjusted.

1 Claim, 44 Drawing Sheets

Related U.S. Application Data continuation of application No. PCT/KR2014/007895, filed on Aug. 25, 2014.

(30) Foreign Application Priority Data

Jan. 29, 2014 (KR) ..... 10-2014-0011721
Mar. 11, 2014 (KR) ..... 10-2014-0028638
Aug. 22, 2014 (KR) ..... 10-2014-0109813

(56) References Cited

U.S. PATENT DOCUMENTS 2,102,877 A * 12/1937 Barnett ..... G01F 11/261 222/328
3,414,162 A * 12/1968 Leonforte ..... B65D 83/0409 221/266
3,480,182 A 11/1969 Rigor
3,620,413 A 11/1971 Borsum
3,637,109 A 1/1972 Stifter
3,833,147 A 9/1974 Borsum et al.
4,376,499 A * 3/1983 Ostergaard ..... A47G 19/34 222/339
4,530,447 A 6/1985 Greenspan
4,653,668 A 3/1987 Gibilisco et al.
4,732,387 A * 3/1988 Elinski ..... G07C 15/003 273/144 A
4,782,984 A 11/1988 Su
5,110,008 A * 5/1992 Moulding, Jr ..... G07F 17/0092 221/268
5,219,093 A 6/1993 Moulding, Jr. et al.
D371,297 S 7/1996 Robbins, III
5,927,558 A * 7/1999 Bruce ..... G01F 11/24 222/185.1
6,488,174 B1 12/2002 Cho
8,322,567 B2 12/2012 Giraud
8,657,155 B2 2/2014 Dwork et al.
9,636,279 B2 5/2017 Song et al.
2004/0094566 A1 5/2004 Renaud
2007/0181614 A1* 8/2007 Rvachov ..... G01F 11/261 222/456
2008/0230556 A1* 9/2008 Kroupa ..... B65D 25/22 221/256
2008/0290110 A1* 11/2008 Gelardi ..... B65D 83/0409 221/266
2012/0103985 A1* 5/2012 Dwork ..... B65D 47/0866 220/254.1
2015/0359388 A1* 12/2015 Landau ..... A47J 47/01 222/1
2016/0159555 A1 6/2016 Park
2016/0200485 A1 7/2016 Quinones et al.

OTHER PUBLICATIONS

Office Action dated May 20, 2019 for Indian Application No. 201647006910.
Advisory Action dated Apr. 15, 2019 for U.S. Appl. No. 15/047,889 (now published as US 2016/0159555).
Final Office Action dated Dec. 31, 2018 for U.S. Appl. No. 15/047,889 (now published as US 2016/0159555).
Non-Final Office Action dated Jun. 28, 2018 for U.S. Appl. No. 15/047,889 (now published as US 2016/0159555).
Final Office Action dated Oct. 10, 2017 for U.S. Appl. No. 15/047,889 (now published as US 2016/0159555).
Non-Final Office Action dated Jun. 29, 2017 for U.S. Appl. No. 15/047,889 (now published as US 2016/0159555).

* cited by examiner

CONTENT RECEIVING DEVICE, OPENING/CLOSING MECHANISM, AND CONTAINER MECHANISM COMPRISING THE SAME

CROSS-REFERENCE TO RELATED APPLICATIONS

This application is a continuation of U.S. patent application Ser. No. 15/047,889 filed on Feb. 19, 2016, which is a continuation of PCT International Application S/N PCT/KR2014/007895 filed on Aug. 25, 2014, which claims priority to Korean Patent Application S/N KR10-2013-0101423 filed on Aug. 27, 2013, Korean Patent Application S/N KR10-2013-0148836 filed on Dec. 2, 2013, Korean Patent Application S/N KR10-2014-0011721 filed on Jan. 29, 2014, Korean Patent Application S/N KR10-2014-0028638 filed on Mar. 11, 2014, and Korean Patent Application S/N KR10-2014-0109813 filed on Aug. 22, 2014, each of which is hereby incorporated in its entirety by reference.

BACKGROUND OF THE INVENTION

Field of the Invention

The present invention relates to a content receiving device, an opening and closing mechanism and a container including the same, and more particularly, to a content receiving device that can secure a passage space for content while changing the passage space to guide stable passage of a demand amount of the content and can prevent additional reception of the content exceeding the demand amount by regulating the passage space and a reception space in association with passage of the content through the passage space, an opening and closing mechanism, and a container including the same.

Description of the Related Art

Generally, a container mechanism storing solid, powder or liquid content includes a container body having male threads formed on an outer circumference of an upper portion thereof, and an opening and closing mechanism (that is, a stopper cap) having female threads formed on an inner circumference thereof and engaging with the container body to keep the container sealed.

In the related art, various kinds of opening and closing mechanisms having various shapes have been used for various purposes.

An opening and closing mechanism for containers generally comprises a cap having a flat upper surface and is formed with fine protrusions on an outer circumferential surface thereof such that the opening and closing mechanism can be gripped and rotated by a user when opening the cap.

It should be understood that the above description is provided for understanding the background of the invention and is not a description of a well-known conventional technique in the art to which the present invention pertains.

One example of an opening and closing mechanism for containers is disclosed in Korean Utility Model Registration No. 20-0360697 (entitled "Triple container with lid").

Such a typical container provides user inconvenience because the content can be spilled out in a lump when the container is tilted by a user to take out the content by one or in a desired amount from the container.

In the case where only a small amount of the content remains in the container, it is necessary for a user to carefully take out the content placed at a lower side of the container by tilting the container, or it is difficult for a user to grip the content with a hand.

Recent containers are configured to allow a user to take content out piece by piece. A pump-type container includes a shaft supporting the content, and a container body that is formed at an upper portion thereof with an outlet port and can be moved upwards or downwards such that the content can be lifted and partially supplied through the outlet port by the shaft. Such a container has some problems in that the entirety of the container body including a lid must be lifted upwards as much as possible and then lowered, thereby providing a long operation distance, and in that the entirety of the content must be lifted and then lowered.

In addition, such a typical container can receive various foods, medicines, or articles, and an opening and closing mechanism provided to the container has a simple function of opening and closing the container without any particular function. Moreover, since it is necessary to open the opening and closing mechanism when taking out a demand amount of content from the container, the entirety of the content received in the container can be easily contaminated by external contaminants, or easily oxidized through contact with air.

Moreover, when a user wants to take a demand amount of content out of the typical container, the user must put their fingers into the container, or must pour some amount of the content over the palm by tilting the container and return the remaining amount of content left on the palm to the container, whereby the content can be easily exposed to external contaminants.

Therefore, there is a need for an improved technique capable of overcoming such problems in the art.

The present invention has been conceived to solve such problems in the art and one aspect of the present invention is to provide a content receiving device that can secure a passage space for content while changing the passage space to guide stable passage of a demand amount of the content, an opening and closing mechanism, and a container mechanism including the same.

Another aspect of the present invention is to provide a content receiving device that can secure a passage space for content and can close the passage space in association with passage of a demand amount of the content in order to prevent the excessive content from passing through the passage space, an opening and closing mechanism, and a container mechanism including the same.

A further aspect of the present invention is to provide a content receiving device that can prevent content from being spilled out in a lump when a user tilts a container to remove content therefrom, an opening and closing mechanism, and a container mechanism including the same.

Yet another aspect of the present invention is to provide a content receiving device that includes a content passage unit allowing a solid, powder or liquid content to be discharged in a demand amount from a container while opening or closing a content passage side of the container to enable stable passage of the solid, powder or liquid content in a demand amount to pass therethrough, an opening and closing mechanism, and a container mechanism including the same.

Yet another aspect of the present invention is to provide a content receiving device that restricts a movement angle of a content passage unit that opens a content passage side of a container in order to improve opening/closing response, an opening and closing mechanism, and a container mechanism including the same.

Yet another aspect of the present invention is to provide a receiving portion that includes a receiving portion provided separately from a content passage unit and preventing content having passed through the content passage unit from being excessively introduced into a standby space to allow a desired amount of the content to remain in the standby space, an opening and closing mechanism, and a container mechanism including the same.

Yet another aspect of the present invention is to provide a content receiving device that can secure a passage space for content by changing the passage space, can guide stable reception of a desired amount of the content by preventing an excessive content from entering the content receiving device, and can regulate the amount of the content passing through the passage space, an opening and closing mechanism, and a container mechanism including the same.

Yet another aspect of the present invention is to provide a content receiving device that provides a content standby space to an opening and closing mechanism of a container mechanism such that content having a solid, powder or liquid phase can be separately stored therein, an opening and closing mechanism, and a container mechanism including the same.

Yet another aspect of the present invention is to provide a content receiving device that provides a content standby space having a separate opening to an opening and closing mechanism such that content can be withdrawn from the content standby space through the separate opening, thereby preventing the whole content from being exposed to external contaminants or air and from being easily oxidized through contact therewith, an opening and closing mechanism, and a container mechanism including the same.

Yet another aspect of the present invention is to provide a content receiving device that can receive content in partitioned spaces such that a user can easily obtain a demand amount of the content in a preset period of time, and allows a plurality of users to obtain the content through each of opening and closing mechanisms provided to several positions or opposite sides of a container mechanism in order to facilitate hygiene management and withdrawal of a desired amount of content, an opening and closing mechanism, and a container mechanism including the same.

SUMMARY OF THE INVENTION

In accordance with one aspect of the present invention, a content receiving device includes an operating mechanism for controlling passage of content for guiding movement of content, wherein the operating mechanism for controlling passage of content includes a content passage unit allowing the content to move therethrough.

The content may be allowed to move by deformation of the content passage unit.

The operating mechanism for controlling passage of content may prevent a demand amount of the content having moved from a storage portion storing the content to the operating mechanism for controlling passage of content from returning to the storage portion.

The content receiving device may further include: a receiving portion configured to receive the content having passed through the content passage unit, wherein the receiving portion is configured to receive the content having passed through the content passage unit while preventing an excess of the content exceeding a demand amount from remaining therein.

The receiving portion may include at least one of an upper resistance plate disposed at an upper portion in a content passage direction and a side resistance plate disposed at a side portion perpendicular to the content passage direction to resist the content having passed through the content passage unit, may allow the content to contact at least one of the upper resistance plate and the side resistance plate, and may restrict a remaining amount of the content to a demand amount therein.

The receiving portion may include a partition member partitioning a space of the receiving portion and restricting an amount of the content to be received by the receiving portion by adjusting a content receiving space of the receiving portion partitioned thereby.

The operating mechanism for controlling passage of content may include a blocking plate provided to an opening for blocking movement of the content, wherein the blocking plate blocks the content from moving into the storage portion upon opening of the opening, or prevents the content from moving towards a portion excluding a content receiving space after passing through the content passage unit.

The operating mechanism for controlling passage of content may further include a stationary member including an opening through which the content passes, and connected to the content passage unit.

The content passage unit may include a variable operation plate movably disposed to allow the content to pass therethrough.

The content passage unit may include a movement securing portion to which the opening member or a moving member connected to the opening member is movably connected.

A pivot angle of the moving member connected to the movement securing portion may be restricted by at least one of a stopper provided to the movement securing portion and a cover provided to the housing.

The content receiving device may further include a housing applied to a container body of the container mechanism, and the housing may include a temporary receiving portion in which the content is on standby for withdrawal, wherein the storage portion may partially communicate with the temporary receiving portion through the opening formed in the operating mechanism for controlling passage of content, and the content in the storage portion may be moved to the temporary receiving portion through the operating mechanism for controlling passage of content.

The content receiving device may further include: a receiving portion configured to receive the content having passed through the operating mechanism for controlling passage of content, wherein the receiving portion may be configured to receive the content having passed through the operating mechanism for controlling passage of content while preventing an excess of the content exceeding a demand amount from remaining therein.

The receiving portion may include at least one of an upper resistance plate disposed at an upper portion in a content passage direction and a side resistance plate disposed at a side portion perpendicular to the content passage direction to resist the content having passed through the operating mechanism for controlling passage of content, may allow the content to contact at least one of the upper resistance plate and the side resistance plate, and may restrict a remaining amount of the content to a demand amount therein.

The content passage unit may include a single or multiple variable operation plates, one side of which is secured to the stationary member and the other side of which is a deformable free end side, wherein the variable operation plate defines a passage space formed at a portion thereof such that the content passes through the passage space.

The temporary receiving portion may allow the content to be on standby therein for withdrawal from the content receiving device applied to the container body, and the content in the storage portion of the container body may be moved into the temporary receiving portion.

The opening may be opened to form a passage space for the content when the opening member is pushed by a weight of the content, when the housing is shaken, or when the opening member is opened by a weight thereof.

The stationary member may be connected to the opening member allowing the content to pass through the opening or to the moving member movably connected to the opening member.

The moving member may be integrally formed with the opening member or releasably coupled thereto.

The moving member may connect the opening member to the movement securing portion to allow the opening member to be moved in a direction of gravity and a compressing direction of the content.

The opening member may be secured at one side thereof to a stationary member and the other side of the opening member may not be secured to open or close the opening member through movement of the opening member.

The housing may be provided with a cover receiving the content, and the temporary receiving portion may be disposed under the cover.

The receiving portion may include an inflow member allowing the content to move into the receiving portion while preventing the content from moving towards a portion excluding the receiving portion.

An upper surface of the operating mechanism for controlling passage of content may support the content, and the content received in the receiving portion may be concentrically collected in an interior region of a retention jaw formed on the upper surface.

The receiving portion may include a protrusion secured to an inner surface thereof and resisting the content passing through the operating mechanism for controlling passage of content to prevent the content from deviating from a receiving space.

The receiving portion may be a demand amount receiving unit disposed in a content passage direction of the operating mechanism for controlling passage of content and guiding a demand amount of the content corresponding to a demand amount to be received therein.

The content passage unit may be demand amount disposed in the operating mechanism for controlling passage of content and guides a demand amount of the content corresponding to a demand amount to pass therethrough.

The content receiving device may further include: a cover releasably coupled to the housing and receiving the content supplied from the content receiving device.

The opening member may be provided singularly or in plural.

The content passage unit further includes a blocking plate for closing the opening member in association with the opening member to prevent the content from passing through the opening portion.

The moving member may further include a guide plate on a circumferential surface between the opening member and the blocking plate, wherein the guide member restricts the content before the content is moved to the opening member, and the content compresses the guide plate to open the opening member to improve passage response, wherein the stationary member is provided with a side plate at an entrance side of the opening member, and the side plate guides the content to move towards the opening member along the blocking plate, wherein an inner side of the opening member or the side plate is provided with a support block to maintain the opening member in a state of blocking the opening member, and wherein the blocking plate is provided with a support member contacting the stationary member to maintain the opening member in a closed state.

The content receiving device may further include: a passage frame connected to the opening member and having an opening open at a central portion thereof.

The opening member may have a free end movably connected to the passage frame and may be formed with a passage space corresponding to the opening.

A variable operation plate composed of the opening member may have an inclined surface to guide the content to move towards the passage frame including the passage space along an inclination trace upon movement of the opening member.

The opening member may include a shielding member protruding from the free end thereof towards one of an upper portion, a lower portion and an inner portion of the opening of the passage frame such that the passage space is formed to allow the content to pass therethrough as the shielding member is shortened by movement of the opening member, and at least one of the free end and an opening guide member connected to the opening member and the passage frame is moved until a restriction plane of the free end or the opening guide member is brought into contact with the stationary member upon movement of the free end or the opening guide member such that the passage space is restricted to a predetermined size while adjusting motion of the opening member.

The movement securing portion may be connected to the stationary member to be secured to one of an upper edge, a circumferential surface, an inner surface, and a lower edge of the stationary member.

The content receiving device may further include an inflow guide member guiding the content to move towards the operating mechanism for controlling passage of content, wherein the inflow guide member has a guide opening formed to face the operating mechanism for controlling passage of content and an inclined surface formed along at least a portion of an edge of the guide opening.

The opening member may be connected to a restoration member configured to open the opening to allow the content having passed through the opening to return and close the opening.

The content receiving device may further include a content guide member guiding the content to move to a portion at which a user can easily obtain the content having passed through the content passage unit, and the content guide member may be formed with an inflow portion into which the content having passed through the content passage unit flows, and may have an inclined surface having an inclination gradually increasing from the inflow portion to an edge thereof.

The cavity may be divided into a storage portion in which the content is stored, and a temporary receiving portion in which the content received from the storage portion is on standby for withdrawal.

The content passage unit may be deformed to guide passage of the content by the weight of the content passage unit or compressive force of the content.

The content passage unit may allow passage of the content therethrough by rotational deformation thereof.

The content passage unit may prevent an excess of the content from passing therethrough by rotational deformation thereof.

Deformation of the content passage unit may be realized by movement of at least one member included in the content passage unit.

The content passing through the content passage unit may have at least one of solid, powder and liquid phases.

The opening member may be rotatably provided to the content passage unit.

The operating mechanism for controlling passage of content may open or close at least a portion of the opening by deformation of the content passage unit.

The blocking plate may close at least a portion of the opening in association with the opening member to allow an excess of the content exceeding a demand amount to pass through the opening.

The content passage unit may allow passage of the content therethrough, with the cover or an opening and closing mechanism capable of opening or closing the housing opened at a side of the content passage unit of the housing provided with the content passage unit.

The content passage unit may allow passage of the content therethrough in a state that the content passage unit does not contact or is not resisted by an opening and closing mechanism of the housing provided with the content passage unit or a member connected to the opening and closing mechanism.

The content passage unit may allow passage of the content therethrough in a state that the housing provided with the content passage unit is open in a content passage direction of the content passage unit.

The content passage unit may allow the content to pass therethrough only by operation of tilting or shaking the housing provided with the content passage unit.

The content passage unit may allow the content to pass therethrough upon rotational deformation thereof.

The content passage unit may prevent an excess of the content exceeding a demand amount from passing therethrough upon rotational deformation thereof.

Rotational deformation of the content passage unit may be achieved only by operation of tilting, overturning or shaking the content passage unit.

Rotational deformation of the content passage unit may be achieved by the weight of the content compressing the content passage unit.

Deformation of the content passage unit may be realized by movement of at least one member included in the content passage unit.

The content passing through the content passage unit may have at least one of solid, powder and liquid phases.

The opening member may be rotatably provided to the content passage unit.

The operating mechanism for controlling passage of content may open or close at least a portion of the opening by deformation of the content passage unit.

The content receiving device may further include a receiving portion for receiving the content having passed through the content passage unit, wherein the receiving portion receives the content having passed through the content passage unit while preventing an excess of the content exceeding a demand amount from remaining therein.

The blocking plate may close at least a portion of the opening in association with the opening member to prevent an excess of the content exceeding a demand amount from passing through the opening.

In accordance with another aspect of the present invention, an opening and closing mechanism applied to a container body may include: a temporary receiving portion in which a content is on standby for withdrawal; a body having the temporary receiving portion; and an operating mechanism for controlling passage of content formed with an opening such that a storage portion of the container body at least partially communicates with the temporary receiving portion through the opening to allow the content to be moved from the storage portion to the temporary receiving portion.

The operating mechanism for controlling passage of content may prevent a demand amount of the content having moved to the temporary receiving portion therethrough from moving into the storage portion.

The opening and closing mechanism may further include: a receiving portion receiving the content having passed through the content passage unit, wherein the receiving portion is configured to allow the content having passed through the content passage unit to remain in a restricted amount in the receiving portion.

The receiving portion may include at least one of an upper resistance plate disposed at an upper portion in a content passage direction and a side resistance plate disposed at a side portion perpendicular to the content passage direction to resist the content having passed through the content passage unit, may allow the content to contact at least one of the upper resistance plate and the side resistance plate, and may restrict a remaining amount of the content to a demand amount therein.

The receiving portion may include a partition member partitioning a space of the receiving portion and restricting an amount of the content to be received by the receiving portion by adjusting a content receiving space of the receiving portion partitioned thereby.

The operating mechanism for controlling passage of content may include a blocking plate provided to the opening and blocking movement of the content, wherein the blocking plate blocks the content from moving into the storage portion upon opening of the opening, or prevents the content from moving towards a portion excluding a content receiving space after passing through the content passage unit.

The opening and closing mechanism may be formed with an opening through which the content is taken out of the temporary receiving portion.

The operating mechanism for controlling passage of content may be releasably connected to the body of the opening and closing mechanism.

The operating mechanism for controlling passage of content may be formed with an opening protruding to a predetermined height.

The operating mechanism for controlling passage of content may include a content passage unit allowing the content to pass through the opening, and the content of the storage portion may be allowed to move opening and closing mechanism by deformation of the content passage unit.

The content passage unit may include a variable operation plate, one side of which is secured to the stationary member and the other side of which is a deformable free end, wherein the variable operation plate has a passage space formed at a portion thereof such that the content passes through the passage space.

The content may pass through the passage space widened by deformation of the free end of the variable operation plate.

The content passage unit may include a variable operation plate opened through movement.

The opening member may be provided singularly or in plural.

The content passage unit may be demand amount disposed in the operating mechanism for controlling passage of content and guide a demand amount of the content corresponding to a demand amount to pass therethrough.

The variable operation plate may include a variable operation plate directly or indirectly connected to the stationary member and may guide the content to pass therethrough depending on opening or closing of the opening through movement of the opening member.

In accordance with a further aspect of the present invention, a container mechanism may include: a content receiving device provided to an open side of a storage portion for storing content and guiding the content to be received in the content receiving device, wherein the content receiving device includes: a housing open towards at least one side thereof; and an operating mechanism for controlling passage of content disposed inside the housing and guiding the content to be received therein, wherein the housing may include a temporary receiving portion in which the content is on standby, the operating mechanism for controlling passage of content is formed with an opening through which the storage portion at least partially communicates with the temporary receiving portion through the opening to allow the content to be moved from the storage portion to the temporary receiving portion, and may include a content passage unit through which the content passes.

The operating mechanism for controlling passage of content may allow the content in the storage portion to move into the temporary receiving portion by deformation of the content passage unit.

The temporary receiving portion may include a receiving portion configured to receive a demand amount of the content having passed through the opening, and the receiving portion may include at least one of an upper resistance plate disposed at an upper portion in a content passage direction and a side resistance plate disposed at a side portion perpendicular to the content passage direction to resist the content having passed through the opening, may allow the content to contact at least one of the upper resistance plate and the side resistance plate, and may restrict a remaining amount of the content to a demand amount after passing through the opening.

The receiving portion may include: a partition member partitioning a space of the receiving portion and restricting an amount of the content to be received by the receiving portion; a blocking plate preventing the content from moving towards a portion excluding the receiving portion when the content having passed through the opening moves towards the temporary receiving portion; and an inflow member allowing the content to move into the receiving portion while preventing the content from moving towards a portion excluding the receiving portion.

The operating mechanism for controlling passage of content may include a stationary member opening or closing the opening, may guide the content to be received depending on opening or closing of the opening through movement of the opening member.

The content receiving device may be applied to the container body and may include the temporary receiving portion in which the content is on standby for withdrawal and the operating mechanism for controlling passage of content having the content passage unit.

The housing may be releasably coupled to the storage portion or integrally formed with the storage portion.

In accordance with yet another aspect of the present invention, a container mechanism includes: a content receiving device provided to a container body configured to receive content and guiding passage of the content; and a housing at least partially open towards at least one side thereof, wherein the content receiving device includes an operating mechanism for controlling passage of content guiding movement of the content, and the operating mechanism for controlling passage of content includes a content passage unit allowing the content to move therethrough.

The content may be allowed to move by deformation of the content passage unit.

The content passage unit may include a variable operation plate movably disposed and moving to allow the content to pass therethrough.

The content passage unit may be deformed to guide passage of the content by the weight of the content passage unit or compressive force of the content.

The content passage unit may allow passage of the content therethrough in a state that the content passage unit does not contact or is resisted by an opening and closing mechanism, a cover, a member connected to the opening and closing mechanism, or a member connected to the cover at a side of the content passage unit of the housing provided with the content passage unit.

The content passage unit may allow passage of the content therethrough, with the cover or an opening and closing mechanism capable of opening or closing the housing opened at a side of the content passage unit of the housing provided with the content passage unit.

The content passage unit may allow passage of the content therethrough in a state that the housing provided with the content passage unit is open in a content passage direction of the content passage unit.

The content passage unit may allow the content to pass therethrough only by operation of tilting, overturning or shaking the housing provided with the content passage unit.

Deformation of the content passage unit may be realized by movement of at least one member included in the content passage unit.

The content passing through the content passage unit may have at least one of solid, powder and liquid phases.

The content receiving device may further include a receiving portion receiving the content having passed through the content passage unit, wherein the receiving portion receives the content having passed through the content passage unit while preventing an excess of the content exceeding a demand amount from remaining therein.

The content passage unit may include a blocking plate closing the opening in association with the opening member to prevent the content from passing through the opening portion.

The blocking plate may close at least a portion of the opening in association with the opening member to prevent an excess of the content exceeding a demand amount from passing through the opening.

In accordance with yet another aspect of the present invention, a container mechanism includes: an opening and closing mechanism provided to a container body and opening or closing the container body, wherein the opening and closing mechanism includes a temporary receiving portion in which content is on standby for withdrawal, and an operating mechanism for controlling passage of content guiding movement of the content, and the operating mechanism for controlling passage of content is formed with an opening such that a storage portion of the container body at least partially communicates with the opening to allow the content to be moved from the storage portion to the temporary receiving portion.

The operating mechanism for controlling passage of content may include a content passage unit allowing the content to pass through the opening portion, and the content of the storage portion may be allowed to move by deformation of the content passage unit.

The operating mechanism for controlling passage of content may partition the temporary receiving portion from the storage portion.

In accordance with yet another aspect of the present invention, a container mechanism configured to store content in an interior space of a housing while allowing the content to pass therethrough as needed, include: a content passage unit provided to the housing and guiding passage of a demand amount of the content, wherein the content passage unit forms a passage space through opening or closing by rotation thereof such that the content passes to an outside of the housing through the passage space, includes a variable operation plate and a movement securing portion to which the opening member is rotatably connected, and guides passage of the content upon formation of the passage space by rotation of the opening member.

The opening member may have one side contacting and secured to the movement securing portion, and be movable at the other side thereof such that the opening member is opened or closed by rotation thereof; and the content passage unit may form the passage space to allow the content to pass therethrough.

The opening member may allow passage of the content therethrough by formation of the passage space through movement of a free end thereof.

In accordance with yet another aspect of the present invention, a passage device includes: a content passage unit configured to guide passage of a demand amount of content, wherein the content passage unit is opened or closed by rotation thereof to form a passage space through which the content passes, includes a variable operation plate and a movement securing portion to which the opening member is rotatably connected, and guides passage of the content upon formation of the passage space by rotation of the opening member.

The opening member may have one side contacting and secured to the movement securing portion, and be movable at the other side thereof such that the opening member is opened or closed by rotation thereof; and the opening member may allow passage of the content therethrough by formation of the passage space through movement of a free end thereof.

Hereinafter, embodiments of the present invention will be described in detail with reference to the accompanying drawings. It should be noted that the drawings are not to precise scale and may be exaggerated in thickness of lines or size of components for descriptive convenience and clarity only. In addition, the terms used herein are defined by taking functions of the present invention into account and can be changed according to user or operator custom or intention. Therefore, definition of the terms should be made according to the overall disclosure set forth herein.

Figure 1:
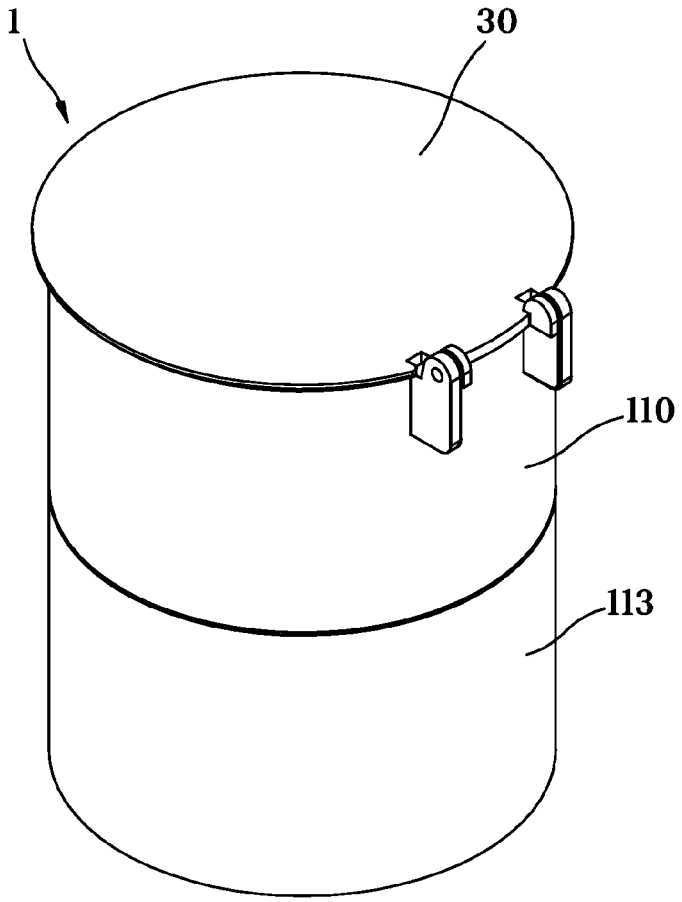
FIG. 1 is a perspective view of a container mechanism including a content receiving device according to a first embodiment of the present invention.
Figure 2:
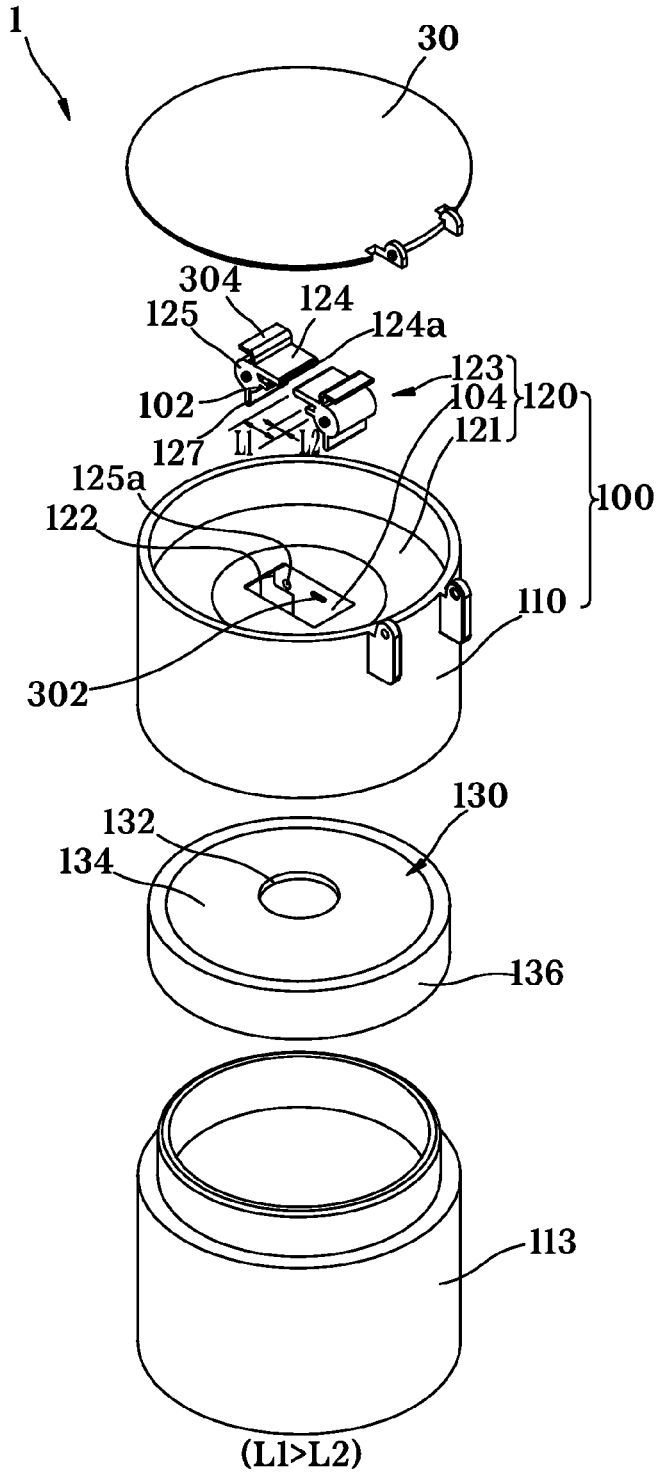
FIG. 2 is an exploded perspective view of the container mechanism including the content receiving device according to the first embodiment of the present invention.
Figure 3:
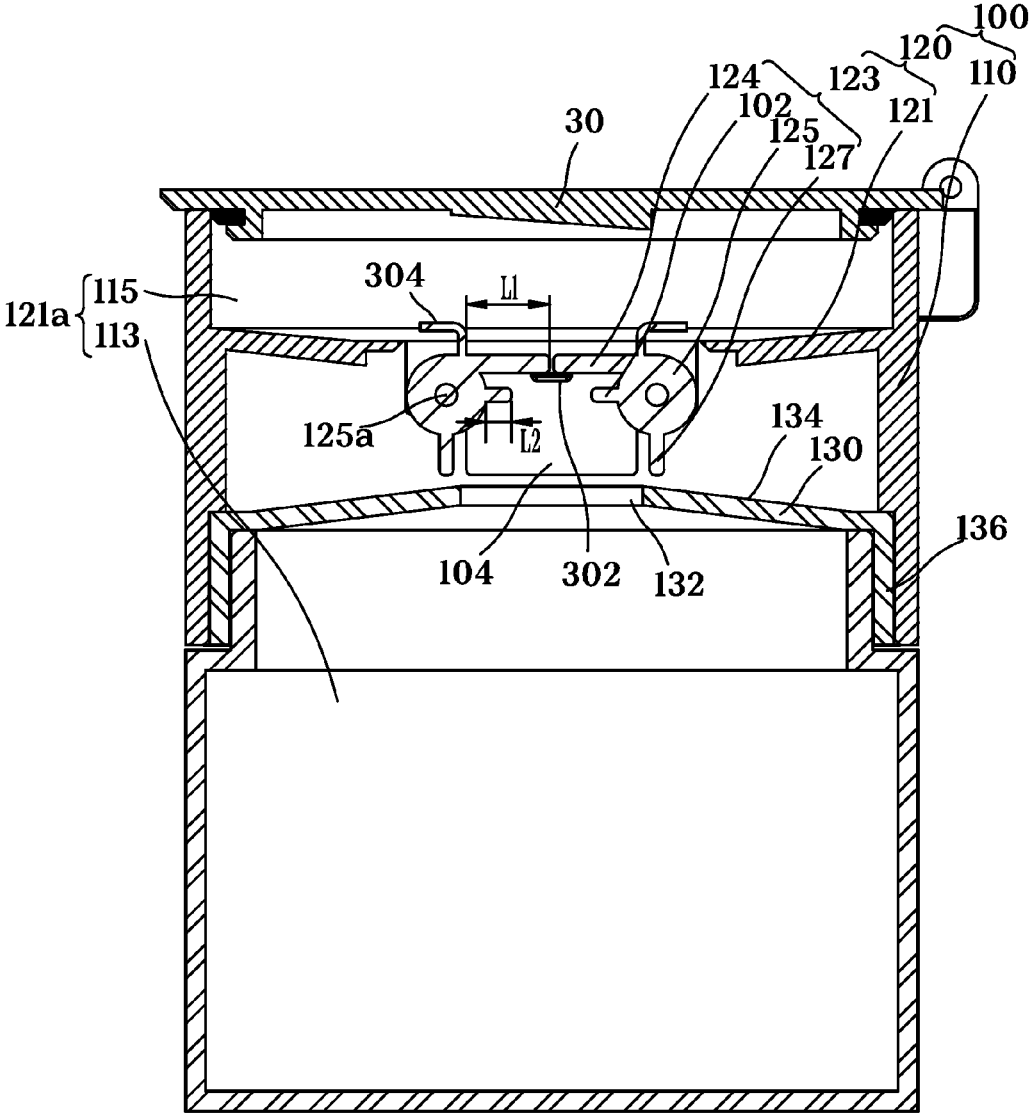
FIG. 3 is a side sectional view of the container mechanism including the content receiving device according to the first embodiment of the present invention.

FIG. 1 is a perspective view of a container mechanism including a content receiving device according to a first embodiment of the present invention, FIG. 2 is an exploded perspective view of the container mechanism including the content receiving device according to the first embodiment of the present invention, and FIG. 3 is a side sectional view of the container mechanism including the content receiving device according to the first embodiment of the present invention.

Figure 4:
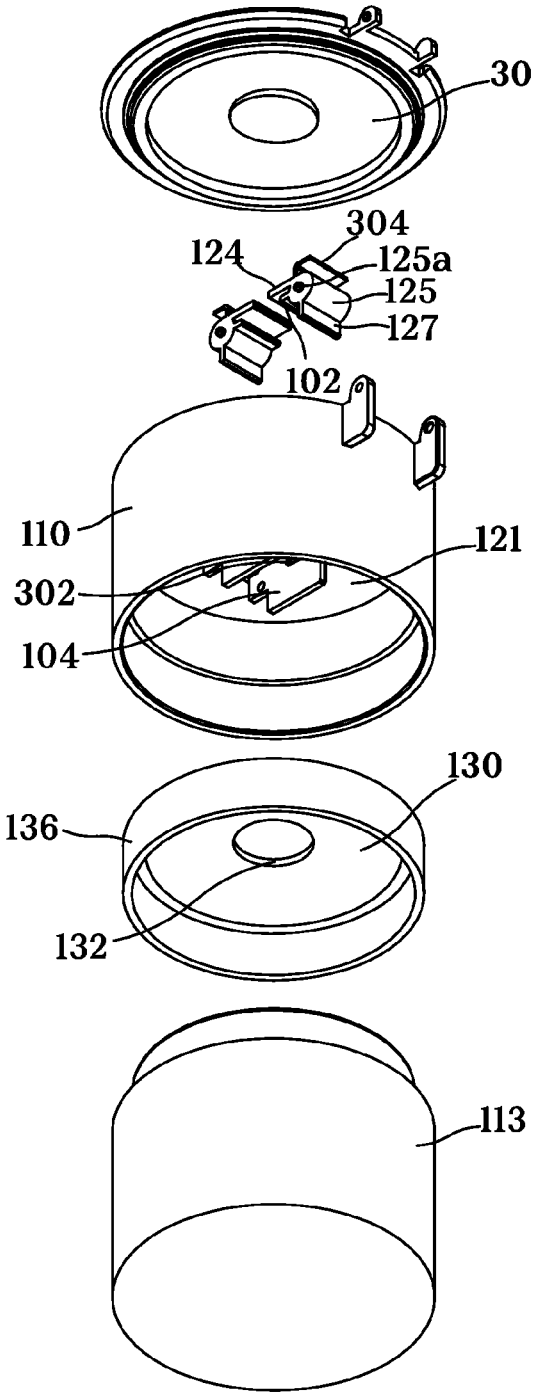
FIG. 4 is a bottom exploded perspective view of the container mechanism including the content receiving device according to the first embodiment of the present invention.
Figure 5:
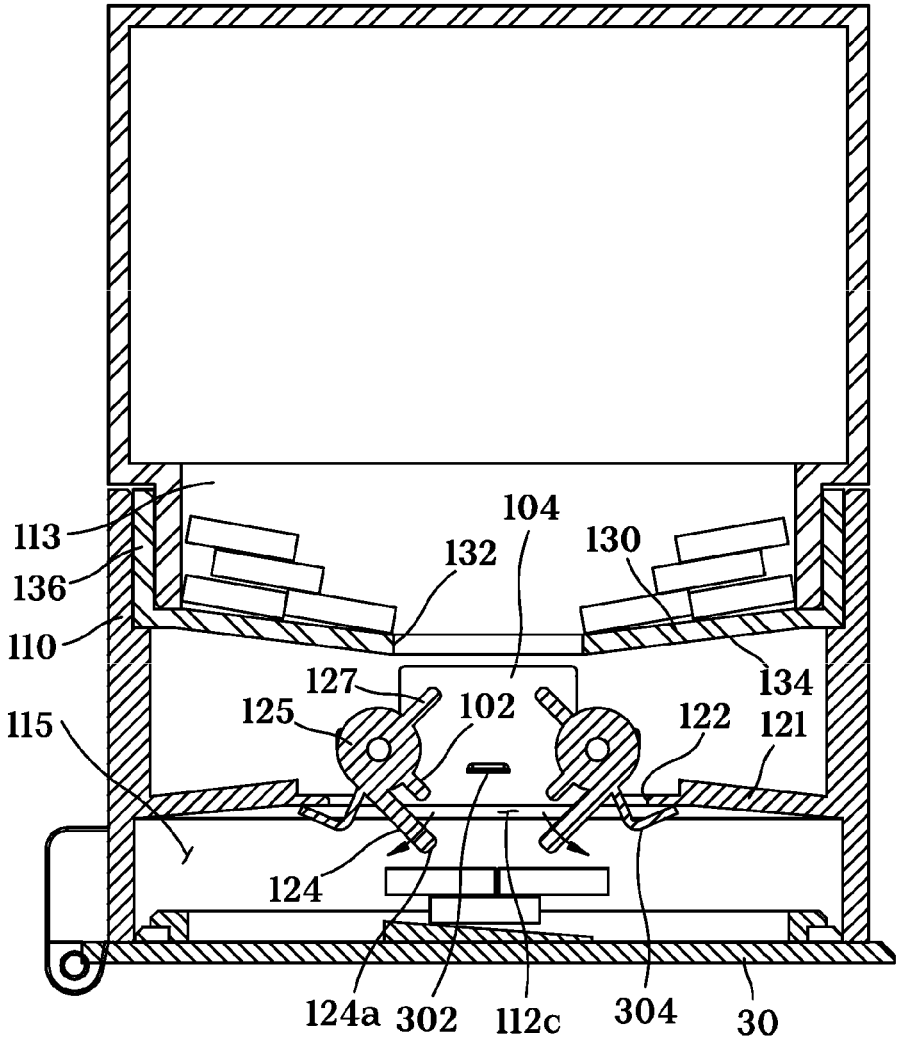
FIG. 5 to FIG. 7 are side sectional views of the container mechanism including the content receiving device according to the first embodiment of the present invention in use.
Figure 6:
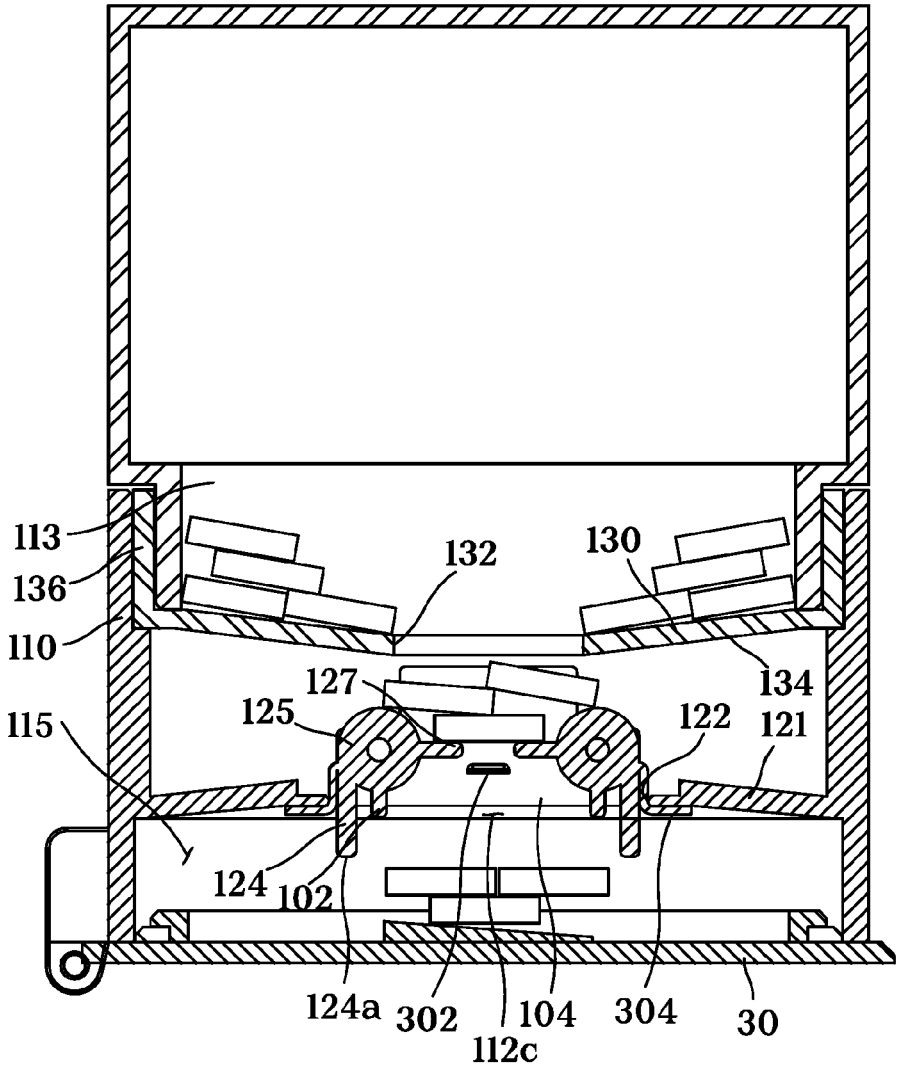
Figure 7:
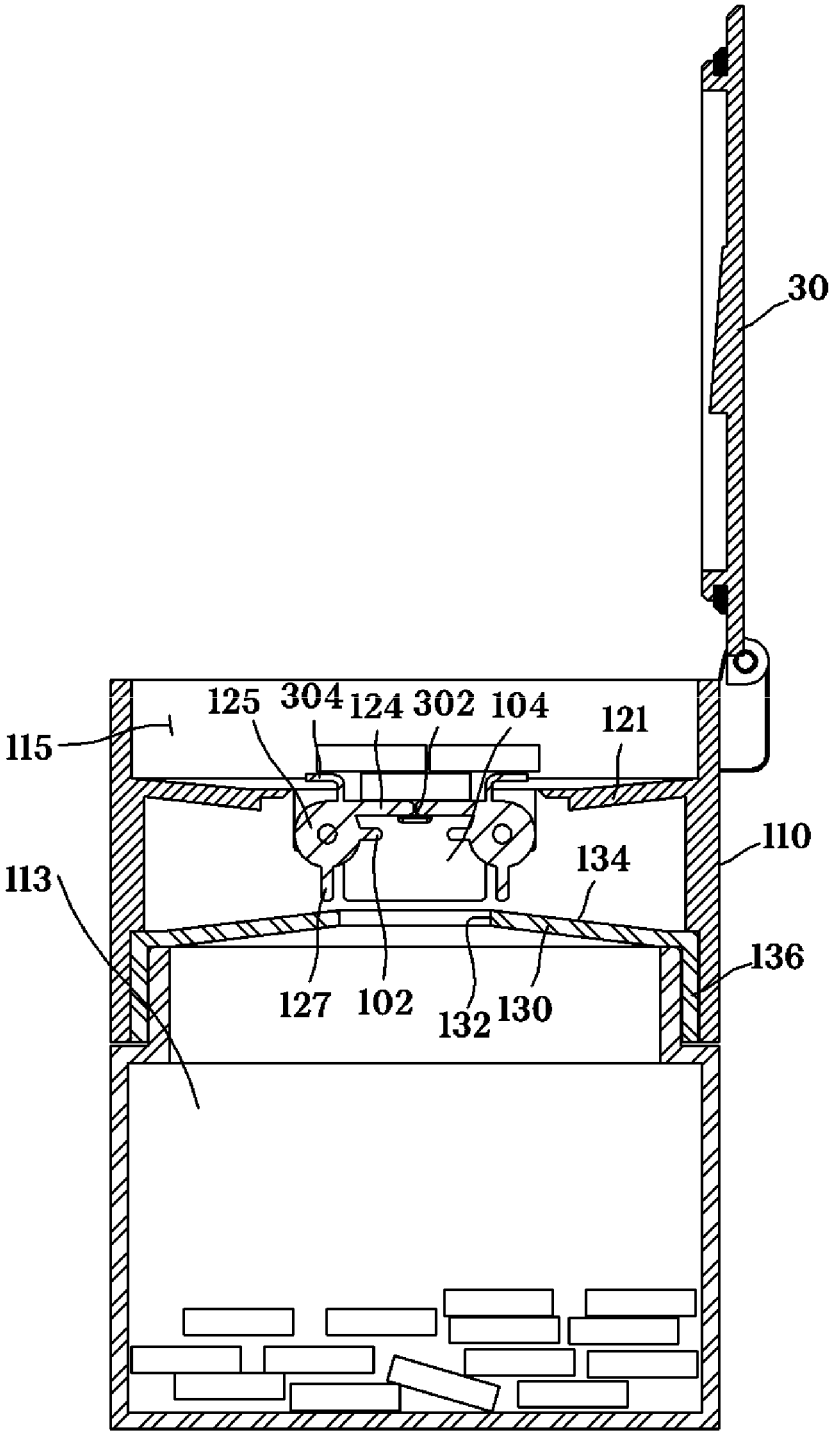

FIG. 4 is a bottom exploded perspective view of the container mechanism including the content receiving device according to the first embodiment of the present invention, and FIG. 5 to FIG. 7 are side sectional views of the container mechanism including the content receiving device according to the first embodiment of the present invention in use.

Figure 8:
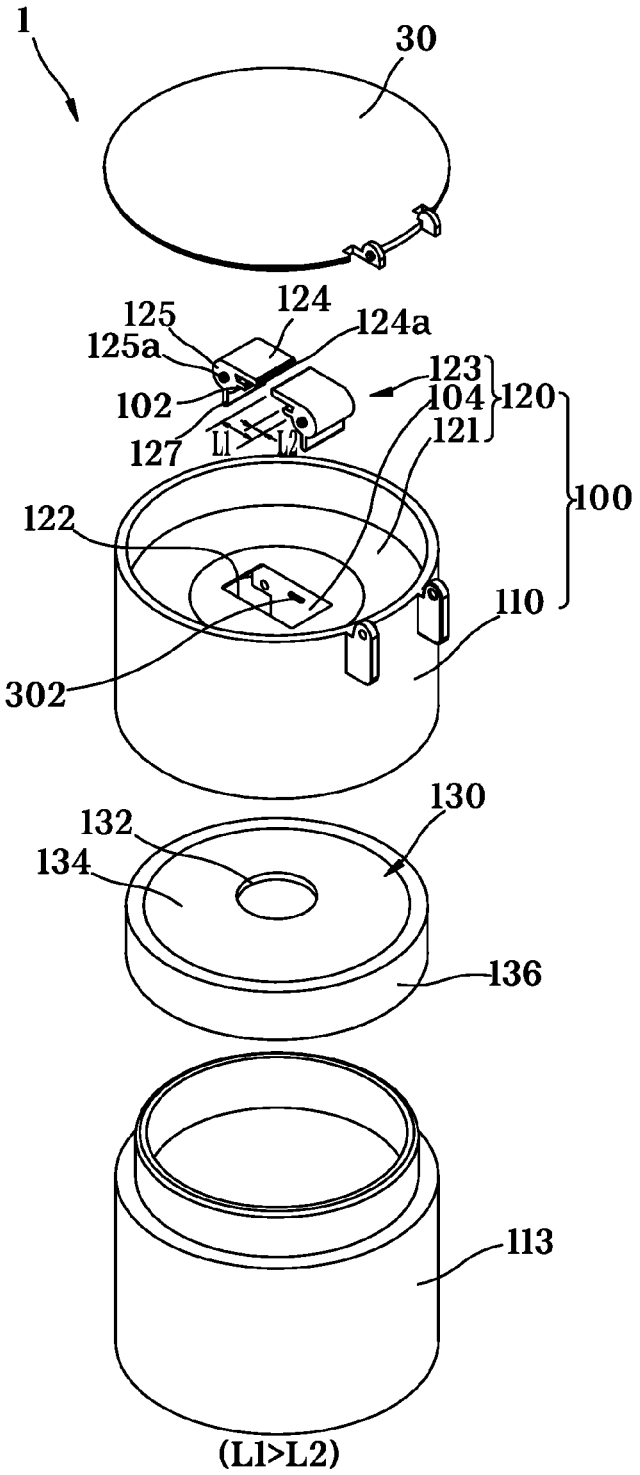
FIG. 8 is an exploded perspective view of a container mechanism including a content receiving device according to a second embodiment of the present invention.
Figure 9:
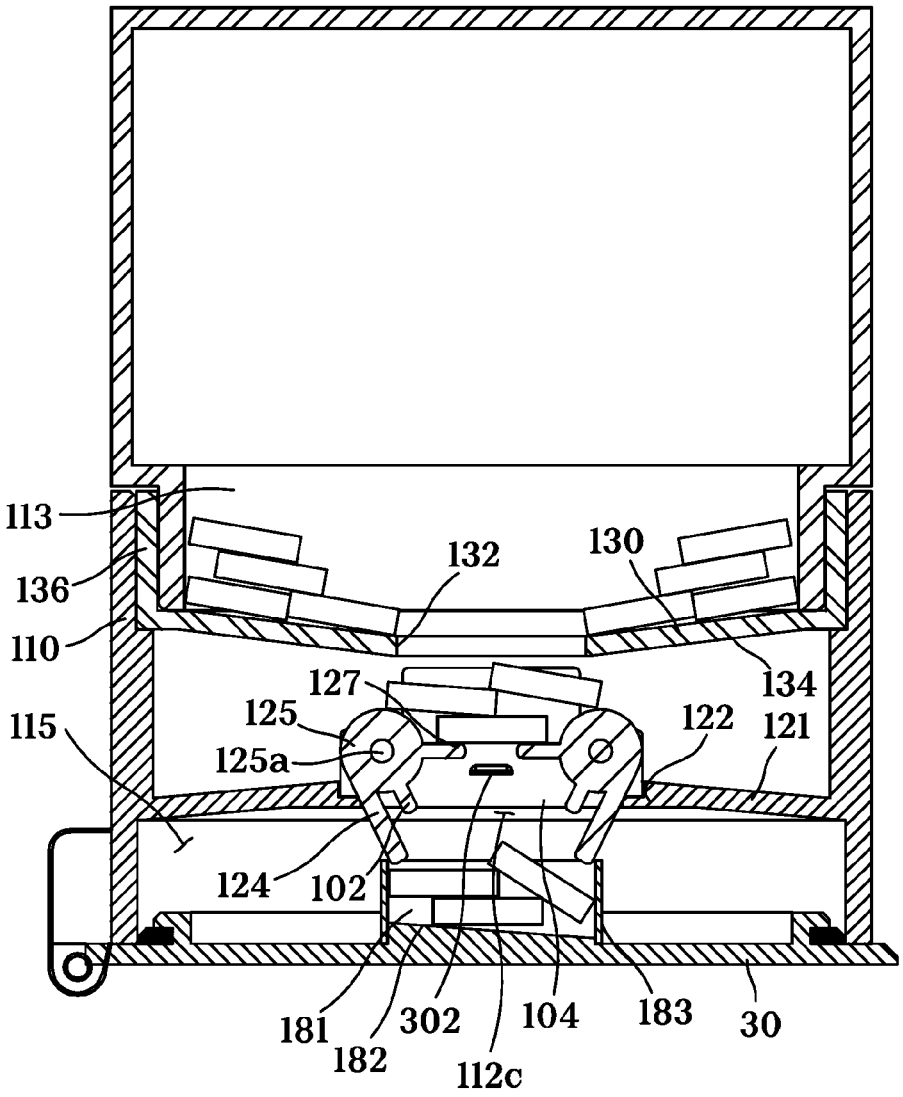
FIG. 9 and FIG. 10 are side sectional views of a container mechanism including the content receiving device according to the second embodiment of the present invention in use.
Figure 10:
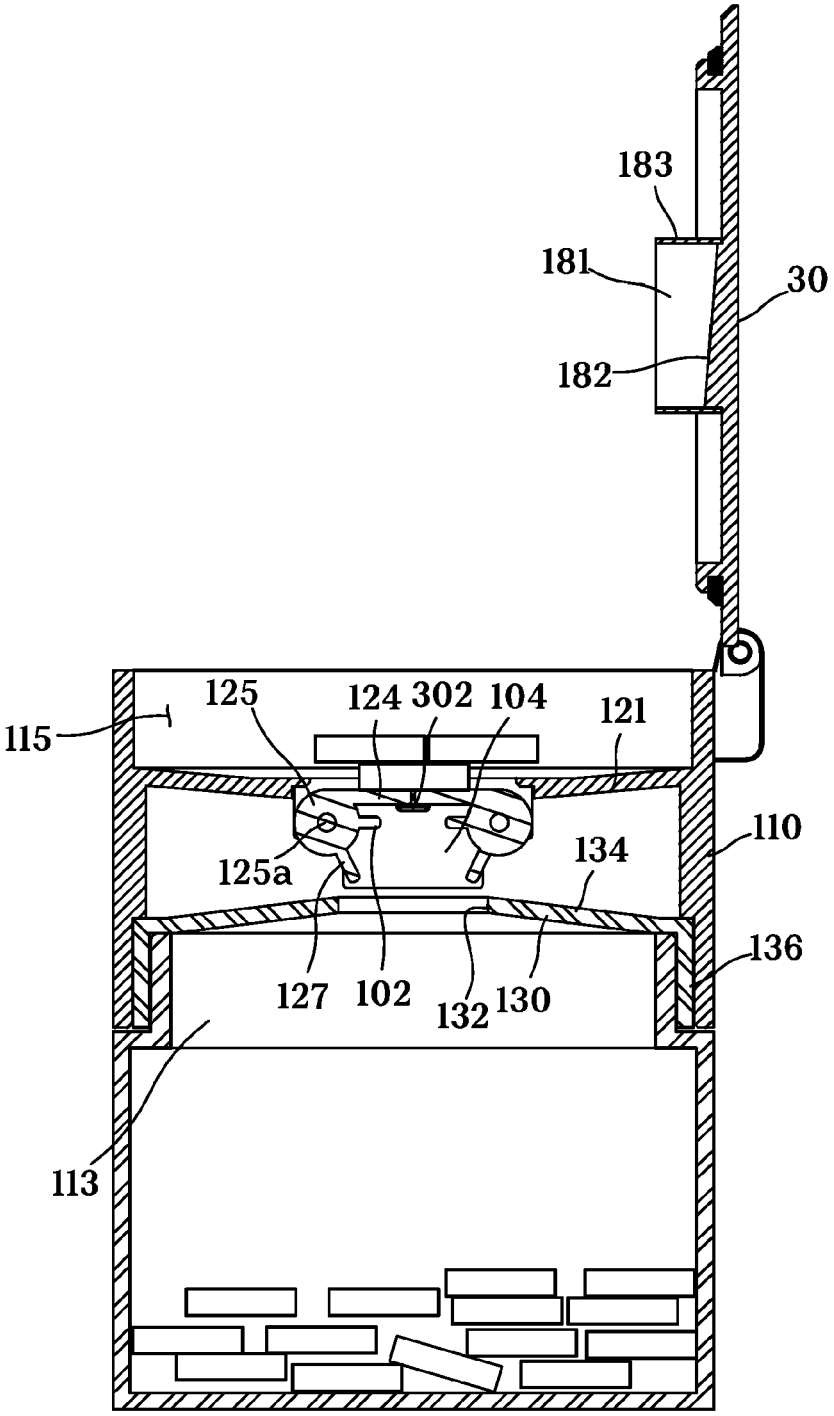

FIG. 8 is an exploded perspective view of a container mechanism including a content receiving device according to the second embodiment of the present invention, and FIG. 9 and FIG. 10 are side sectional views of container mechanism including the content receiving device according to the second embodiment of the present invention in use.

Figure 11:
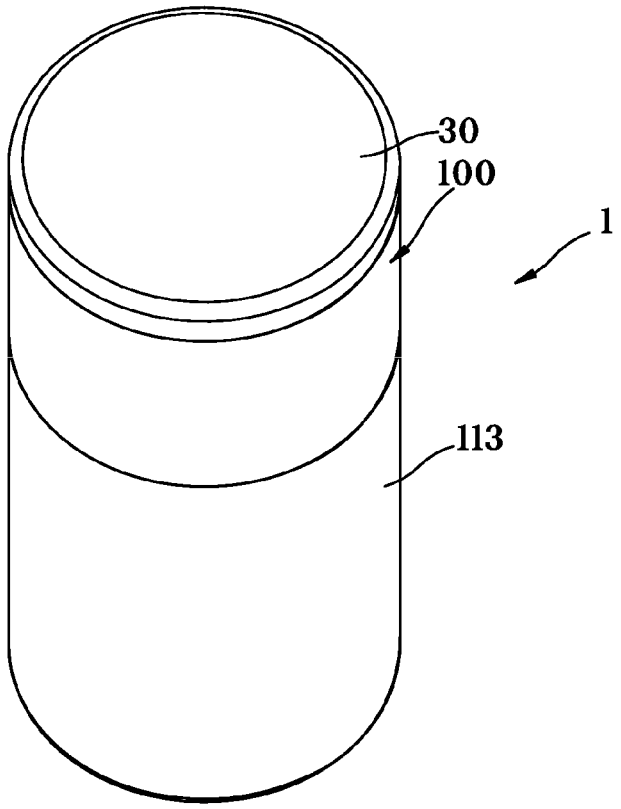
FIG. 11 is a perspective view of a container mechanism including a content receiving device according to a third embodiment of the present invention.
Figure 12:
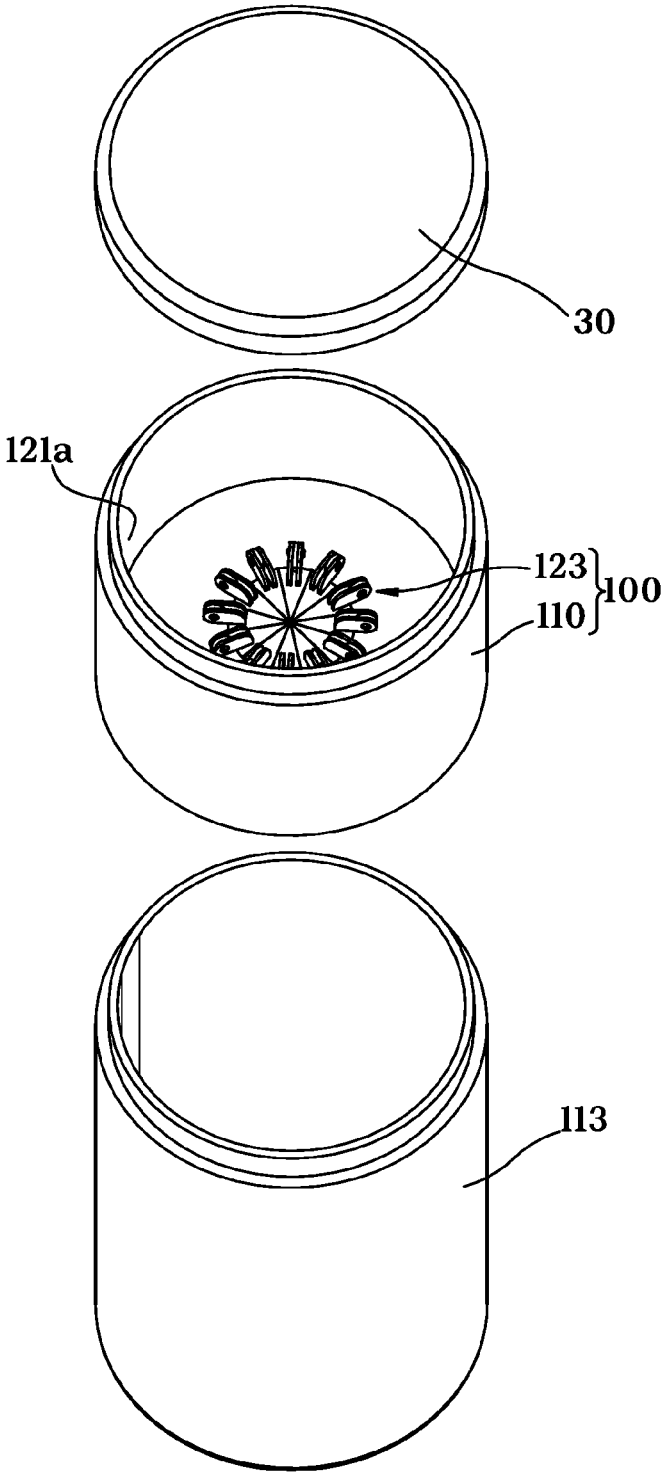
FIG. 12 is an exploded perspective view of the container mechanism including the content receiving device according to the third embodiment of the present invention.
Figure 13:
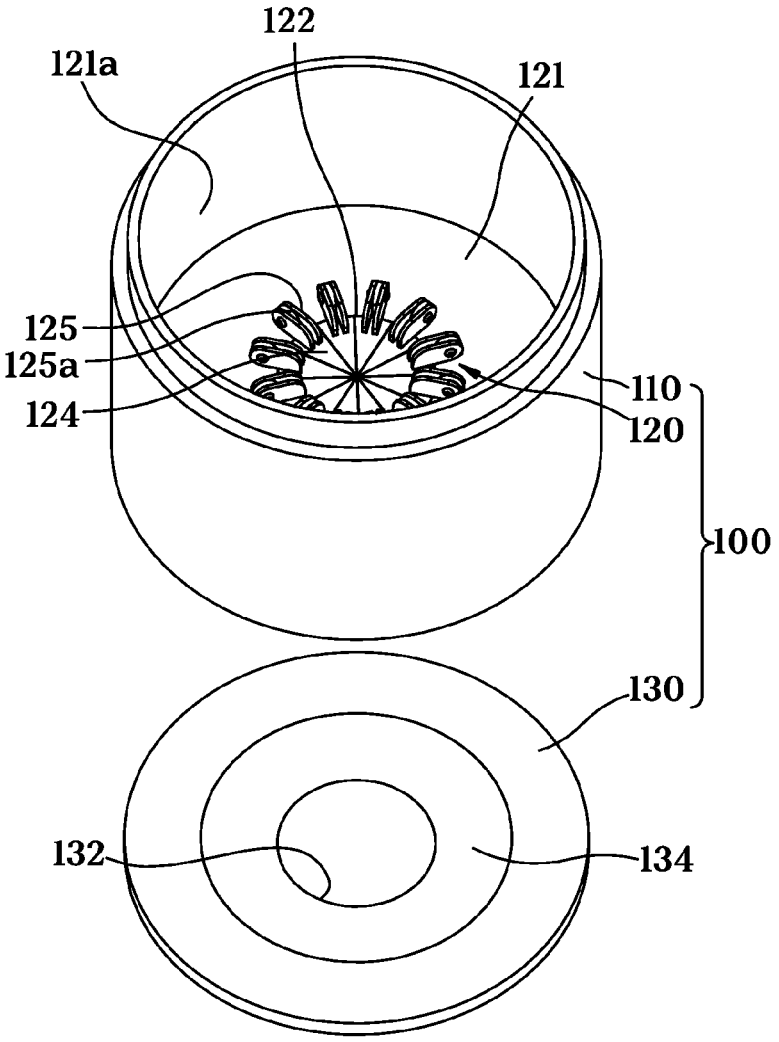
FIG. 13 is an exploded perspective view of the content receiving device according to the third embodiment of the present invention.

FIG. 11 is a perspective view of a container mechanism including a content receiving device according to a third embodiment of the present invention, FIG. 12 is an exploded perspective view of the container mechanism including the content receiving device according to the third embodiment of the present invention, and FIG. 13 is an exploded perspective view of the content receiving device according to the third embodiment of the present invention.

Figure 14:
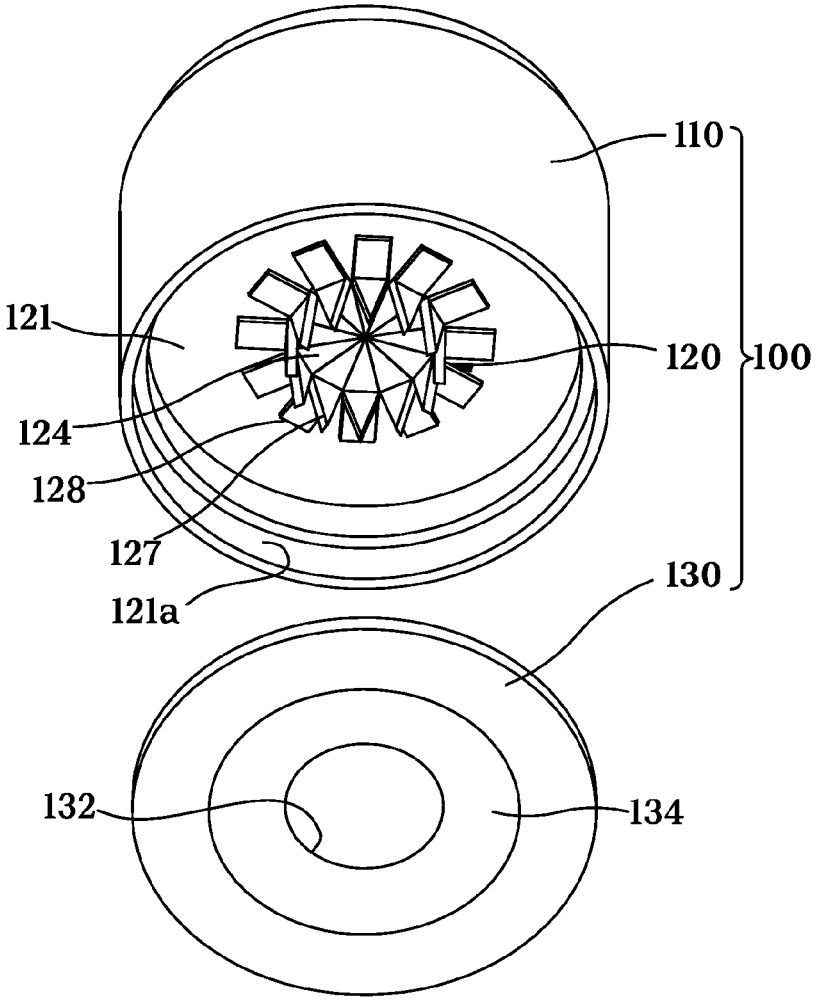
FIG. 14 is a bottom exploded perspective view of the content receiving device according to the third embodiment of the present invention.
Figure 15:
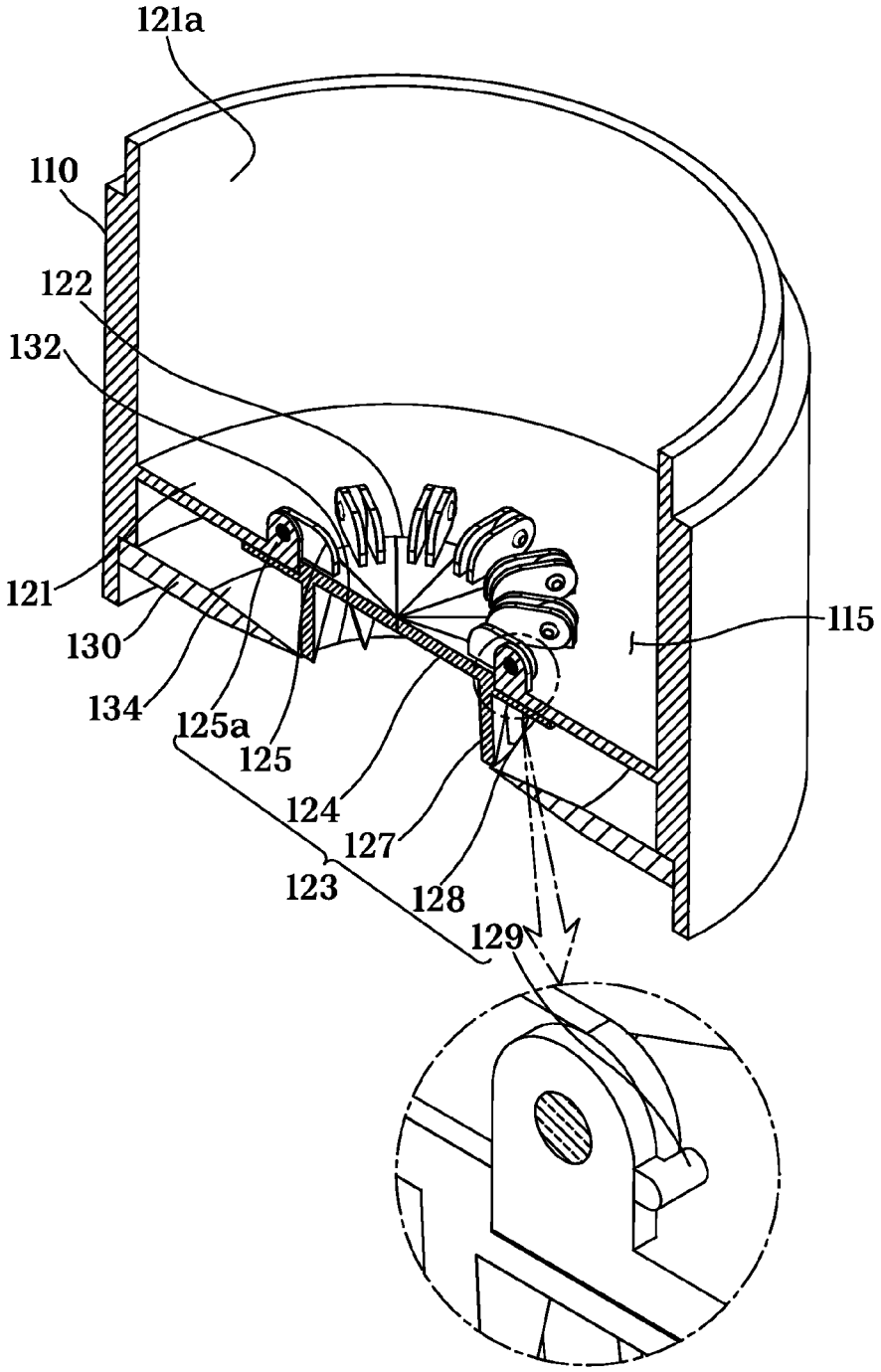
FIG. 15 is a sectional exploded perspective view of the content receiving device according to the third embodiment of the present invention.
Figure 16:
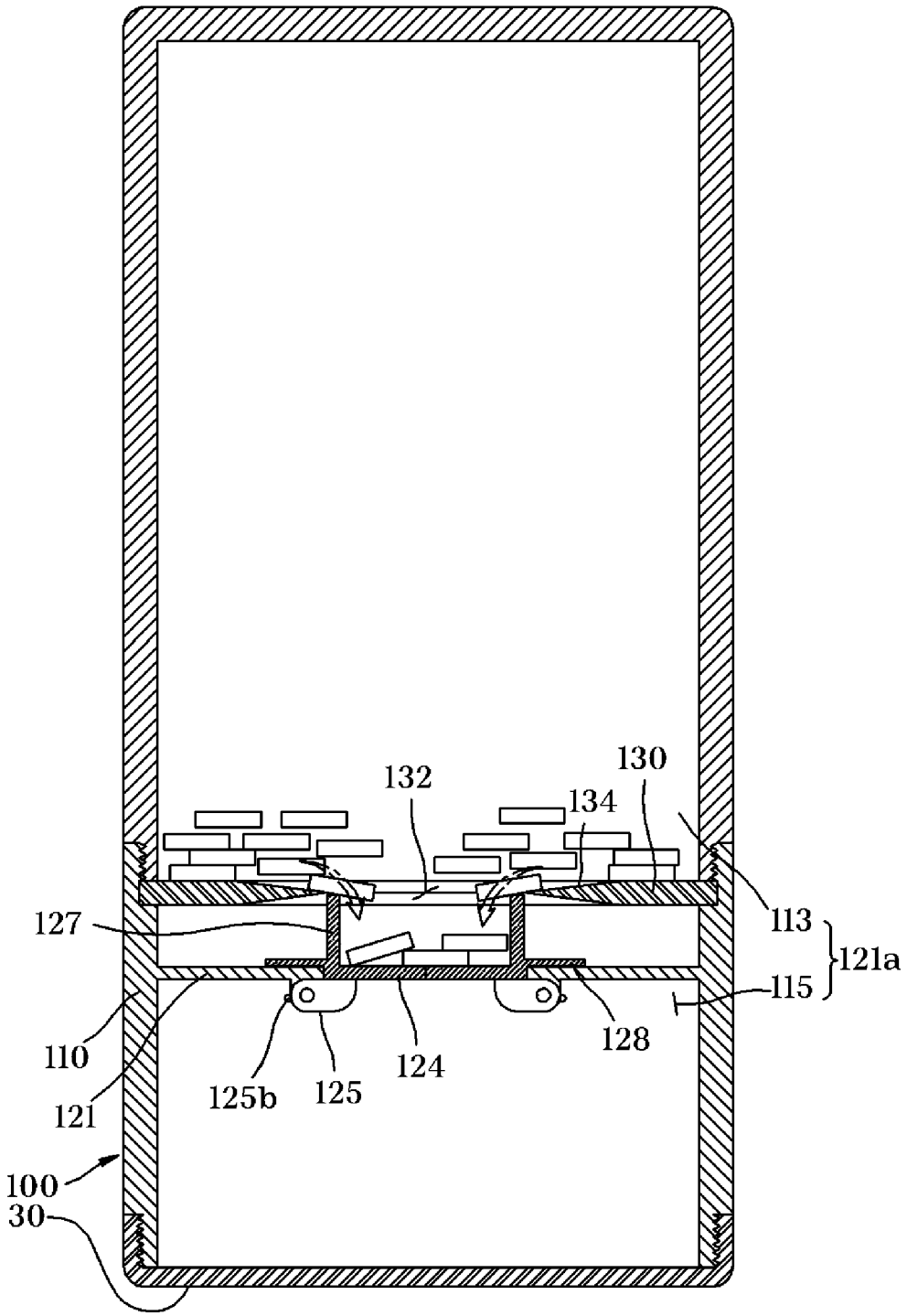
FIG. 16 to FIG. 18 are side sectional views of the container mechanism including the content receiving device according to the third embodiment of the present invention in use.
Figure 17:
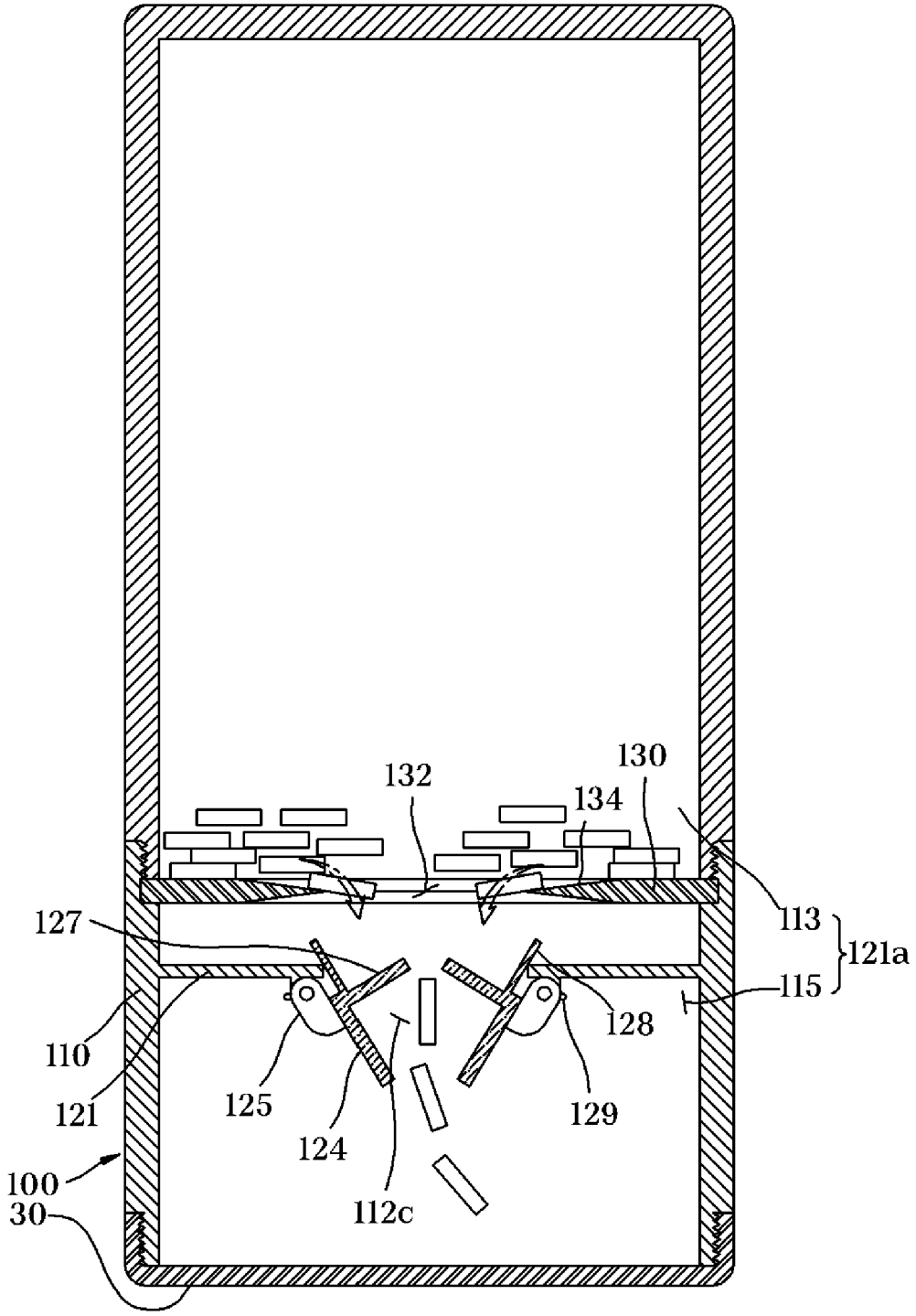
Figure 18:
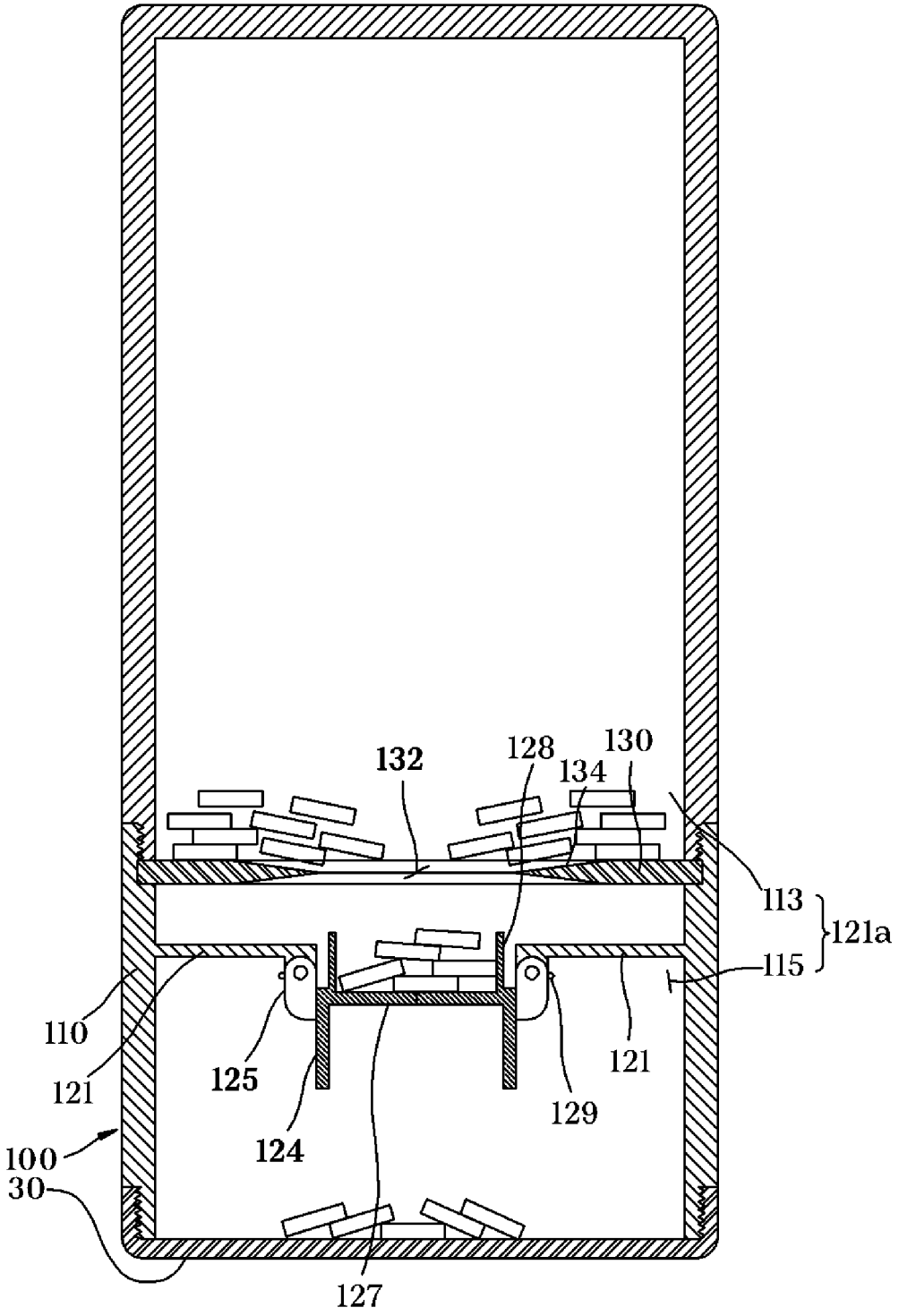

FIG. 14 is a bottom exploded perspective view of the content receiving device according to the third embodiment of the present invention, FIG. 15 is a sectional exploded perspective view of the content receiving device according to the third embodiment of the present invention, and FIG. 16 to FIG. 18 are side sectional views of the container mechanism including the content receiving device according to the third embodiment of the present invention in use.

Figure 19:
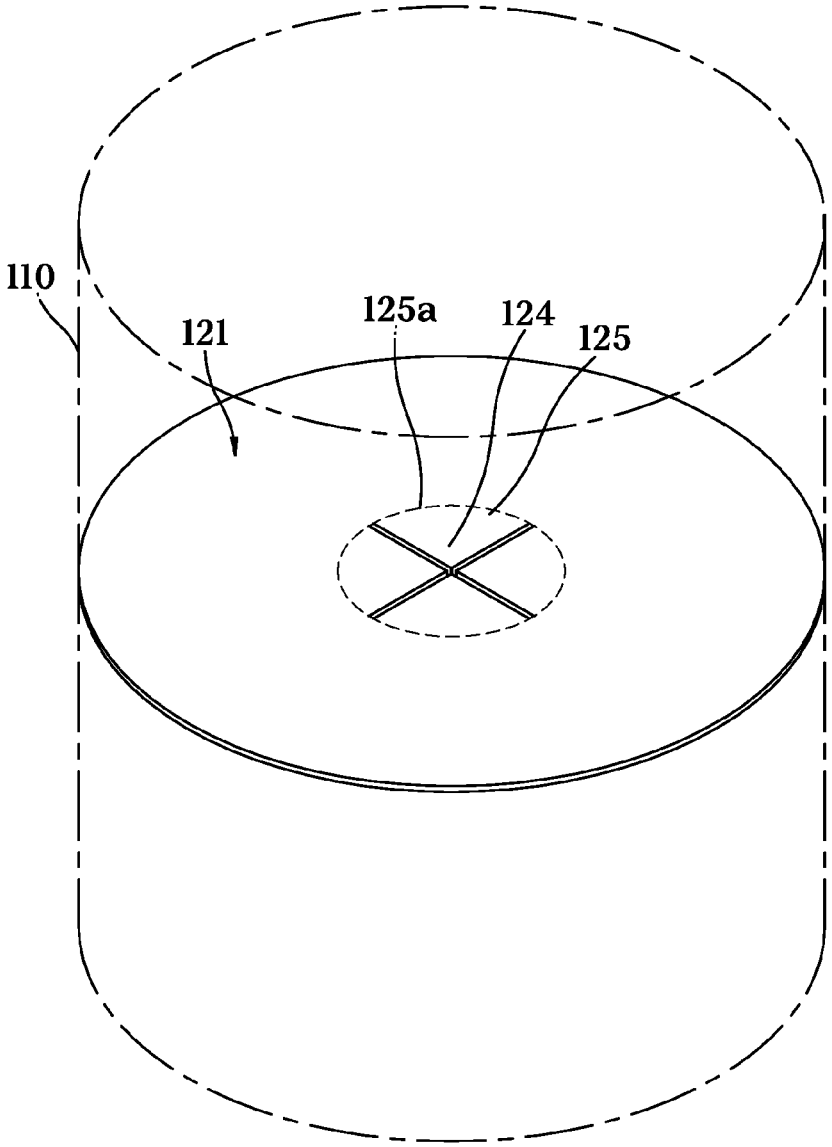
FIG. 19 and FIG. 20 are perspective views of a content receiving device according to a fourth embodiment of the present invention.
Figure 20:
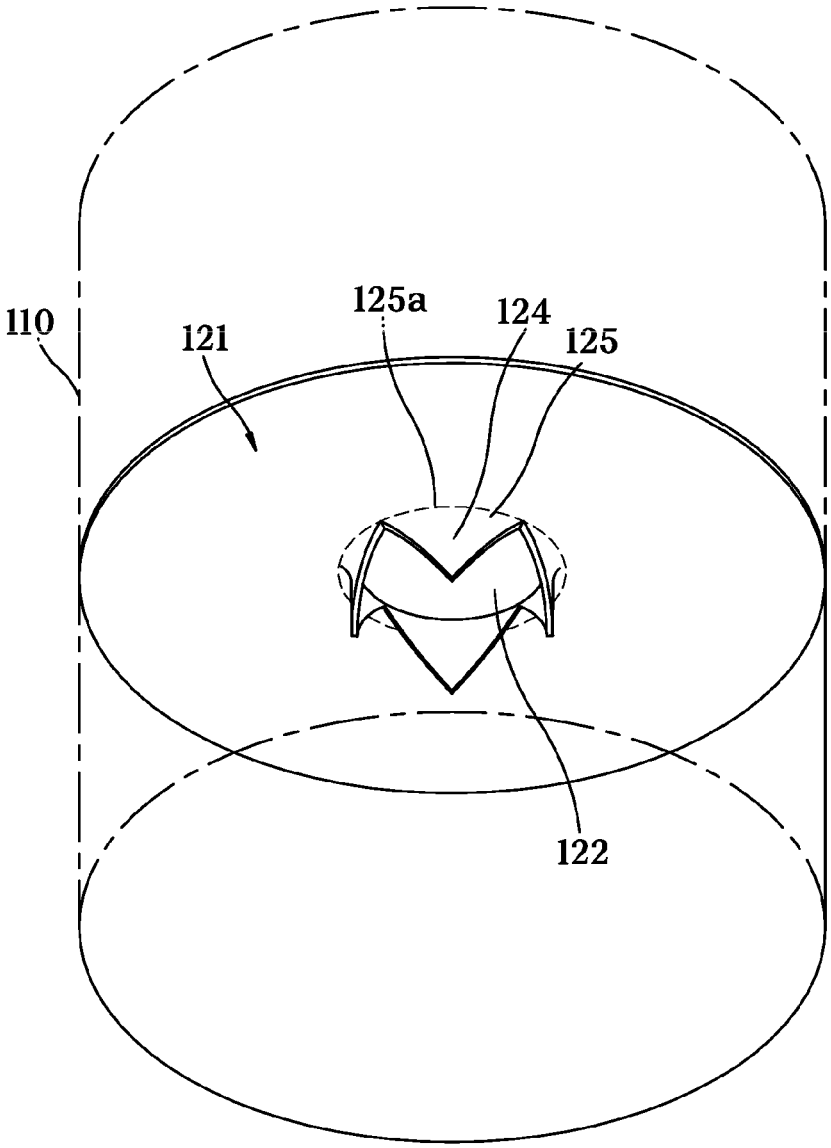

FIG. 19 and FIG. 20 are perspective views of a content receiving device according to a fourth embodiment of the present invention.

Figure 21:
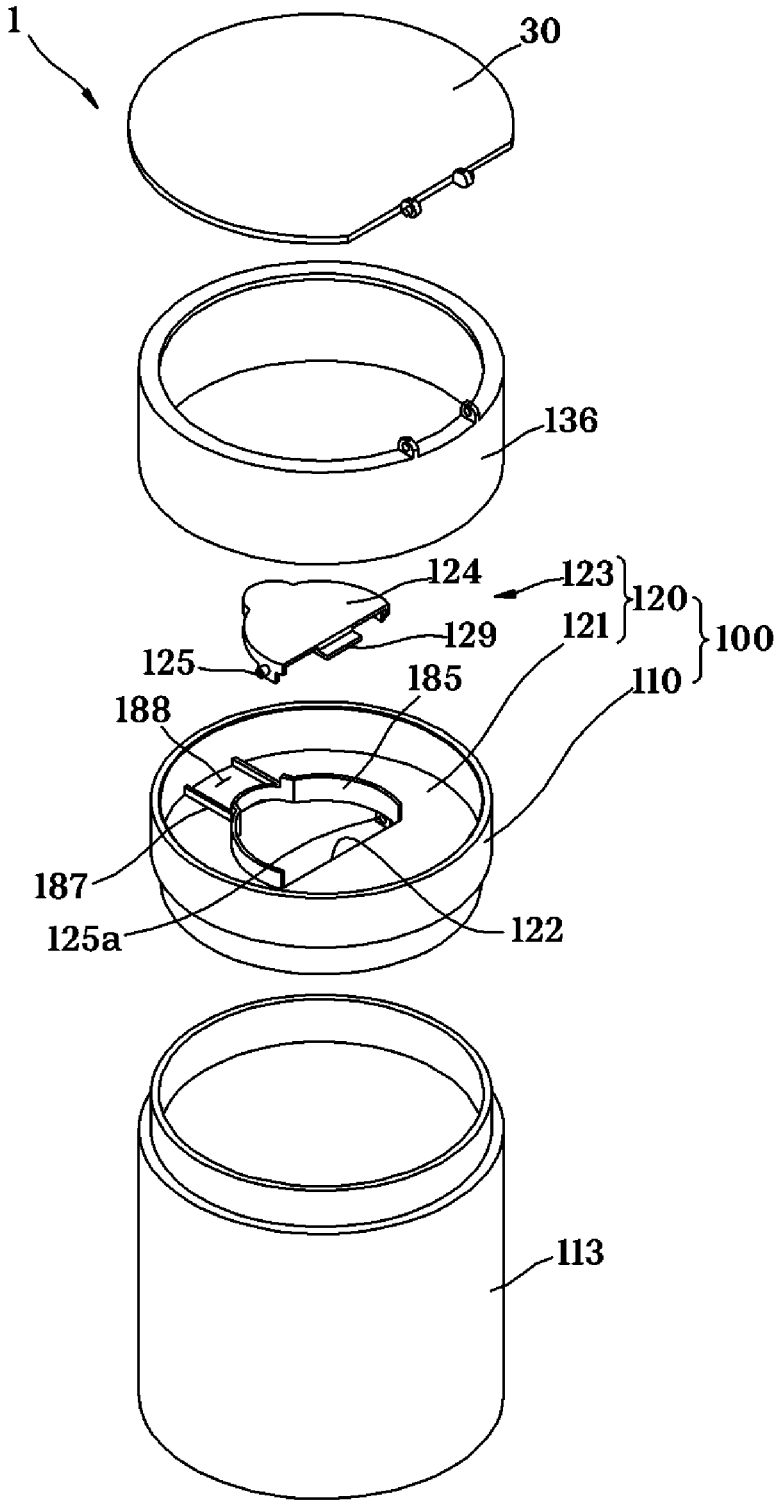
FIG. 21 is an exploded perspective view of a content receiving device according to a fifth embodiment of the present invention.
Figure 22:
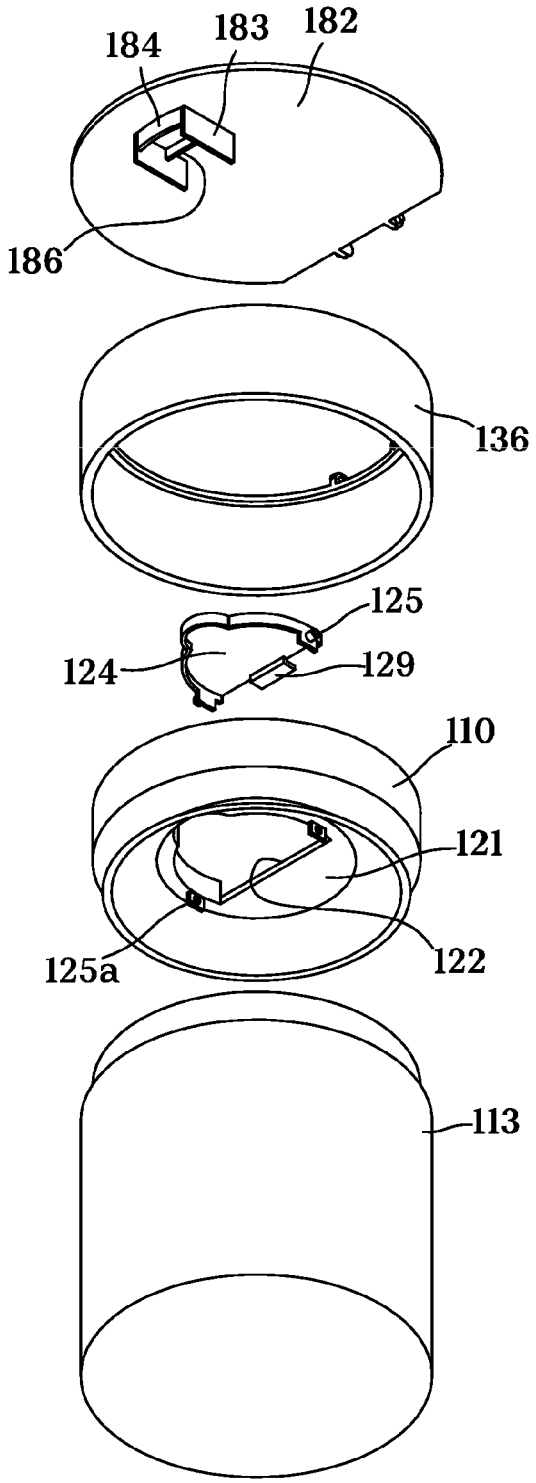
FIG. 22 is a bottom exploded perspective view of the content receiving device according to the fifth embodiment of the present invention.
Figure 23:
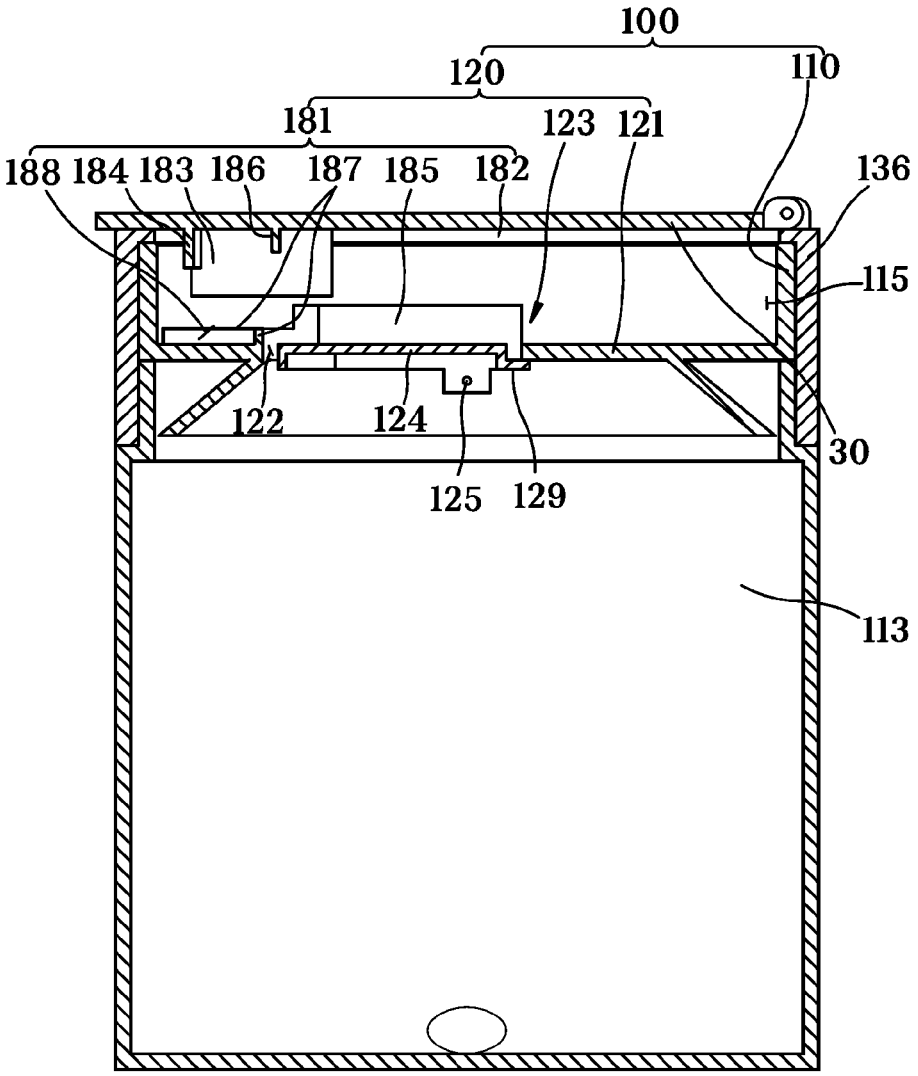
FIG. 23 and FIG. 24 are side sectional view of the content receiving device according to the fifth embodiment of the present invention in use.
Figure 24:
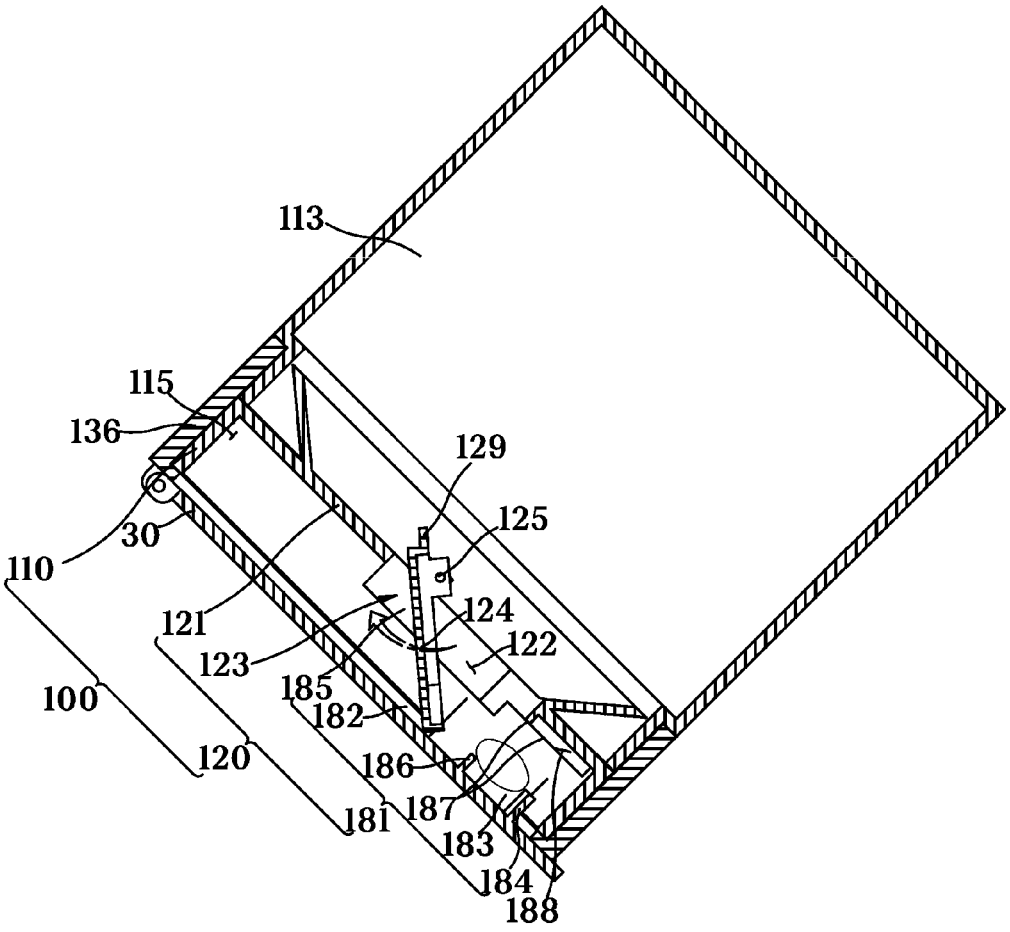

FIG. 21 is an exploded perspective view of a content receiving device according to a fifth embodiment of the present invention, FIG. 22 is a bottom exploded perspective view of the content receiving device according to the fifth embodiment of the present invention, and FIG. 23 and FIG. 24 are side sectional views of the content receiving device according to the fifth embodiment of the present invention in use.

Figure 25:
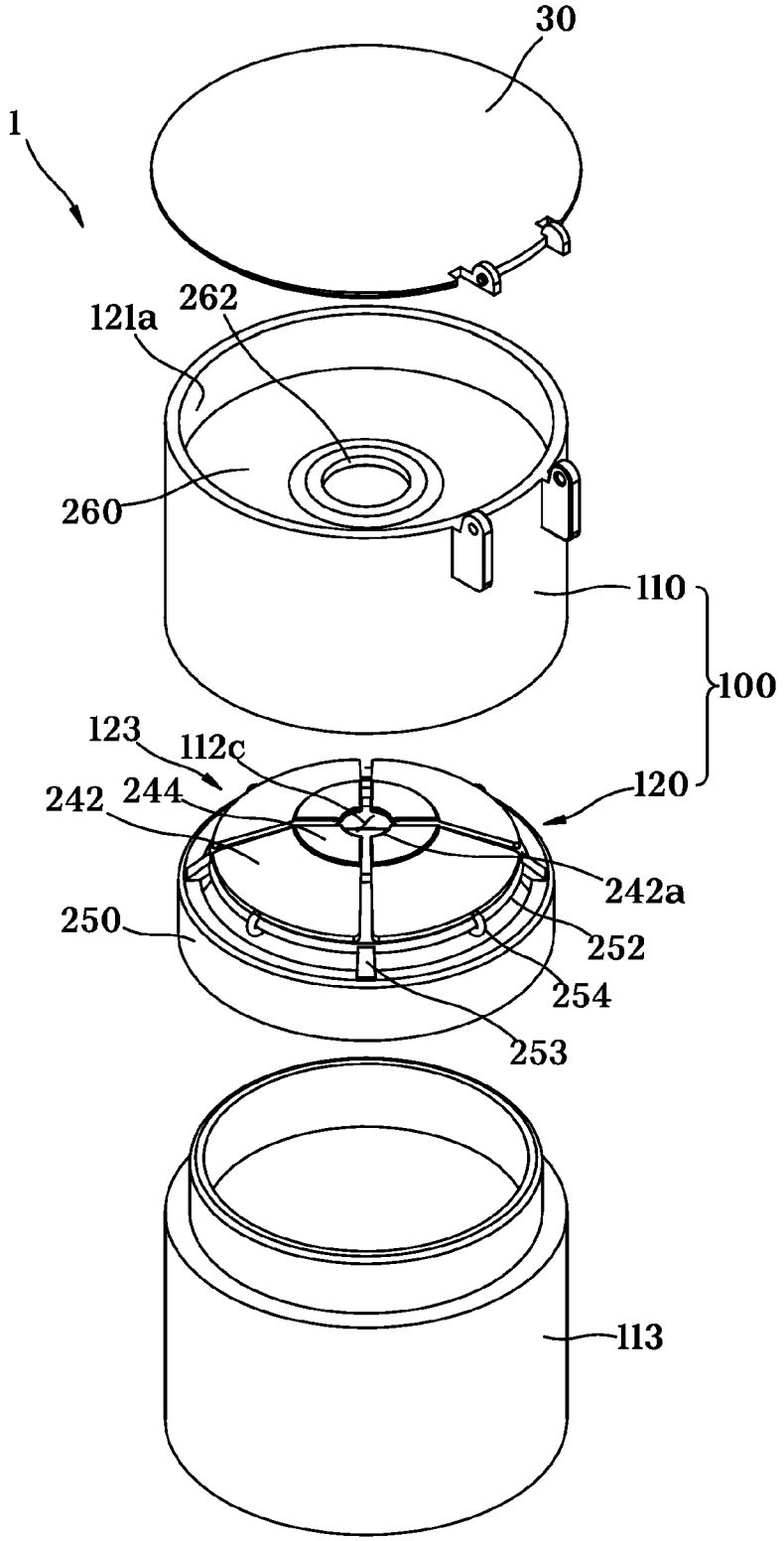
FIG. 25 is an exploded perspective view of a container mechanism including a content receiving device according to a sixth embodiment of the present invention.
Figure 26:
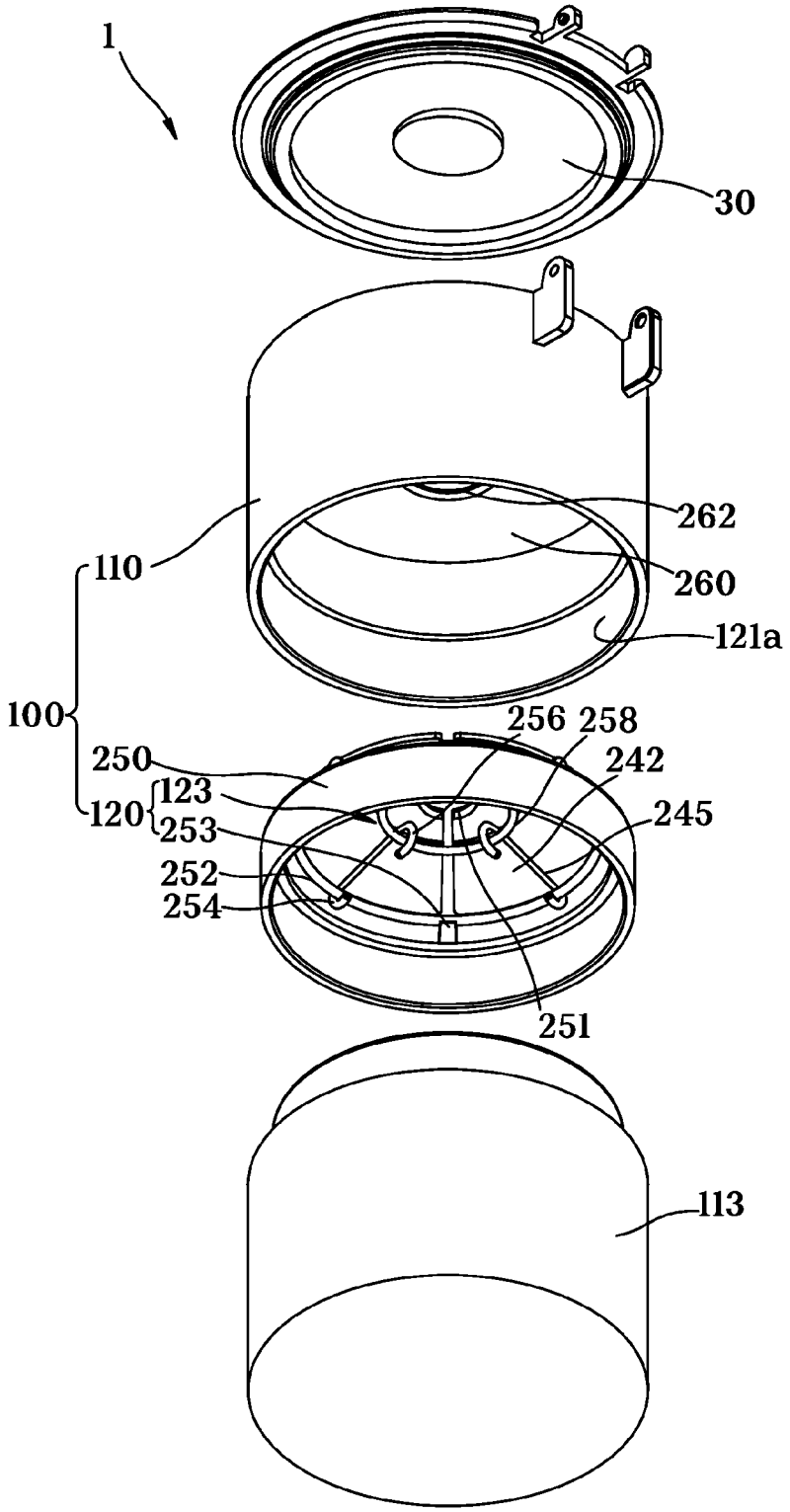
FIG. 26 is a bottom perspective view of an operating mechanism for controlling passage of content of the container mechanism including the content receiving device according to the sixth embodiment of the present invention.

FIG. 25 is an exploded perspective view of a container mechanism including a content receiving device according to a sixth embodiment of the present invention, and FIG. 26 is a bottom perspective view of an operating mechanism for controlling passage of content of the container mechanism including the content receiving device according to the sixth embodiment of the present invention.

Figure 27:
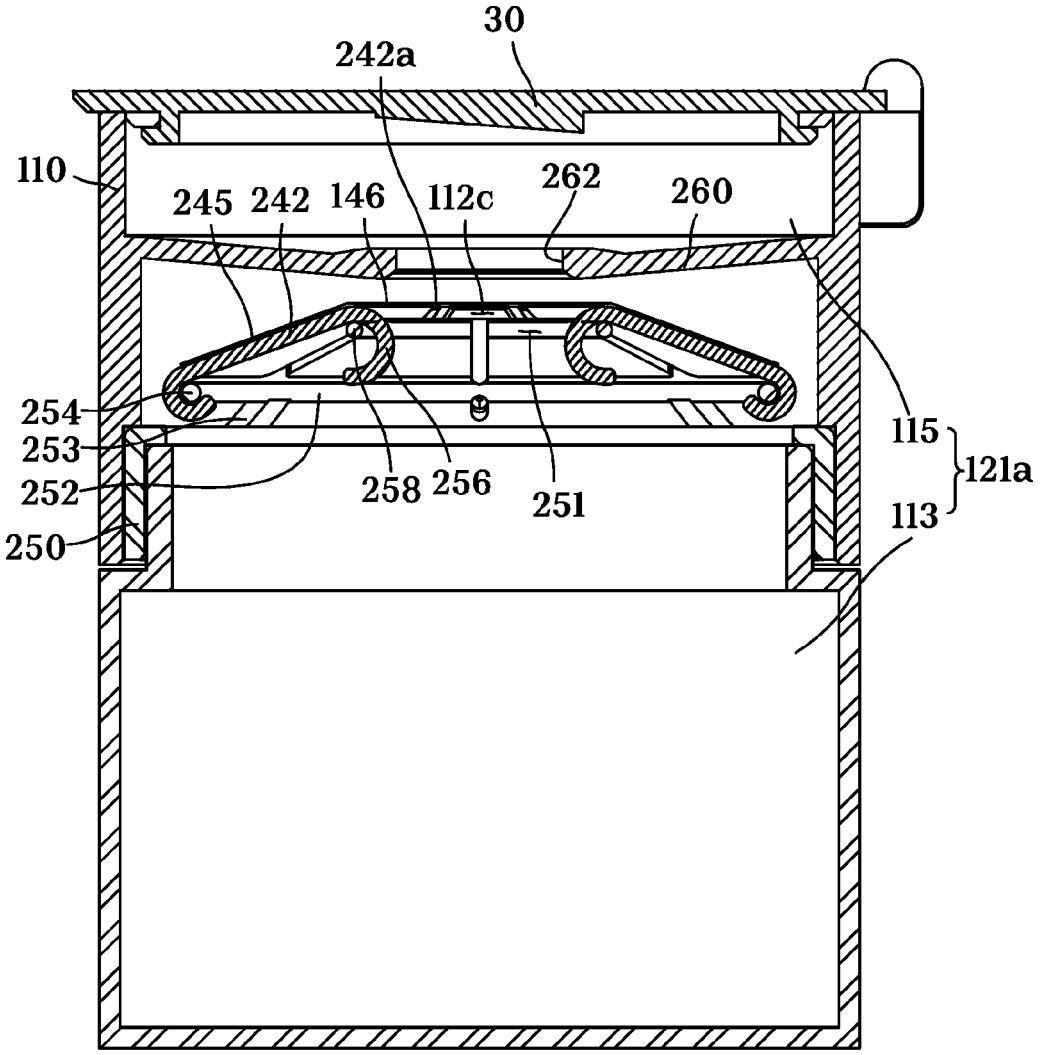
FIG. 27 is a side sectional view of the container mechanism including the content receiving device according to the sixth embodiment of the present invention.
Figure 28:
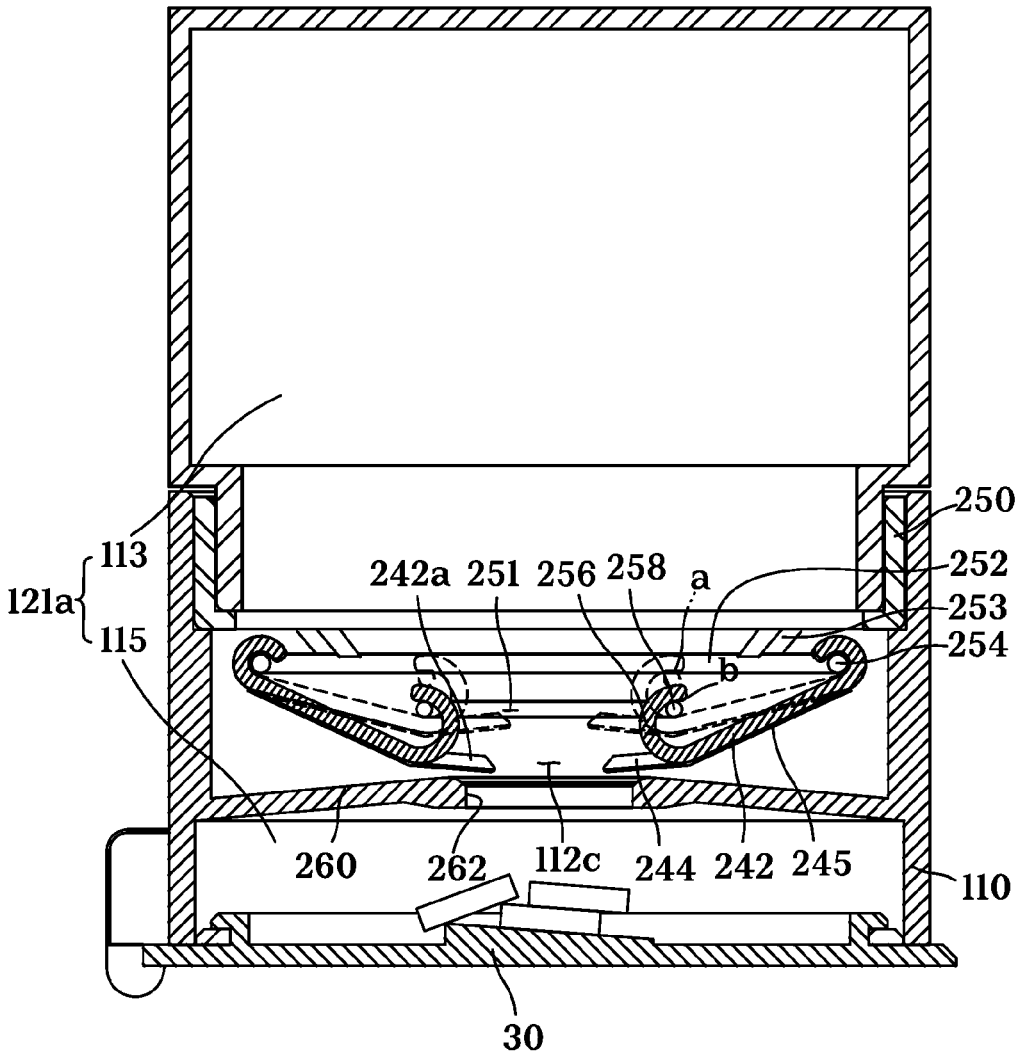
FIG. 28 and FIG. 29 are side sectional views of the container mechanism including the content receiving device according to the sixth embodiment of the present invention in use.
Figure 29:
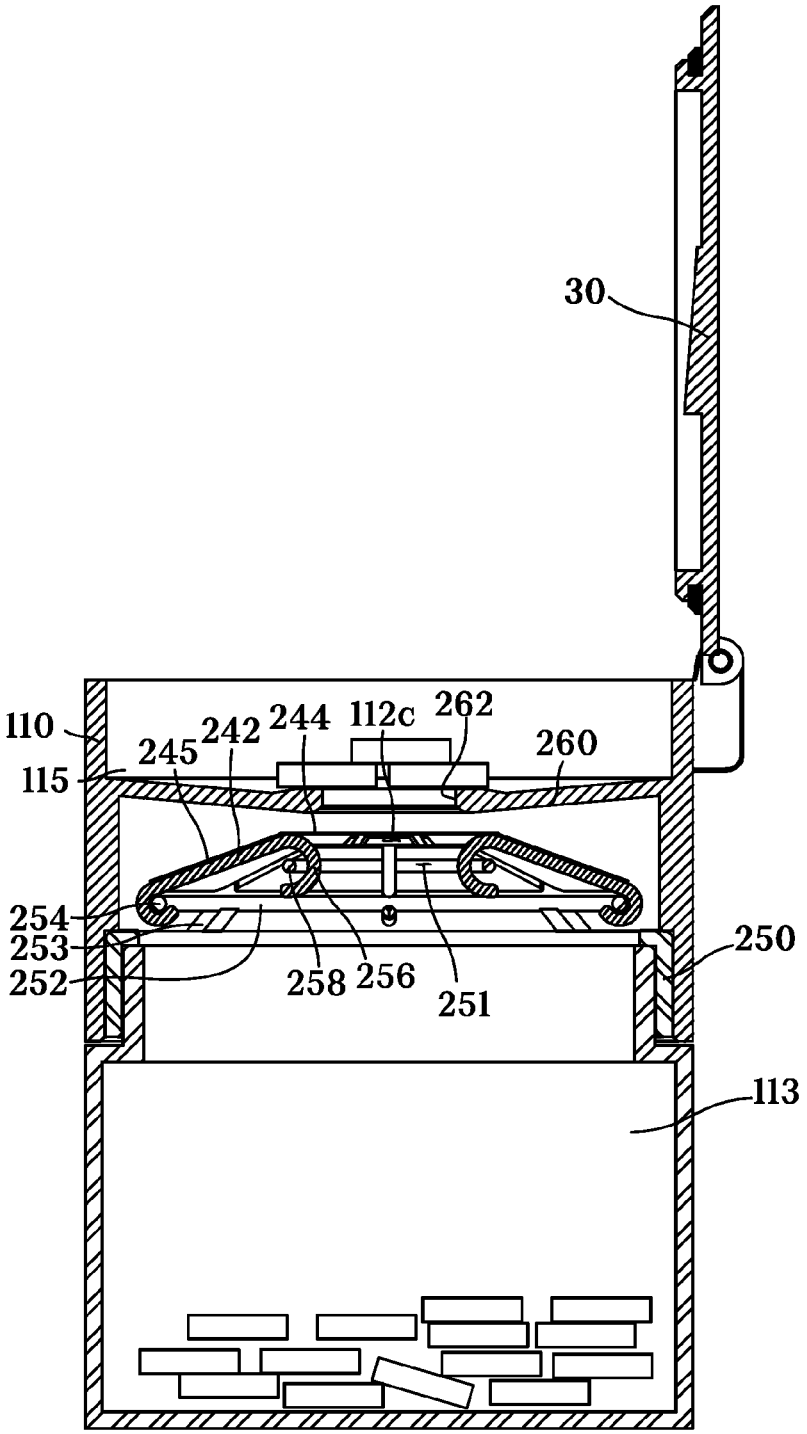

FIG. 27 is a side sectional view of the container mechanism including the content receiving device according to the sixth embodiment of the present invention, and FIG. 28 and FIG. 29 are side sectional views of the container mechanism including the content receiving device according to the sixth embodiment of the present invention in use.

Figure 30:
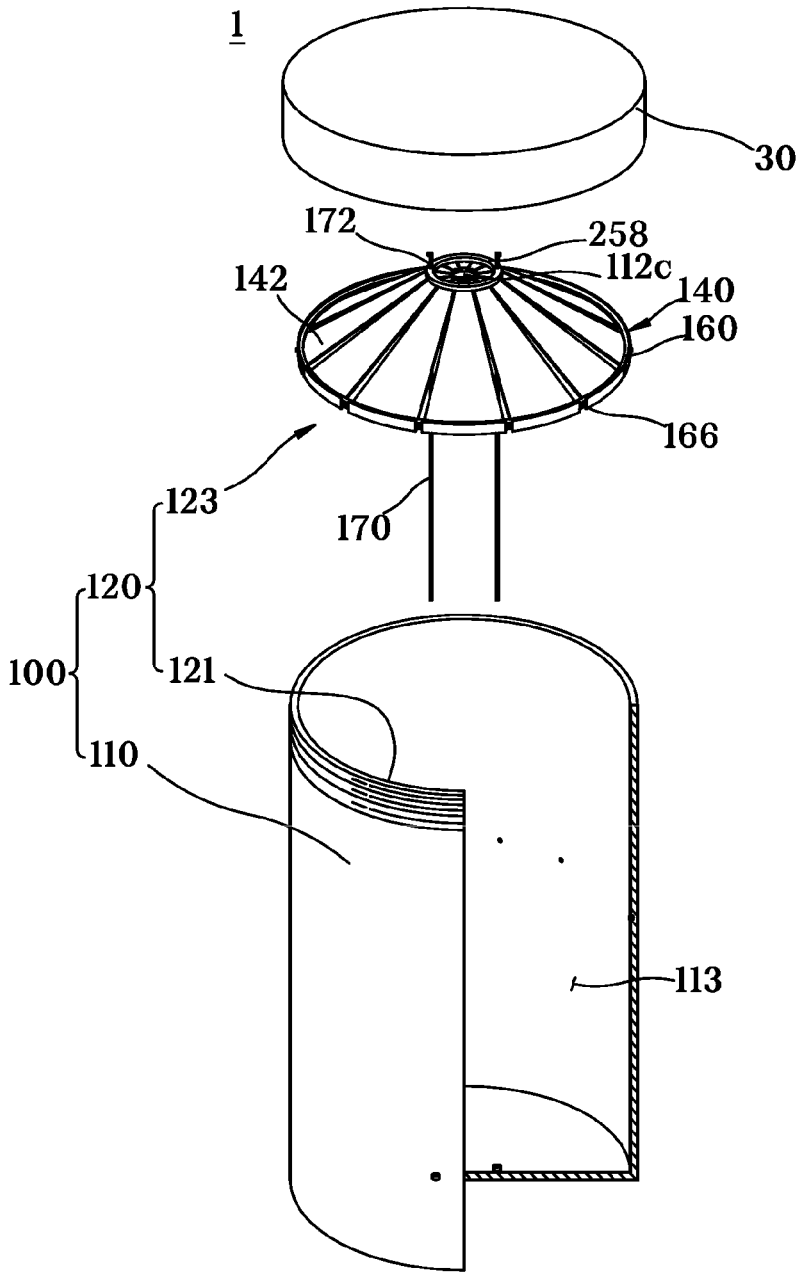
FIG. 30 is an exploded perspective view of a container mechanism including a content receiving device according to a seventh embodiment of the present invention.
Figure 31:
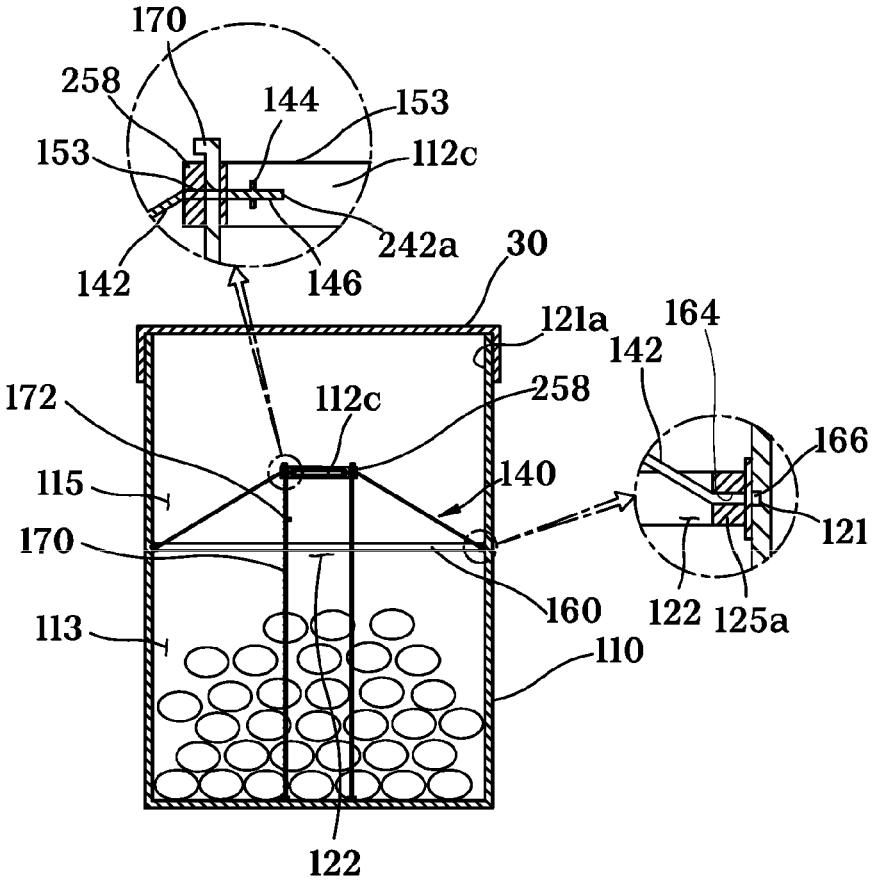
FIG. 31 is a side sectional view of the container mechanism including the content receiving device according to the seventh embodiment of the present invention.
Figure 32:
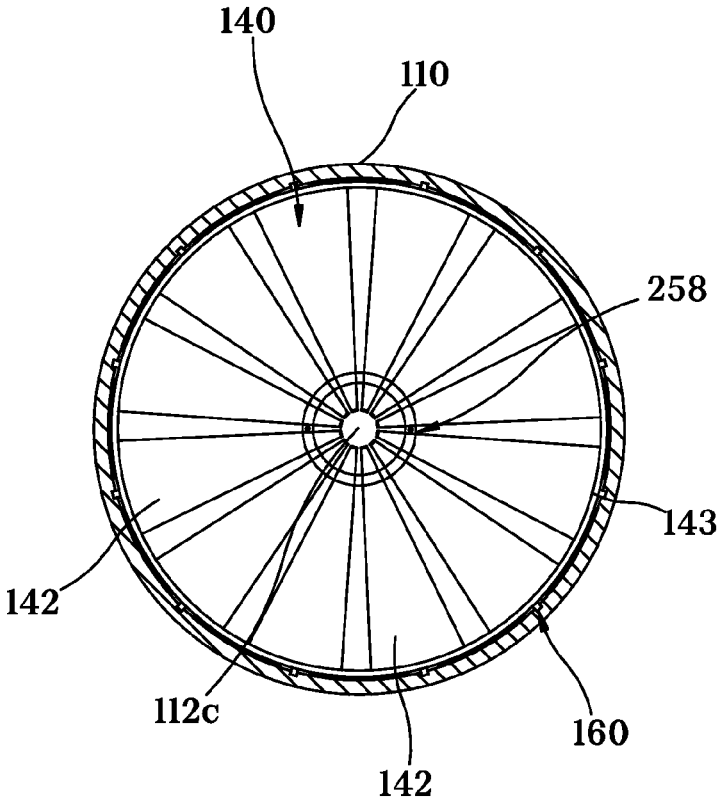
FIG. 32 is a plan view of an operating mechanism for controlling passage of content according to the seventh embodiment of the present invention.

FIG. 30 is an exploded perspective view of a container mechanism including a content receiving device according to a seventh embodiment of the present invention, FIG. 31 is a side sectional view of the container mechanism including the content receiving device according to the seventh embodiment of the present invention, and FIG. 32 is a plan view of an operating mechanism for controlling passage of content according to the seventh embodiment of the present invention.

Figure 33:
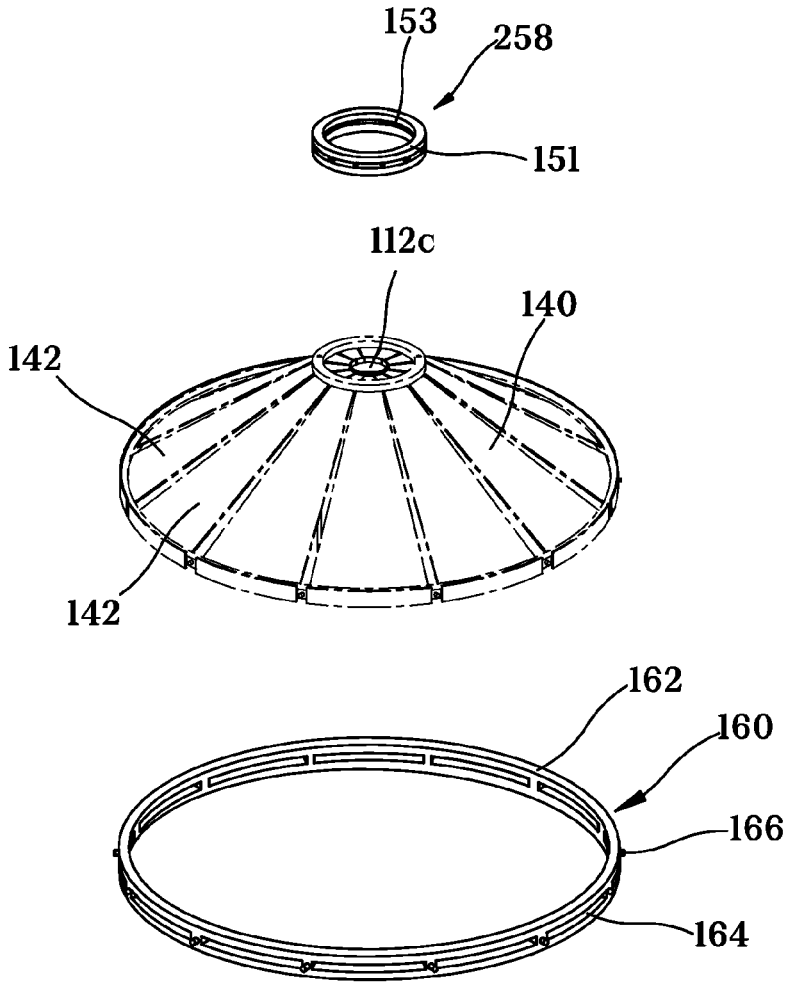
FIG. 33 is an exploded perspective view of the operating mechanism for controlling passage of content according to the seventh embodiment of the present invention.
Figure 34:
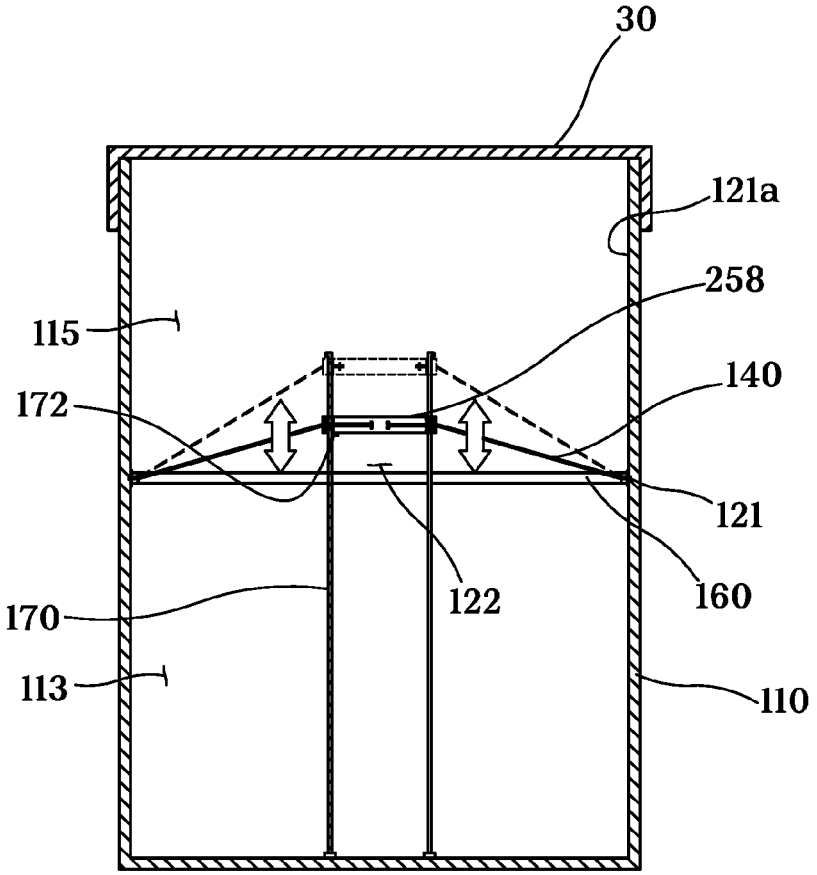
FIG. 34 and FIG. 35 are side sectional views of the operating mechanism for controlling passage of content according to the seventh embodiment of the present invention in use.
Figure 35:
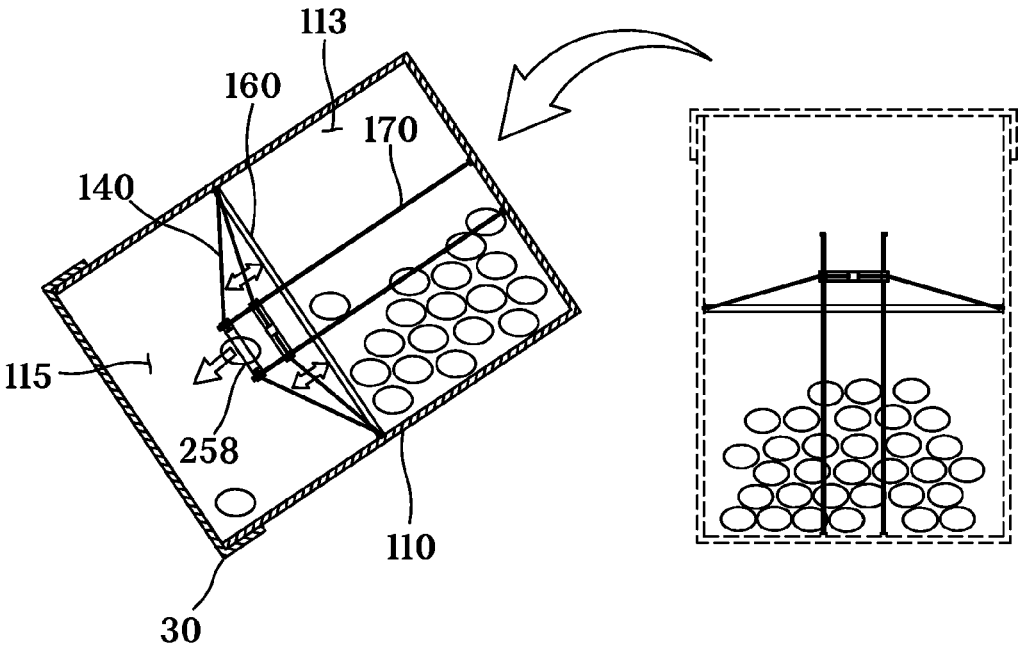

FIG. 33 is an exploded perspective view of the operating mechanism for controlling passage of content according to the seventh embodiment of the present invention, and FIG. 34 and FIG. 35 are side sectional views of the operating mechanism for controlling passage of content according to the seventh embodiment of the present invention in use.

Figure 36:
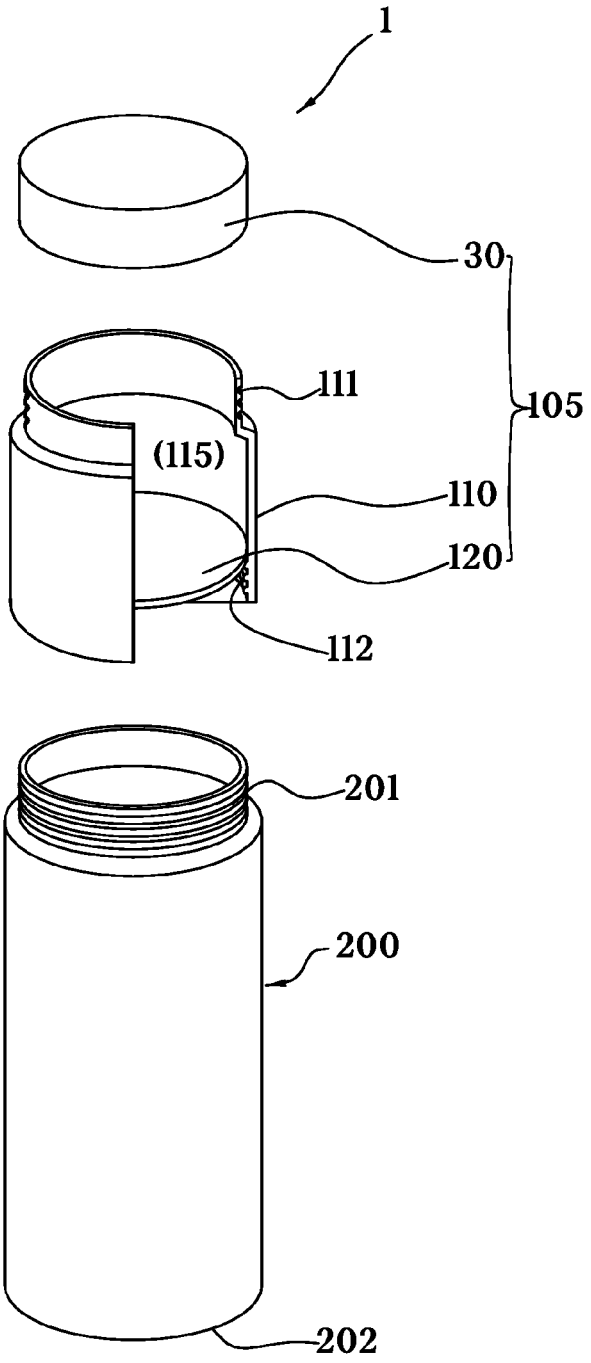
FIG. 36 is an exploded perspective view of a container mechanism including a content receiving device according to an eighth embodiment of the present invention.
Figure 37:
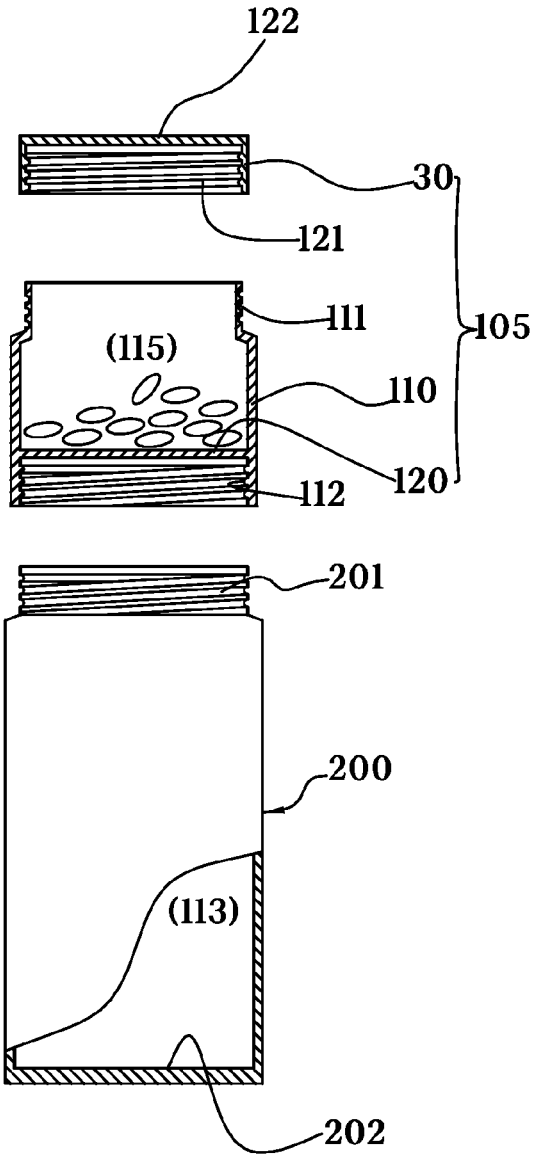
FIG. 37 is a longitudinal sectional view of the container mechanism including the content receiving device according to the eighth embodiment of the present invention.

FIG. 36 is an exploded perspective view of a container mechanism including a content receiving device according to an eighth embodiment of the present invention, and FIG. 37 is a longitudinal sectional view of the container mechanism including the content receiving device according to the eighth embodiment of the present invention.

Figure 38:
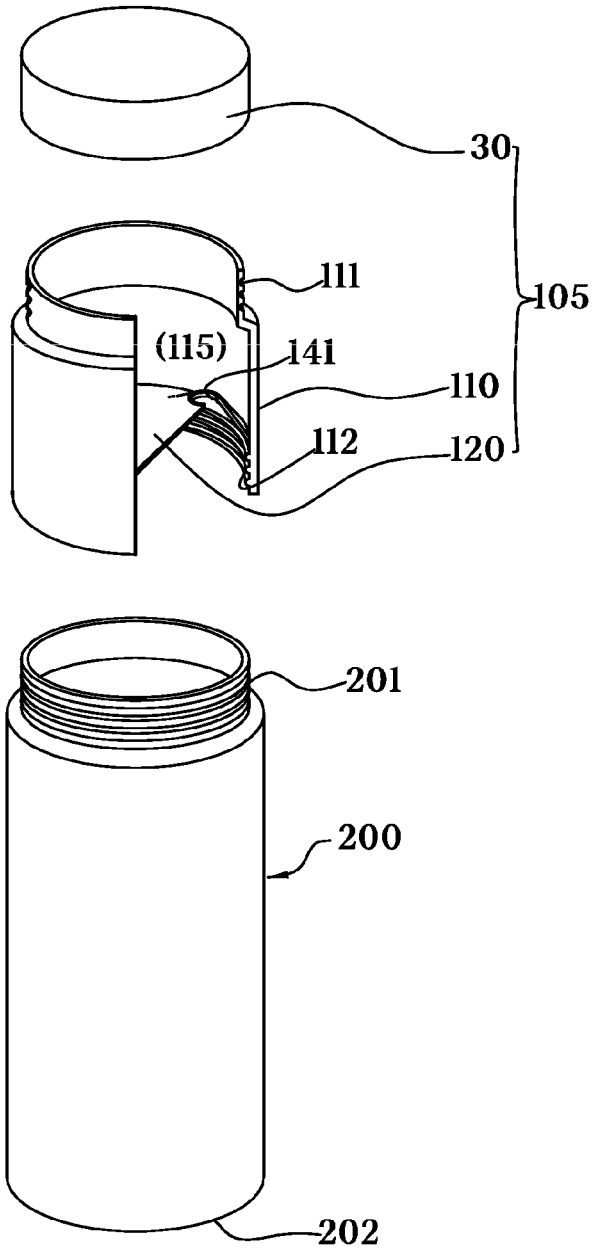
FIG. 38 is an exploded perspective view of a container mechanism including a content receiving device according to a ninth embodiment of the present invention.
Figure 39:
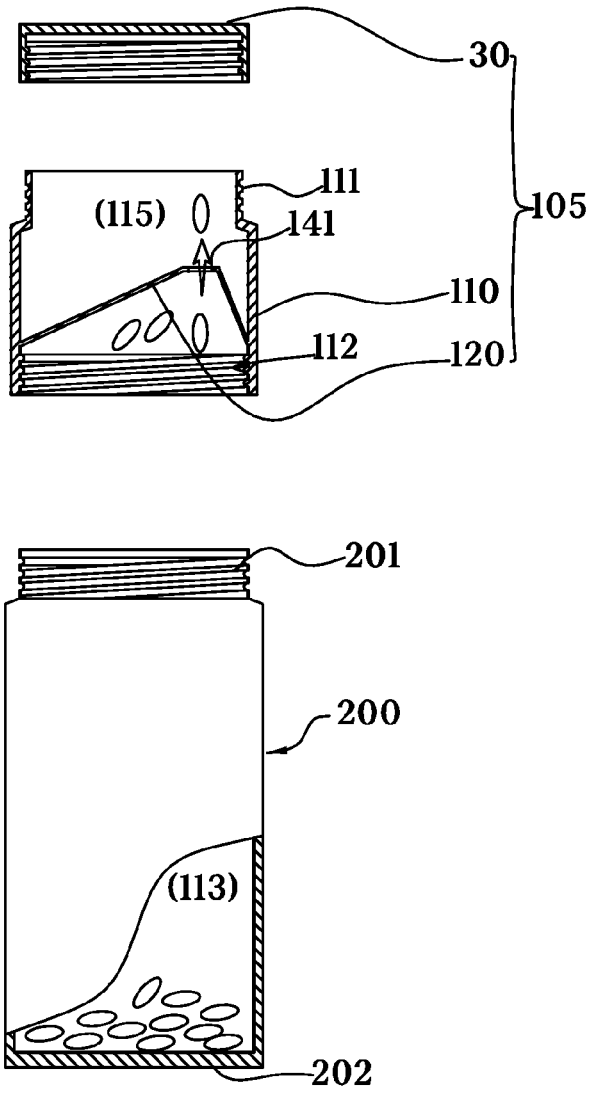
FIG. 39 is a longitudinal sectional view of the container mechanism including the content receiving device according to the ninth embodiment of the present invention.
Figure 40:
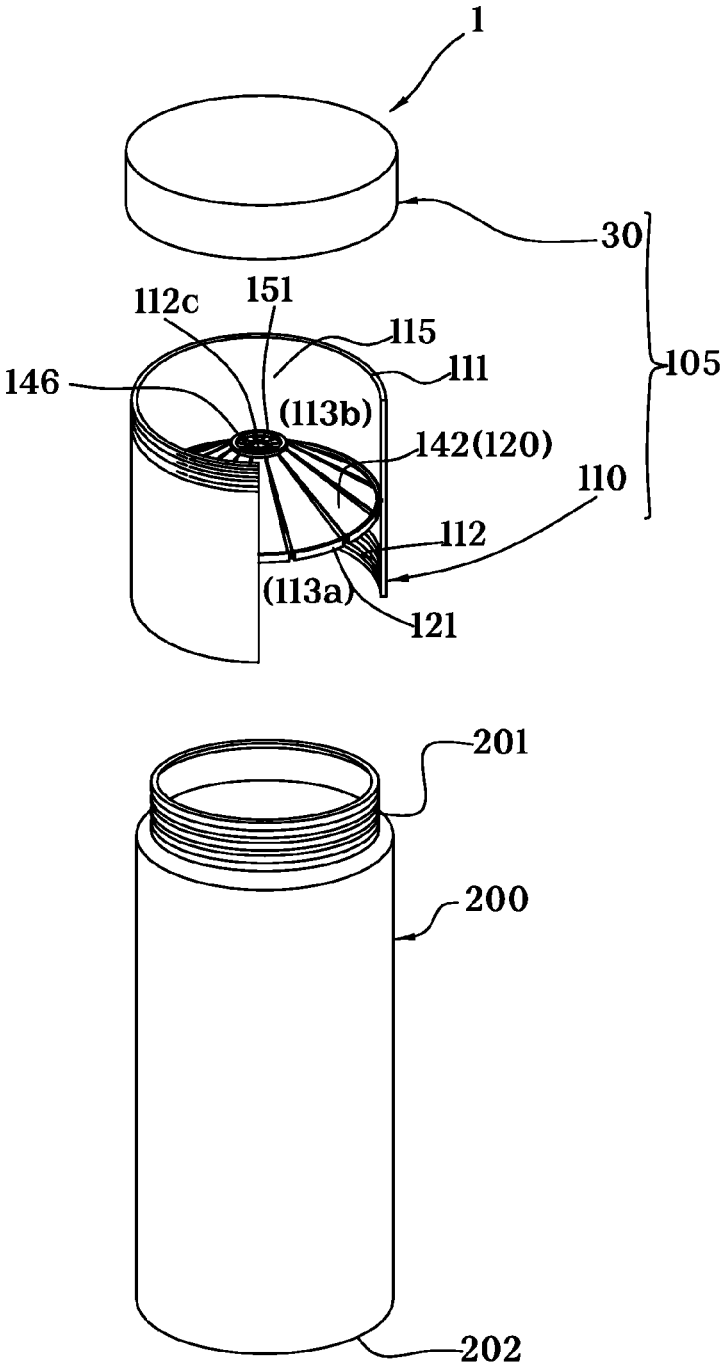
FIG. 40 is an exploded perspective view of the container mechanism including the content receiving device according to the ninth embodiment of the present invention.
Figure 41:
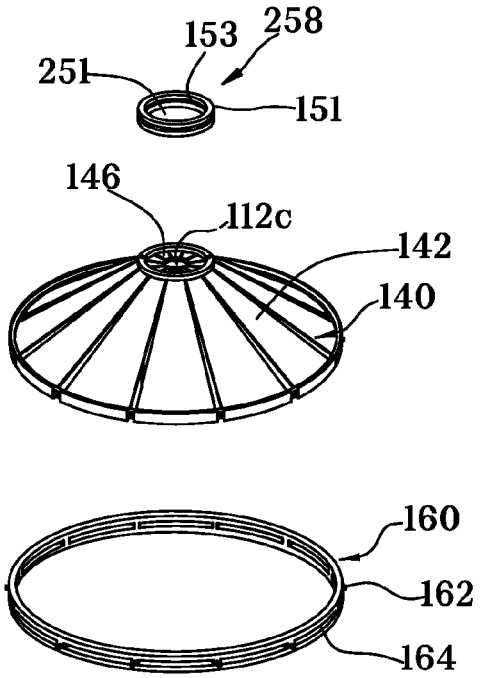
FIG. 41 is an exploded perspective view of the content receiving device according to the ninth embodiment of the present invention.
Figure 42:
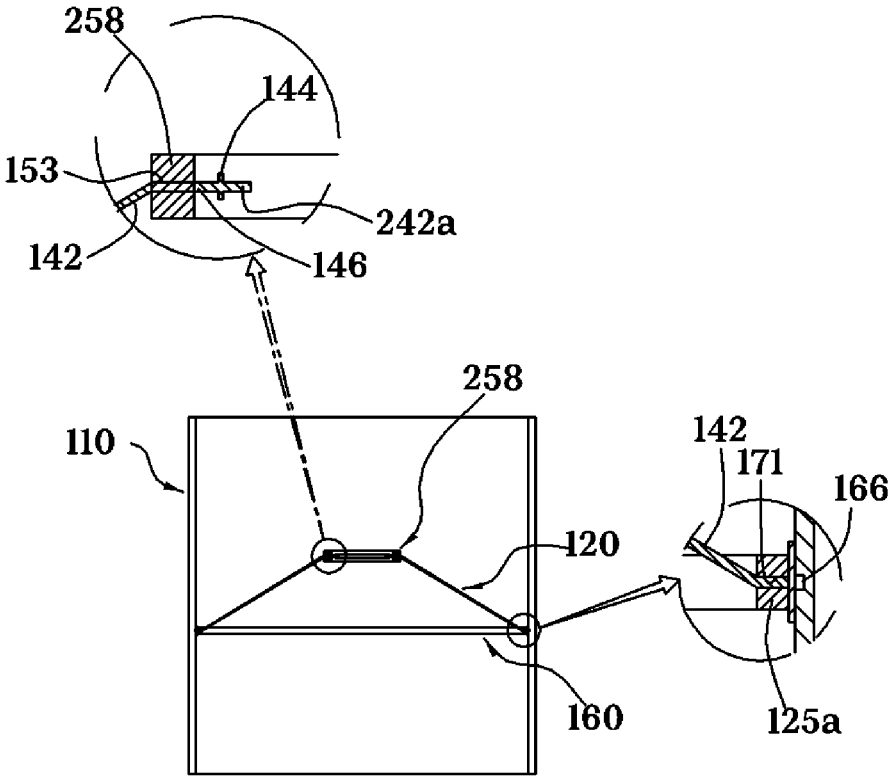
FIG. 42 is a side sectional view of the content receiving device according to the ninth embodiment of the present invention.
Figure 43:
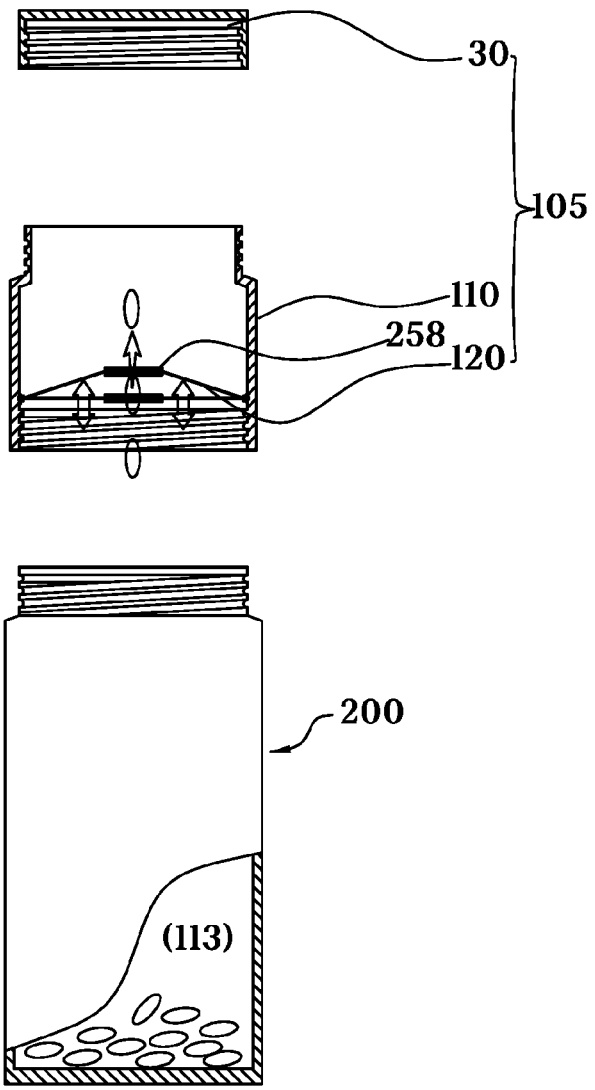
FIG. 43 is a longitudinal sectional view of container mechanism including the content receiving device according to the ninth embodiment of the present invention.

FIG. 38 is an exploded perspective view of a container mechanism including a content receiving device according to a ninth embodiment of the present invention, FIG. 39 is a longitudinal sectional view of the container mechanism including the content receiving device according to the ninth embodiment of the present invention, and FIG. 40 is an exploded perspective view of the container mechanism including the content receiving device according to the ninth embodiment of the present invention FIG. 41 is an exploded perspective view of the content receiving device according to the ninth embodiment of the present invention, FIG. 42 is a side sectional view of the content receiving device according to the ninth embodiment of the present invention, and FIG. 43 is a longitudinal sectional view of a container mechanism including the content receiving device according to the ninth embodiment of the present invention.

Figure 44:
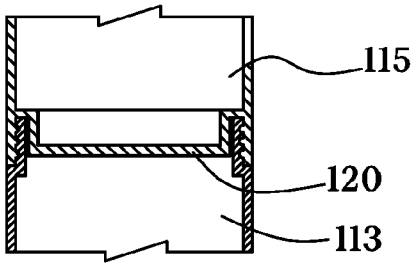
FIG. 44 and FIG. 45 are side sectional views of a content receiving device according to a tenth embodiment of the present invention.
Figure 46:
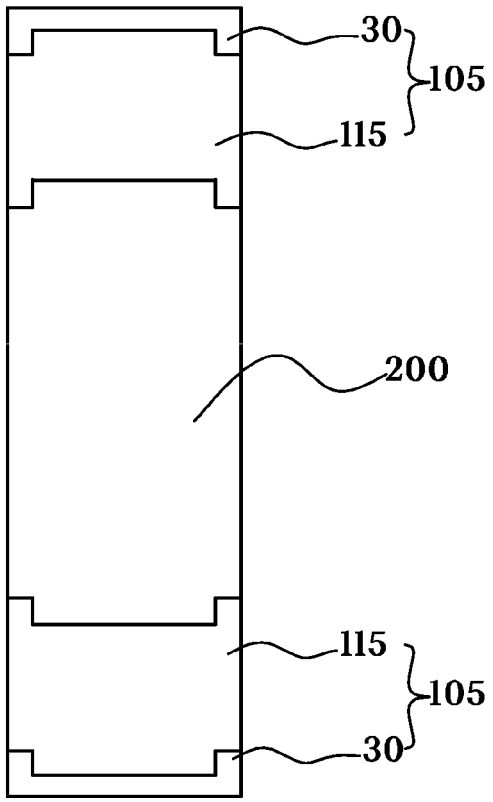
FIG. 46 is a configurational view of a container mechanism including the content receiving device according to the tenth embodiment of the present invention.
Figure 45:
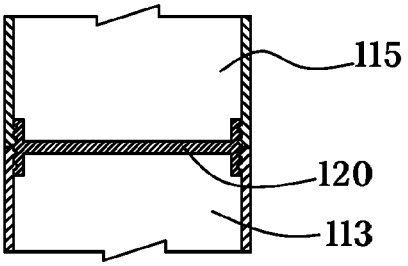

FIG. 44 and FIG. 45 are side sectional views of a content receiving device according to a tenth embodiment of the present invention, and FIG. 46 is a configurational view of a container mechanism including the content receiving device according to the tenth embodiment of the present invention.

DETAILED DESCRIPTION OF EXEMPLARY EMBODIMENTS

Herein, the term "upper portion (upper side)" will refer to a side of opening or closing an opening and closing mechanism when a container mechanism is directed upward, and the term "front side" will refer to a side of opening or closing the opening and closing mechanism when the container mechanism is tilted.

Referring to FIG. 1 to FIG. 4, a container mechanism 1 including a content receiving device 100 according to a first embodiment of the invention includes a storage portion 113, a housing 110, and an operating mechanism for controlling passage of content 120.

The storage portion 113 serves to receive and store content. The storage portion 113 is open at one side thereof, through which the content is received or passes. Obviously, the storage portion 113 may have various shapes and may be formed of various materials.

The housing 110 is provided to a passage side of the storage portion 113 in which the content is received. That is, a lower side of the housing 110 is connected to the storage portion 113. Here, the content may be a solid, powder, or liquid.

Particularly, the housing 110 may be releasably coupled to a content passage side of the storage portion 113 or may be integrally formed with the storage portion 113. For convenience of description, the housing 110 is illustrated as being releasably coupled to the storage portion 113. In this case, the housing 110 may be releasably coupled to the storage portion 113 by screw fastening. Obviously, the housing 110 may have various shapes and may be formed of various materials.

The housing 110 is provided with a cavity 121*a* that is open at opposite sides thereof.

The operating mechanism for controlling passage of content 120 is disposed inside the housing 110 to guide the content received in the storage portion 113 to be moved by a demand amount or demanded quantity. As used herein, the term "demand amount" means the same number or amount, and the number or amount within allowable error limits. The term "demand amount" refers to an amount (number) that a user demands and is included in the meaning of the "demand amount".

The housing 110 is provided at an upper side thereof with a cover 30. The cover 30 receives the content that is moved by a demand amount through the operating mechanism for controlling passage of content 120. The cover 30 is releasably coupled to the housing 110.

The housing 110 may act as an opening and closing mechanism 110 for opening or closing the storage portion 113 of a container body, and may be provided to a content passage side of the separate storage portion 113 to be releasably coupled to the content passage side.

The opening and closing mechanism 110 is formed to have the storage portion 113 inside the opening and closing mechanism 110, and the cover 30 is fastened to an upper end of the opening and closing mechanism 110 to act as an opening and closing mechanism cap 30. The operating mechanism for controlling passage of content 120 is provided with a content passage unit 123 and may be disposed inside the opening and closing mechanism 110 or inside the storage portion 113.

The operating mechanism for controlling passage of content 120 includes a stationary member 121 and the content passage unit 123.

The stationary member 121 is disposed on an inner surface of the cavity 121*a* of the housing 110. With this structure, the stationary member 121 divides the interior of the housing 110, particularly, the cavity 121*a*. That is, the cavity 121*a* of the housing 110 is divided by the stationary member 121. In other words, the cavity 121*a* is divided into the storage portion 113 in which the content is stored, and a temporary receiving portion 115 in which a demand amount of the content having passed through the storage portion 113 is on standby for withdrawal. The storage portion 113 is open towards the storage portion 113 and the temporary receiving portion 115 is open towards the cover 30.

The stationary member 121 may be disposed inside the cavity 121*a*, without being limited thereto.

The stationary member 121 is formed with an opening 122. The opening 122 connects the temporary receiving portion 115 of the housing 110 to the storage portion 113 thereof such that the content can be withdrawn therethrough. Here, the number and diameter of the opening 122 are not particularly limited.

The opening 122 may have various shapes, for example, a circular shape or a polygonal shape in plan view. For convenience of description, the opening is illustrated as having a rectangular shape.

The stationary member 121 may be integrally formed with the housing 110 or may be releasably coupled thereto. The stationary member 121 may have various shapes.

The content passage unit 123 serves to guide passage of a demand amount of the content through the opening 122. That is, the content passage unit 123 adjoins the opening 122 to allow a demand amount of the content to pass through the opening 122.

The content passage unit 123 includes opening members 124, moving members 125, movement securing portions 125*a*, blocking plates 127, and guide plates 102.

Each of the moving members 125 movably connects the opening member 124 to the movement securing portion 125*a*. The moving member 125 is movably connected to the stationary member 121 and coupled to the opening member 124 to move together with the opening member 124.

The moving member 125 may be integrally formed with the opening member 124 or may be releasably coupled to the opening member 124.

The movement securing portion 125*a* is provided to the stationary member 121. Particularly, the movement securing portion 125*a* is provided to the stationary member 121 at a side of the opening 122.

The movement securing portion 125*a* connects the moving member 125 to the stationary member 121 such that the moving member 125 can be moved about the movement securing portion 125*a*. Thus, the moving members 125 are moved in association with operation of the opening members 124 to open or close the opening 122 by the weight or compression of the content. For convenience of description, although the moving members 125 may have various shapes, the moving members 125 are illustrated as having a cylindrical shape in this embodiment.

The opening member 124 serves to open the opening 122 and may be provided singularly or in plural. That is, the opening members 124 are moved with respect to each other at opposite sides of the opening 122 to open a central region of the opening 122. In other words, when free ends 124*a* of the opening members 124 are pushed by the weight of the content, or moved by the weight of the opening members 124 upon shaking of the housing 110, the opening 122 is open to form a passage space 112*c*.

In addition, in the structure wherein the content passage unit includes a pair of opening members 124 and a pair of moving members 125, upon opening of the opening members 124, the content can be pushed in a lump into a side space defined along an edge of the opening 122, at which the moving members 125 are not disposed, or can pass through the side space after being pushed into the side space.

Accordingly, side plates 104 may be provided to an entrance side of the opening 122, at which the moving members 125 are not disposed. The side plates 104 serve to prevent the content from being pushed in a lump into the side space defined along the edge of the opening 122 between the moving members 125 and the opening 122, or from passing through the side space after being pushed into the side space. That is, the side plates 104 serve to guide the content to flow towards the opening members 124 along the blocking plates 127 instead of being separated therefrom.

The side plates 104 may be integrally formed with the stationary member 121 at the entrance side of the opening 122, or may be releasably connected to the stationary member 121. Obviously, the side plates 104 may have various shapes and may be formed of various materials. In addition, the number and size of the side plates 104 are not particularly limited. For convenience of description, the content passage unit will be described as including a pair of side plates 104 facing each other.

Particularly, the movement securing portions 125*a* may be integrally formed with the stationary member 121 at one side of the opening 122, or may be releasably coupled to the stationary member 121. Obviously, the side plates 104 may have various shapes and may be formed of various materials. In addition, the number and size of the side plates 104 are not particularly limited. For convenience of description, the content passage unit will be described as including a pair of side plates 104 facing each other.

Particularly, the moving members 125 may be movably connected to the stationary member 121 or to the side plates 104. For convenience of description, the moving members 125 may be rotatably connected to the side plates 104. One of the side plates 104 is provided with a pair of movement securing portions 125*a*. Each of the movement securing portions 125*a* is axially inserted at one end thereof into the corresponding moving member 125 such that the moving members 125 can be moved. In addition, each of the movement securing portions 125*a* is held at the other side thereof by the other side plate 104. With this structure, the moving members 125 and the opening members 124 are moved around the corresponding movement securing portions 125*a*. As a result, the opening members 124 open or close the opening 122.

In addition, each of the movement securing portions 125*a* may be provided to the moving member 125 so as to be axially inserted into the side plate 104.

On the other hand, in an initial state in which the container mechanism 1 is directed upward or content remains therein, it is necessary for the opening members 124 to maintain a state of blocking the opening 122. That is, it is necessary for the pair of opening members 124 to be flush with each other. In order to stop movement of the opening members 124, support blocks 302 are disposed at lower sides of the opening members 124 so as to support the opening members 124, respectively. The support blocks 302 serve to prevent unintentional rotation of the opening members 124 in a downward direction in the initial state of the container mechanism 1 by supporting the opening members 124. The support blocks 302 protrude from the side plate 104.

When the container mechanism 1 is tilted or directed downward to allow the content to move out of the container mechanism 1, the opening members 124 are pushed to open the opening 122. In the case where the opening members 124 are excessively pushed, the opening members 124 fail to return to an initial state or do not rapidly return to the initial state when the container mechanism 1 is directed upward to return to the initial state. Thus, each of the opening members 124 is required to have a limited pivot angle for opening the opening 122. That is, the moving members 125 have a restricted pivot degree in order to allow the opening 122 to be open through the opening members 124. Thus, each of the moving members 125 is provided at a circumferential surface thereof with a restoration member 304. When the restoration members 304 are brought into contact with an upper side of the stationary member 121, the moving members 125 are pivoted to push the opening members 124 such that the opening 122 is opened. The restoration members 304 are resiliently bent and thus act as buffering members by resisting the stationary member 121 when the opening 122 is opened by the weight of the opening members 124 or by the content pushing the opening members 124. Furthermore, the restoration members 304 have resilient restoration force, thereby improving reclosing response of the opening members 124. Obviously, the number, shape and material of the restoration members 304 may be changed in various ways, and the restoration members 304 may be integrally formed with the moving members 125.

The blocking plates 127 are disposed adjacent the opening members 124. Thus, the blocking plates 127 are moved in association with the corresponding opening members 124.

The blocking plates 127 are disposed on a circumferential surface of the moving member 125. When the opening members 124 close the opening 122, the blocking plates 127 are maintained in an open state to allow the content to flow towards the opening members 124. On the contrary, when the opening members 124 open the opening 122, the blocking plates 127 serve to block the opening 122 in order to prevent the content from additionally flowing into the opening 122. Obviously, the blocking plates 127 may be integrally formed with the moving members 125, and may be formed in various sizes and shapes.

Further, each of the moving members 125 may be provided with the guide plate 102. The guide plate 102 is disposed between the opening member 124 and the blocking plate 127 along the circumferential surface of each of the moving members 125. A length L2 of the guide plates 102 is shorter than a length L1 of the opening member 124 (L1>L2). Thus, upon tilting the storage portion 113 with the opening members 124 closing the opening 122, the guide plates 102 are moved by compressive force or bumping force of the content, thereby improving opening response of the opening members 124. In addition, the guide plates 102 facing each other allow a small amount of the content to flow towards the opening members 124 after passing therethrough, so that a demand amount of the content can be supplied from the container.

The storage portion 113 or the interior of the housing 110 is provided with an inflow guide member 130. For convenience of description, the inflow guide member 130 has a plate shape and is disposed inside the housing 110. The inflow guide member 130 has a guide opening 132 corresponding to the opening 122. Particularly, the inflow guide member 130 serves to guide the content within the storage portion 113 to be concentrically moved into a space between the blocking plates 127 directed perpendicularly along an inclination trace when the storage portion 113 is tilted to allow passage of the content.

The inflow guide member 130 is provided with a rim member 136 extending along the periphery thereof. The rim member 136 is fitted over an upper circumferential surface of the storage portion 113. That is, the rim member 136 is assembled to the upper circumferential surface of the storage portion 113. Obviously, the rim member 136 may be screwed to the storage portion 113. Accordingly, the rim member 136 is releasably coupled to the storage portion 113, whereby the storage portion 113 facilitates replenishment of the content after removal of the rim member 136. Further, a lower side of the housing 110 is fitted over an outer circumferential surface of the rim member 136. With this structure, the inflow guide member 130 is disposed inside the housing 110.

Furthermore, the inflow guide member 130 has an inclined surface 134 to allow the content received in the storage portion 113 to be collected in a guide opening 132. Further, the inflow guide member 130 is separated a predetermined distance from the blocking plates 127 in order to prevent interference with rotation of the blocking plates 127. The inflow guide member 130 is disposed adjacent the blocking plates 127 such that the content having passed through the guide opening 132 passes through the opening 122 while the opening 122 is not blocked by the blocking plates 127, and such that the content is prevented from passing through the guide opening 132 while the blocking plates 127 are pivoted to block the opening 122. That is, the inflow guide member 130 is disposed adjacent the blocking plates 127 and the side plates 104, which are directed perpendicularly, to prevent the content from moving into a space between the inflow guide member 130 and the stationary member 121 instead of passing through the opening 122.

The housing 110 is provided with a cover 30 to prevent the content having passed through the opening 122 of the stationary member 121 from flowing out of the container mechanism. After opening the cover 30, a user takes out the content, which has flowed into the space of the temporary receiving portion 115 by the cover 30. The cover 30 is provided to the housing 110 in various ways. The cover 30 may be hinged to the housing 110, or may be completely separated from the housing 110. Obviously, the cover 30 may have various shapes.

Next, operation of the container mechanism 1 including the content receiving device 100 according to the first embodiment of the invention will be described.

Referring to FIG. 5, when a user tilts or overturns the storage portion 113 of the container mechanism, the content received within the storage portion 113 passes through the guide opening 132 along the inclined surface 134 of the inflow guide member 130 of the housing 110 and reaches the guide plates 102 and the opening members 124.

At this time, the opening members 124 are in a state of blocking the opening 122 of the stationary member 121, the blocking plates 127 are in a state of opening the opening 122, and each of the guide plates 102 is disposed between the opening member 124 and the blocking plate 127.

Only a demand amount (or number) of the content is allowed to move towards the opening members 124 through the guide plates 102 separated from each other while colliding with or compressing the guide plates 102. Particularly, since the content first compresses the guide plates 102, the opening members 124 have improved opening response.

Undescribed reference numerals are the same as those described above and detailed description thereof will be omitted herein.

Referring to FIG. 6, when a demand amount of the content compresses the guide plates 102 and the opening members 124, the opening members 124 are pushed to open the opening 122.

Here, while the restoration members 304 resiliently resist the stationary member 121, the moving members 125 are pivoted in one direction and the opening members 124 open the opening 122.

Particularly, after the blocking plates 127 are opened to receive the content, the opening members 124 open the opening 122 in association with operation of closing the blocking plates 127. As a result, the container mechanism prevents an additional amount of the content from passing through the opening 122.

Undescribed reference numerals are the same as those described above and detailed description thereof will be omitted herein.

Referring to FIG. 7, when the storage portion 113 is returned to an initial state, the blocking plates 127 are returned from a state of blocking the opening 122 to an initial state by the weight thereof. Even though the storage portion 113 is not directed upward by a user, the opening members 124 are returned to an initial position while being rotated together with the moving members 125 in the other direction by resilient restoration of the restoration members 304. Particularly, the moving members 125 are moved in the other direction until the opening members 124 are brought into contact with the support block 302. Obviously, the configuration and shape of the restoration member 304 enabling resilient restoration can be realized in various ways.

Thereafter, a user opens the cover 30 and takes the content from the container mechanism. Obviously, when the content passes through the opening 122 in a state that the cover 30 is removed or open, the content can be discharged outside.

Undescribed reference numerals are the same as those described above and detailed description thereof will be omitted herein.

Referring to FIGS. 8 to 10, a container mechanism 1 including a content receiving device 100 according to a second embodiment of the invention includes a storage portion 113, a housing 110, and an operating mechanism for controlling passage of content 120.

Detailed descriptions of the storage portion 113 and the housing 110 are the same as those described above and will be omitted herein.

The housing 110 may be provided at one side thereof with a cover 30 to open or close the housing 110, or may be provided only with a receiving portion 181 without the cover 30 to be formed in a non-closed state. The cover 30 is provided to open or close the open side of the housing 110 and may be formed in various shapes.

The operating mechanism for controlling passage of content 120 includes a stationary member 121 and a content passage unit 123, as described above.

Particularly, the content passage unit 123 of the operating mechanism for controlling passage of content 120 is opened by movement to guide a content to move out of the storage portion 113.

The content receiving device 100 includes a receiving portion 141 separate from the content passage unit 123. The receiving portion 141 prevents an excess of the content having passed through the content passage unit 123 from moving into a temporary receiving portion 115 such that a desired amount of the content can remain.

The housing 110 may act as an opening and closing mechanism 110 and is releasably coupled to the content passage side of the storage portion 113 to open or close the storage portion 113 of the container body.

The opening and closing mechanism 110 is formed to have the temporary receiving portion 115 inside the opening and closing mechanism 110 to receive a divided amount of the content in the container mechanism 1 to be used by a user.

The cover 30 acts as an opening and closing mechanism cap 30 coupled to an upper end of the opening and closing mechanism 110. The operating mechanism for controlling passage of content 120 provided with the content passage unit 123 may be disposed inside the opening and closing mechanism 110 or inside the storage portion 113.

The receiving portion 181 includes an upper resistance plate 182 and a side resistance plate 183, and may further include a partition member 184, a blocking plate 185, an inflow member 186, a retention jaw 188 and a temporary retention portion 188 as in a fifth embodiment of the invention.

The content is brought into contact with one of the upper resistance plate 182 and the side resistance plate 183 provided to the receiving portion 181 and suppresses a residual amount of the content having passed through the opening 122.

The upper resistance plate 182 may be provided to the housing 110, and the side resistance plate 183 may be provided to the housing 110, the upper resistance plate 182, the stationary member 121, or the cover 30.

Particularly, the side resistance plate 183 may be formed on a surface of the stationary member 121 facing in a content passage direction. Alternatively, when the housing is provided with the cover 30, the side resistance plate 183 may be provided to the cover 30 to be moved together with the cover 30 in order to prevent interference with the content when a user takes out the content after opening the cover 30.

Obviously, the upper resistance plate 182 and the side resistance plate 183 may be placed in the content passage direction and in a direction perpendicular thereto, and may have various shapes.

The content passage unit 123 includes opening members 124, moving members 125, movement securing portions 125*a*, blocking plates 127, and guide plates 102, as described above.

In addition, an inflow guide member 130 is disposed inside the storage portion 113 or the housing 110. For convenience of description, the inflow guide member 130 will be illustrated as having a plate shape and being disposed inside the housing 110. The inflow guide member 130 has an inclined surface 134 to allow the content received in the storage portion 113 to be collected in the guide opening 132. The inflow guide member 130 is separated from the blocking plates 127 in order to prevent interference with rotation of the blocking plates 127. Further, the inflow guide member 130 is disposed adjacent the blocking plates 127 such that the content having passed through the guide opening 132 passes through the opening 122 when the opening 122 is not blocked by the blocking plates 127, and such that the content is prevented from passing through the guide opening 132 when the blocking plates 127 are pivoted to close the opening 122. That is, the inflow guide member 130 is disposed adjacent the blocking plates 127 and the side plate 104, which are directed perpendicularly, to prevent the content from moving into a space between the inflow guide member 130 and the stationary member 121 instead of passing through the opening 122.

On the other hand, in an initial state in which the container mechanism 1 is directed upward or the content remains therein, it is necessary for the opening members 124 to maintain a state of blocking the opening 122. That is, it is necessary for the pair of opening members 124 to be flush with each other. To this end, support blocks 302 are formed inside the side plate 104 or the opening 122 to be disposed at lower sides of the opening members 124 so as to support the opening members 124, respectively. The support blocks 302 serve to prevent unintentional movement of the opening members 124 in a downward direction in the initial state of the container mechanism 1 by supporting the opening members 124. The support blocks 302 protrude from the side plate 104.

When the container mechanism 1 is tilted or directed downward to allow the content to move out of the container mechanism 1, the opening members 124 are pushed to open the opening 122. In the case where the opening members 124 are excessively pushed, the opening members 124 fail to return to an initial state or do not rapidly return to the initial state when the container mechanism 1 is returned to the initial state. Thus, each of the opening members 124 has a limited pivot angle for opening the opening 122. That is, the size of the opening 122 is adjusted to allow the opening members 124 to be pushed while moving within an acute angle range with respect to the stationary member 121. In other words, the opening members 124 are moved by an acute angle from the support blocks 302 to open the opening 122, and then contact a portion of the stationary member 121 corresponding to an edge of the opening 122 to be stopped by the stationary member 121.

Accordingly, the blocking plates 127 can be rapidly returned from the state of blocking the opening 122 to the initial state by the weight thereof when the storage portion 113 is directed upward to return to the initial state. Particularly, the moving members 125 are pivoted until the opening members 124 reach the support block 302.

Particularly, when a user tilts or overturns the storage portion 113, the content moves (flows) into the temporary receiving portion 115 after passing through a passage space 112*c* of the stationary member 121. Since the temporary receiving portion 115 has a wider inner space than the passage space 112*c*, a large amount of the content can flow into the temporary receiving portion 115. In order to prevent such a phenomenon, the temporary receiving portion 115 is provided with a receiving portion 181 corresponding to the passage space 112*c*.

The receiving portion 181 is open towards the passage space 112*c* such that the content having passed through the passage space 112*c* can mainly flow into the receiving portion 181. Accordingly, the content is prevented from flowing in an excessive amount by a narrowed inner space of the receiving portion 181. Obviously, the receiving portion 181 may have various shapes.

Undescribed reference numerals are the same as those described above and detailed description thereof will be omitted herein.

Referring to FIGS. 11 to 15, a container mechanism 1 including a content receiving device according to a third embodiment of the present invention 100 includes a storage portion 113, a housing 110, and an operating mechanism for controlling passage of content 120.

Detailed descriptions of the storage portion 113 and the housing 110 are the same as those described above and will be omitted herein.

The operating mechanism for controlling passage of content 120 includes a stationary member 121 and a content passage unit 123. The operating mechanism for controlling passage of content 120 may be formed on a circumferential surface of the housing 110, that is, on an inner surface of a cavity 121*a*.

The stationary member 121 is disposed on an inner surface of the cavity 121*a* of the housing 110. With this structure, the stationary member 121 divides the interior of the housing 110, particularly, the cavity 121*a*. The stationary member 121 is formed with an opening 122, which is provided with the operating mechanism for controlling passage of content 120. Here, the number and diameter of the opening 122 are not particularly limited.

Particularly, the stationary member 121 may constitute an inner wall of the housing 110 or may be integrally formed with the housing or releasably coupled thereto. The stationary member 121 may have various shapes.

Further, the content passage unit 123 is provided to the opening 122 and serves to guide passage of a demand amount of the content through the opening 122 by the weight thereof or compression of the content. Here, the content may have a solid, powder or liquid phase.

The content passage unit 123 includes a variable operation plate 124, a moving member 125, a movement securing portion 125*a*, and a blocking plate 127.

The opening member 124 is provided singularly or in plural on an inner surface of the opening 122 or along an edge of the opening 122. In an initial state wherein the storage portion 113 is directed upward, the opening members 124 serve to prevent unintentional passage of the content or entrance of foreign matter from the outside by closing the opening 122. Furthermore, when the storage portion 113 is tilted or overturned to be directed downward, the opening members 124 are pushed by the weight thereof or compression of the content to open the opening 122 such that the content can pass through the opening 122. Here, the content is passed by a demand amount through the opening 122.

Preferably, the opening member 124 is provided singularly or in plural along the edge of the opening 122 so as to be pushed by the weight thereof or compression of the content to allow the content to pass through the opening 122. The opening members 124 may have various shapes. For convenience of description, the opening members 124 are illustrated as having a trigonal shape. Obviously, the number and material of the opening members 124 are not particularly limited.

The movement securing portion 125*a* is connected to the moving member 125 to connect each of the opening members 124 to the corresponding stationary member 121 such that each of the opening members 124 can be moved. Alternatively, the movement securing portion 126 is connected to each of the opening members 124 integrally formed with the corresponding moving member 125 to connect each of the opening members 124 to the corresponding stationary member 121 such that each of the opening members 124 can be moved.

For example, the stationary member 121 is provided on an upper surface thereof with the movement securing portions 125*a* along the edge of the opening 122. As used herein, the term "upper surface" refers to a surface of the stationary member 121 facing upwards when the storage portion 113 is directed upwards when not in use.

The moving members 125 are respectively connected to the corresponding movement securing portions 125*a* disposed on upper surfaces of the opening members 124 closing the opening 122. Thus, the opening members 124 are moved along the moving members 125. Obviously, the moving members 125 and the movement securing portions 125*a* may have various shapes. Furthermore, the moving members 125 may be integrally formed with the opening members 124 or may be releasably connected to the opening members 124. Likewise, the movement securing portions 125*a* may be releasably connected to the stationary members 121 or may be integrally formed with the stationary members 121.

Further, the blocking plates 127 are provided to the opening members 124, respectively. Thus, each of the blocking plates 127 is moved in association with the corresponding opening member 124.

Particularly, when the opening members 124 close the opening 122, the blocking plates 127 open the opening 122. On the contrary, when the opening members 124 open the opening 122, the blocking plates 127 close the opening 122.

After the blocking plates 127 are opened to allow the content to move towards the opening members 124, the opening members 124 are opened in association with operation of closing the blocking plates 127, thereby allowing the content moved towards the opening members 124 to pass therethrough.

Preferably, the opening members 124 and the blocking plates 127 provided in one-to-one correspondence are integrally formed with each other. Further, since the blocking plates 127 can close the opening 122 so as to prevent passage of the content therethrough, the number of blocking plates 127 may be less than the number of opening members 124.

Accordingly, when a demand amount (number) of the content compresses the opening member 124, the opening members 124 are pushed to open the opening 122. In association with this operation of the opening members, the blocking plates 127 close the opening 122. As a result, only a demand amount of the content is allowed to pass through the opening 122 each time.

The content having passed through the opening 122 is received in the cover 30. Furthermore, when the storage portion 113 is directed upward so as not to be used, the opening members 124 are pivoted to close the opening 122 by the weights of the opening members 124 and the blocking plates 127. Thus, the content received in the cover 30 is prevented from moving into the storage portion 113.

On the other hand, when opening the opening 122, the opening members 124 and the blocking plates 127 are directed perpendicular or at an acute angle with respect to the surface of the stationary member 121. As a result, closing response of each of the opening members 124 and the blocking plates 127 in a state of opening the opening 122 can be improved.

For example, in order to restrict an opening angle of the opening members 124 when opening the opening members 124, each of the movement securing portions 125*a* is provided with a stopper 129. The stopper 129 protrudes from the movement securing portion 125*a* to restrict a movement angle of the moving member 125 connected to the opening member 124. Obviously, the stopper 129 may have various shapes.

Furthermore, in order to restrict an opening angle of the blocking plates 127 when the blocking plates 127 are open, each of the blocking plates 127 is provided with a support member 128, which adjoins the stationary member 121 when the opening 122 is open. The support members 128 serve to prevent the blocking plates 127 from being excessively pushed beyond a certain angle. Since the opening members 124 are integrally formed with the blocking plates 127, the support members 128 also serve to maintain the opening members 124 in a closed state. Obviously, the support members 128 may have various shapes.

On the other hand, the inflow guide member 130 serves to guide the content within the storage portion 113 to be concentrically moved into a space between the blocking plates 127 directed perpendicularly along an inclination trace when the storage portion 113 is tilted.

Thus, the inflow guide member 130 is disposed inside the housing 110 and formed with a guide opening 132. In this case, the guide opening 132 is formed in the inflow guide member 130 so as to match with the opening 122. Furthermore, the inflow guide member 130 is formed with an inclined surface 134 along an edge of the guide opening 132. Particularly, the inclined surface 134 is formed on the inflow guide member 130 along the edge of the guide opening 132. The inclined surface 134 may be a flat surface or a curved surface.

The inclined surface 134 serves to guide the content to move towards the content passage unit 123 when the storage portion 113 is tilted.

Obviously, the inflow guide member 130 may be integrally formed with the stationary member 121 or with the housing 110, or may be releasably fitted in the housing 110.

Next, operation of the container mechanism 1 including the content receiving device 100 according to the third embodiment of the present invention will be described.

Referring to FIG. 16, when a user tilts or overturns the storage portion 113 of the container mechanism, the content received within the storage portion 113 passes through the guide opening 132 along the inclined surface 134 of the inflow guide member 130 of the housing 110 and reaches the opening members 124.

At this time, the opening members 124 are in a state of blocking the opening 122 of the stationary member 121, and the blocking plates 127 are in a state of opening the opening 122.

A demand amount of the content is allowed to move towards the opening members 124.

Undescribed reference numerals are the same as those described above and detailed description thereof will be omitted herein.

Referring to FIG. 17, when a demand amount of the content compresses the opening members 124, the opening members 124 are pushed to open the opening 122 and the passage space 112*c* is secured.

At this time, the moving members 125 are pivoted in one direction until the stoppers 129 contact the stationary member 121, and the opening members 124 open the opening 122.

Particularly, after the blocking plates 127 are opened to receive the content, the blocking plates 127 are closed in association with operation of the opening members 124 to open the opening 122. As a result, the container mechanism prevents an additional amount of the content from passing through the opening 122.

Undescribed reference numerals are the same as those described above and detailed description thereof will be omitted herein.

Referring to FIG. 18, the blocking plates 127 close the opening 122 in association with the opening members 124.

As a result, the content is not additionally moved into the opening 122. In addition, the content having passed through the opening 122 is received in the cover 30.

Then, when the storage portion 113 is returned to an initial state, the blocking plates 127 are returned from a state of blocking the opening 122 to an initial state by the weight thereof. Then, the opening members 124 are returned to an initial position while being rotated together with the moving members 125 in the other direction by resilient restoration of the restoration members 304. Particularly, the moving members 125 are pivoted in the other direction until the opening members 124 are brought into contact with the support block 302.

Then, a user opens the cover 30 and takes the content from the container mechanism.

Undescribed reference numerals are the same as those described above and detailed description thereof will be omitted herein.

As shown in FIGS. 19 and 20, a content receiving device according to a fourth embodiment of the invention includes a stationary member 121.

Particularly, the stationary member 121 is provided with opening members 124, which are resiliently pushed in a content passage direction to allow content to pass therethrough.

Moving members 125 are disposed at an edge of an opening 122 of the opening members 124 to connect the corresponding opening members 124 to the stationary member 121 such that the opening members 124 can be moved thereby, and may be integrally formed with the opening members 124.

A movement securing portion 125*a* defines an edge of the opening 122 of the stationary member 121, and the opening members 124 may be resiliently pushed about the moving members 125, each of which corresponds to one end of the opening member 124 and is secured to the edge of the opening 122 corresponding to the movement securing portion 125*a*. The opening members 124 are pushed in the direction of gravity or in a compressing direction of the content when the housing 110 is directed downward or tilted.

The opening members 124 are resiliently pushed about the movement securing portion 125*a*. Here, the movement securing portion 125*a* may be realized in various ways, for example, by a folding line or a finishing line formed at a connection side of the stationary member 121 of the moving members 125 or by an outer circumference at which a cutting line of the opening member 124 is finished.

The number and the shape of the opening members 124 are not particularly limited.

Referring to FIGS. 21 to 24, a container mechanism 1 including a content receiving device 100 according to a fifth embodiment of the present invention includes a storage portion 113, a housing 110, a receiving portion 181, and an operating mechanism for controlling passage of content 120.

Detailed descriptions of the housing 110 and the operating mechanism for controlling passage of content 120 are the same as those described above and will be omitted herein.

The housing 110 may be provided at one side thereof with a cover 30 to open or close the housing 110, or may be provided only with a receiving portion 181 without the cover 30 to be formed in a non-closed state. The cover 30 is provided to open or close the open side of the housing 110 and may be formed in various shapes.

Particularly, the operating mechanism for controlling passage of content 120 includes a content passage unit 123, which is opened or closed by rotation and guides a content to move out of the storage portion 113.

The content receiving device 100 includes the receiving portion 181 separate from the content passage unit 123. The receiving portion 181 prevents an excess of the content having passed through the content passage unit 123 from moving into a temporary receiving portion 115 such that a desired amount of the content can remain therein.

The housing 110 may act as an opening and closing mechanism 110 and is releasably coupled to the content passage side of the storage portion 113 to open or close the storage portion 113 of the container body.

The opening and closing mechanism 110 is formed to have the temporary receiving portion 115 inside the opening and closing mechanism 110 to receive a divided amount of the content in the container mechanism 1 to be used by a user.

The cover 30 acts as an opening and closing mechanism cap 30 coupled to an upper end of the opening and closing mechanism 110. The operating mechanism for controlling passage of content 120 provided with the content passage unit 123 may be disposed inside the opening and closing mechanism 110 or inside the storage portion 113.

The receiving portion 181 includes an upper resistance plate 182, a side resistance plate 183, a partition member 184, a blocking plate 185, an inflow member 186, a retention jaw 188, and a temporary retention portion 188.

The content is brought into contact with one of the upper resistance plate 182 and the side resistance plate 183 provided to the receiving portion 181 and restricts a residual amount of the content having passed through the opening 122.

The upper resistance plate 182 may be provided to the housing 110, and the side resistance plate 183 may be provided to the housing 110, the upper resistance plate 182, the stationary member 121, or the cover 30.

Particularly, the side resistance plate 183 may be formed on a surface of the stationary member 121 facing in a content passage direction. Alternatively, when the housing is provided with the cover 30, the side resistance plate 183 may be provided to the cover 30 to be moved together with the cover 30 in order to prevent interference with the content when a user takes the content out after opening the cover 30.

Obviously, the upper resistance plate 182 and the side resistance plate 183 may be placed at an upper portion in the content passage direction and at a side portion perpendicular to the content passage direction, and may have various shapes.

The partition member 184 partitions the space of the receiving portion 181 to restrict a remaining amount of the content, which will pass through the opening 122.

The partition member 184 serves to restrict the amount of the content to be received by the receiving portion 181 by adjusting a substantial content receiving space of the receiving portion 181 partitioned thereby. The partition member 184 may be formed on a side of the cover 30 to face the stationary member 121, and may be changed in various ways to divide the receiving portion.

The blocking plates 185 protrude from an upper surface of the stationary member 121. Specifically, the blocking plates 185 protrude from the surface of the stationary member 121 directed in the content passage direction. The blocking plates 185 serve to prevent the content from moving towards a portion excluding the receiving portion 181 after passing through the opening.

The temporary retention portion 188 corresponds to a portion of the temporary receiving portion 115.

The receiving portion 181 includes the inflow member 186.

The inflow member 186 is provided to the receiving portion 181 to guide the content having passed through the opening to move into the receiving portion 181 while preventing the content from moving towards other portions excluding the receiving portion. The inflow member 186 protrudes from the cover 30 so as to be separated from the partition member 184. Obviously, the inflow member 186 may have various shapes.

An upper surface of the stationary member 121, that is, a surface of the stationary member 121 facing the cover 30, serves to support the content, and the retention jaw 188 formed on the upper surface of the stationary member 121 serves to collect the content into the temporary retention portion 188. The content within the temporary receiving portion 115 is on standby for withdrawal.

The retention jaw 188 protrudes towards the cover along an edge of the opening 122 of the stationary member 121. Obviously, the retention jaw 188 may have various shapes.

In this embodiment, the content passage unit 123 includes a variable operation plate 124 and a moving member 125.

The opening member 124 serves to open the opening 122 of the stationary member 121.

When the housing 110 is tilted, the opening member 124 opens the opening 122 by the weight thereof or by compression of the content. Conversely, when the housing 110 is directed upward, the opening member 124 closes the opening 122 by the weight thereof.

The moving member 125 allows the opening member 124 to be pivoted inside the opening 122. The moving member 125 may have various shapes.

Further, the content passage unit 123 includes a stopper 129 to allow the opening member 124 to maintain a state of closing the opening 122, with the housing 110 directed upward.

That is, the opening member 124 is pivoted about the moving member 125 in one direction by the weight thereof or by compression of the content to open the opening 122.

On the other hand, the opening member 124 is pivoted about the moving member 125 in the other direction by the weight thereof or by compression of the content to close the opening 122. At this time, the stopper 129 is brought into contact with the surface of the stationary member 121, thereby preventing the opening member 124 from being further rotated in the other direction.

Referring to FIGS. 25 to 29, a container mechanism 1 including a content receiving device 100 according to a sixth embodiment of the invention includes an operating mechanism for controlling passage of content 120, an operating mechanism for controlling passage of content housing 250, and a housing 110.

The operating mechanism for controlling passage of content 120 includes a content passage unit 123 and a stationary member 253.

The housing 110 releasably coupled to the storage portion 113 is the same as the housing described above and thus a detailed description thereof will be omitted herein.

The content passage unit 123 is disposed inside the housing 110 and serves to guide content received in the storage portion 113 to be moved by a demand amount.

The housing 110 is provided at an upper side thereof with a cover 30. The cover 30 receives the content that is moved by a demand amount through the operating mechanism for controlling passage of content 120. The cover 30 is releasably coupled to the housing 110.

Particularly, the content passage unit 123 includes opening members 242, moving members 245, a movement securing portion 252, and a passage frame 258.

The operating mechanism for controlling passage of content housing 250 is disposed on a circumferential surface at an open side of the housing 110. The operating mechanism for controlling passage of content housing 250 has a ring shape. The operating mechanism for controlling passage of content housing 250 is releasably coupled to the housing 110 to be easily replaced by a new operating mechanism for controlling passage of content housing, and may have various shapes and be formed of various materials. The operating mechanism for controlling passage of content housing 250 is mounted on an outer side of the storage portion 113 and the housing 110 covers the operating mechanism for controlling passage of content housing 250.

The passage frame 258 is connected to the opening members 242 and has an opening 251, which is open at a central portion thereof. Each of the opening members 242 has a free end 242*a* movably connected to the passage frame 258, and is formed with a passage space 112*c* for the content corresponding to the opening 251.

Each of the moving members 245 supports the corresponding opening member 242 and is provided at one side thereof with a latch member 254.

Each of the latch members 254 is latched to the movement securing portion 252 and acts as a pivot joint upon rotation of the opening members 242. That is, the latch member 254 is provided to one side of each of the moving members 245 to be latched to the movement securing portion 252 while hingedly coupling the corresponding opening member 242, which is moved in the direction of gravity or in the compressing direction of the content. The latch member 254 may be integrally formed with or releasably coupled to each of the moving members 245 and may have various shapes.

Further, the movement securing portion 252 is connected to the stationary member 253. Although the movement securing portion 252 may have various shapes, the movement securing portion 252 is illustrated as having a ring shape in this embodiment, for convenience of description.

The movement securing portion 252 may be connected to the stationary member 253 in various ways. For example, the movement securing portion 252 may be connected to the stationary member 253, which is composed of connection ribs arranged at constant intervals in the circumferential direction. The movement securing portion 252 is fixedly connected to the stationary member 253. Obviously, the movement securing portion 252 may be formed of various materials.

The movement securing portion 252 may be secured to one of an upper edge, a circumferential surface, an inner surface and a lower edge of the stationary member 253.

Particularly, the opening member 242 may be provided singularly or in plural and connected to the movement securing portion 252 to form the passage space 112*c*, thereby securing a space through which a demand amount of the content can pass.

That is, each of the moving members 245 connected to the opening members 242 is movably connected at one side thereof to the movement securing portion 252. Thus, when the housing 110 is shaken to supply the content, the opening members 242 are widened at the other sides thereof with respect to each other to form the passage space 112*c*. Accordingly, the content is allowed to pass through the passage space 112*c* from the storage portion 113 of the housing 110. For convenience of description, the content passage unit is illustrated as including the plural opening members 242 separated from each other.

In addition, the other sides of the opening members 242 are interlocked with each other in order to adjust an open degree of the passage space 112*c*. This structure is provided to prevent the opening members 242 from being excessively pushed and returned to an initial position, and to guide passage of a demand amount of the content through adjustment of the open degree of the passage space 112*c*.

To this end, the content passage unit 123 includes opening guide members 256 and the passage frame 258.

The opening guide member 256 is provided to the other side of each of the moving members 245. Obviously, the opening guide member 256 may have various shapes and may be integrally formed with or releasably connected to each of the moving members 245. Further, the opening guide member 256 may be integrally formed with the moving member 245 to be coupled to the opening member 242.

The opening member 242 may be integrally formed with the moving member 245.

The passage frame 258 is formed to allow each of the opening guide members 256 to be latched thereto. With this structure, the passage frame 258 is moved while adjoining the opening guide members 256 upon rotation of the opening members 242. That is, while the opening members 242 are moved from an initial state to form the passage space 112*c*, the opening guide members 256 are moved from a position 'a' to a position 'b' along the passage frame 258 (see FIG. 28). As a result, the opening members 242 are widened at the other sides thereof with respect to each other. Accordingly, the passage frame 258 can form the passage space 112*c* for passage of the content by adjusting a rotated degree of each of the opening members 242.

Each of the opening members 242 is provided with a shielding member 146 inside the passage space 112*c*.

Furthermore, when the opening members 242 are returned to an initial state after being opened to form the passage space 112*c*, it is necessary for each of the opening members 242 to be returned to a closing position corresponding to the initial state while maintaining the passage space 112*c* for rapid opening. At this time, the passage space 112*c* has a size preventing unintentional passage of content therethrough. Thus, the passage frame 258 serves to maintain a closing position restoration force of each of the opening members 242.

Although the passage frame 258 may have various shapes, the passage frame 258 is illustrated as having a ring shape in this embodiment, for convenience of description. The passage frame 258 and the opening guide member 256 are interlocked with each other.

Each of the opening members 242 may be formed with a protrusion 244 at an edge thereof near the passage space 112*c* in order to improve rotation response by the weight thereof in a state of being interlocked with the passage frame 258. That is, when the housing 110 is directed upward to be returned to an initial state, the protrusions 244 act as weights for improving response to an operation of returning the opening members 242 to an initial state thereof. Obviously, the protrusion 244 may have various shapes.

The content having passed through the passage space 112*c* having a sufficient size is stored in the temporary receiving portion 115 instead of being discharged outside.

The content guide member 260 is disposed near the opening members 242 inside the housing 110 so as not to contact the opening members 242 while securing a sufficient size of the passage space 112*c*. This structure is provided to prevent interference with movement of the opening members 242 by the content guide member 260 and to prevent the content having passed through the passage space 112*c* from leaking to a space between the opening members 242 and the content guide member 260 through an inflow portion 262.

Particularly, a surface of the content guide member 260 has a gentle inclination from the inflow portion 262 to the center of the content guide member 260. More specifically, the surface of the content guide member 260 facing the cover 30 is inclined to have a height gradually decreasing from the inflow portion 262 to the center of the content guide member 260. This structure is provided to allow the content having passed through the passage space to be placed at the center of the content guide member 260 near the inflow portion 262 such that a user can easily pick up the content when the storage portion 113 is directed upward to be returned to an initial state.

Next, operation of the container mechanism 1 including the content receiving device 100 according to the sixth embodiment of the invention will be described.

Referring to FIG. 28, when a user tilts or overturns the storage portion 113 of the container mechanism, the content received within the storage portion 113 pushes the opening members 242 in a content passage direction while moving along the inclined surfaces of the opening members 242. At this time, the opening members 242 are rapidly widened by the weight of the protrusions 244.

As a result, the passage space 112*c* for passage of the content can be sufficiently secured.

The content falls onto the cover 30 after passing through the passage space 112*c* and the opening members 242.

Undescribed reference numerals are the same as those described above and detailed description thereof will be omitted herein.

Referring to FIG. 29, when the storage portion 113 is directed upward to be returned to an initial state, the opening members 242 widened with respect to each other are rapidly narrowed with respect to each other by the weight of the protrusions 244, thereby narrowing the passage space 112*c*. As a result, the content is prevented from unintentionally passing through the passage space 112*c*.

Then, a user opens the cover 30 and takes the content out of the container mechanism.

Undescribed reference numerals are the same as those described above and detailed description thereof will be omitted herein.

Referring to FIGS. 30 to 35, a container mechanism 1 according to a seventh embodiment of the invention has a function of supplying a demand amount of content and includes a housing 110 and an operating mechanism for controlling passage of content 120.

In this embodiment, the housing 110 is integrally formed with the storage portion of the other embodiments. However, the housing may be releasably coupled to the storage portion (for example, by thread coupling, interference fitting, and the like), and this structure provides an advantage in that these components can be separately prepared.

For convenience of description, the operating mechanism for controlling passage of content 120 will be illustrated as being provided to the housing 110.

The housing 110 may have a closable bottom or circumferential surface to fill the housing with the content, or may have a snap structure.

Particularly, the housing 110 may be provided to a content passage side of a separate storage portion. The housing 110 may be releasably coupled to the content passage side of the storage portion, or may be integrally formed with the storage portion. Obviously, the housing 110 may have various outer shapes and may be formed of various materials.

The housing 110 is provided with a cavity 121*a* that is open at opposite sides thereof.

The operating mechanism for controlling passage of content 120 is disposed inside the housing 110 to guide the content received in the housing 110 or in the storage portion 113 to be moved by a demand amount. The cover 30 is releasably coupled to the housing 110.

The housing 110 may act as an opening and closing mechanism 110 for opening or closing the separate storage portion 113, and may be provided to a content passage side of the separate storage portion 113 to be releasably coupled to the content passage side.

The opening and closing mechanism 110 is formed to have the storage portion 113 inside the opening and closing mechanism 110, and the cover 30 is fastened to an upper end of the opening and closing mechanism 110 to act as an opening and closing mechanism cap 30. The operating mechanism for controlling passage of content 120 is provided with a content passage unit 123 and may be disposed inside the opening and closing mechanism 110 or inside the storage portion 113.

The operating mechanism for controlling passage of content 120 includes a stationary member 121 and the content passage unit 123.

The stationary member 121 is disposed on an inner surface of the cavity 121*a* of the housing 110. With this structure, the stationary member 121 divides the interior of the housing 110, particularly, the cavity 121*a*. That is, the cavity 121*a* of the housing 110 is divided by the stationary member 121. In other words, the cavity 121*a* is divided into the storage portion 113 in which the content is stored, and a temporary receiving portion 115 in which a demand amount of the content having passed through the storage portion 113 is on standby. The storage portion 113 is open towards the storage portion 113 and the temporary receiving portion 115 is open towards the cover 30.

The stationary member 121 is disposed inside the cavity 121*a*, without being limited thereto.

The stationary member 121 is formed with an opening 122. The opening 122 connects the temporary receiving portion 115 of the housing 110 to the storage portion 113 thereof such that the content can be withdrawn therethrough. Here, the number and diameter of the opening 122 are not particularly limited.

The stationary member 121 may be integrally formed with the housing 110 or may be releasably coupled thereto. The stationary member 121 may have various shapes.

The stationary member 121 is formed integrally with the housing 110 as an inner wall of the housing 110 adjoining the operating mechanism for controlling passage of content 120.

The content passage unit 123 serves to guide passage of a demand amount of the content through the opening 122. In this embodiment, the content passage unit 123 is disposed inside the opening 122, which is an overall open space of the inner wall of the housing 110, to allow a demand amount of the content to pass through the opening 122.

The content passage unit 123 includes opening member 142, moving members 143, a movement securing portion 125*a*, and a passage frame 258. The movement securing portion 125*a* includes a connection via-hole 164 and latch protrusions 166.

The movement securing portion 125*a* is connected to the stationary member 121. Particularly, the movement securing portion 125*a* is connected to the stationary member 121 at a side of the opening 122. Although the movement securing portion 125*a* may have various shapes, the movement securing portion 125*a* is illustrated as having a ring shape in this embodiment for convenience of description.

The movement securing portion 125*a* connects the opening members 142 such that the opening members 142 can be moved.

The movement securing portion 125*a* may be integrally formed with the stationary member 121 or may be integrally formed with the inner wall of the housing 110.

The opening members 142 are disposed on an inner surface of the opening 122 or along an edge of the opening 122. In an initial state wherein the storage portion 113 is directed upward, the opening members 124 serve to prevent unintentional passage of the content or entrance of foreign matter from the outside by closing the opening 122. Furthermore, when the storage portion 113 is tilted or overturned to be directed downward, the opening members 124 are pushed by the weight thereof or compression of the content to secure a passage space 112*c* such that the content can pass through the passage space 112*c*. Here, the content is passed by a demand amount through the passage space 112*c* defined in the opening 122.

The opening members 142 are provided to the movement securing portion 125*a* so as to form the passage space 112*c*. Particularly, the opening member 142 may be provided singularly or in plural and connected to the movement securing portion 252 to form the passage space 112*c*, thereby securing a space through which a demand amount of the content can pass.

That is, each of the moving members 143 connected to the opening members 242 is movably connected at one side thereof to the movement securing portion 252. Thus, when the housing 110 is shaken to allow passage of the content, the opening members 242 are widened at the other side thereof with respect to each other to form the passage space 112*c*. Accordingly, the content passes through the passage space 112*c* from the storage portion 113 of the housing 110. For convenience of description, the content passage unit is illustrated as including the plural opening members 242 separated from each other.

The opening members 142 are disposed on the inner surface of the opening 122 or along the edge of the opening 122. In an initial state wherein the storage portion 113 is directed upward, the opening members 124 serve to prevent unintentional passage of the content or entrance of foreign matter from the outside by closing the opening 122. Furthermore, when the storage portion 113 is tilted or overturned to be directed downward, the opening members 124 are pushed by the weight thereof or compression of the content to secure a passage space 112*c* such that the content can pass through the passage space 112*c*. Here, the content is passed by a demand amount through the passage space 112*c* defined in the opening 122.

The opening members 142 are provided to the movement securing portion 125*a* so as to form the passage space 112*c*. Particularly, the opening member 142 may be provided singularly or in plural and connected to the movement securing portion 252 to form the passage space 112*c*, thereby securing a space through which a demand amount of the content can pass.

That is, each of the moving members 143 connected to the opening members 242 is movably connected at one side thereof to the movement securing portion 252. Thus, when the housing 110 is shaken to allow passage of the content, the opening members 242 are widened at the other side thereof with respect to each other to form the passage space 112*c*. Accordingly, the content passes through the passage space 112*c* from the storage portion 113 of the housing 110. For convenience of description, the content passage unit is illustrated as including the plural opening members 242 separated from each other.

Each of the opening members 142 may be integrally formed with the corresponding moving member 143.

In this embodiment, the opening member 142 is integrally formed with the moving member 143 as a single component, and the opening member 142 and the moving member 143 are movably connected as the single component to the movement securing portion 125*a*.

The movement securing portion 125*a* is connected to the stationary member 121. Particularly, the movement securing portion 125*a* is connected to the stationary member 121 at a side of the opening 122. Although the movement securing portion 125*a* may have various shapes, the movement securing portion 125*a* is illustrated as having a ring shape in this embodiment for convenience of description.

The movement securing portion 125*a* connects the opening members 142 such that the opening members 142 can be moved.

The movement securing portion 125*a* may be integrally formed with the stationary member 121 or may be integrally formed with the inner wall of the housing 11.

Upon opening of the opening members 142, a variable operation plate 140 composed of the opening members 142 acts as an inflow guide member and guides the content within the housing 110 to be concentrically moved towards the passage space 112*c* of the passage frame 258 along an inclination trace when the storage portion 113 is tilted.

The content passage unit 123 includes the variable operation plate 140 composed of the opening members 142, which are secured at one side thereof to the stationary member 121 corresponding to the inner wall of the housing 110 and are moved at the other side thereof and arranged adjacent to each other to form the passage space 112*c*, which prevents the content from falling into the passage space while allowing the content to pass through a certain portion thereof.

As the non-fixed sides of the opening members 142 are moved inside the housing 110, the passage space 112*c* is widened to allow content to pass therethrough.

When the housing 110 is tilted or shaken by a user, the non-fixed sides of the opening members 142 may be moved by the weight of the opening members 142 or by compression of the content.

The passage frame 258 is connected to the opening members 142 and has an opening 251, the center of which is open. The opening members 142 are movably connected at free ends 242*a* thereof to the passage frame 258 and the passage space 112*c* for the content is formed corresponding to the opening 251.

Each of the opening members 142 is provided with a shielding member 146 inside the passage space 112*c*.

Here, the content passes through the passage space 112*c* inside the opening 251 as the length of the shielding member 146 is reduced due to deformation of the opening member 142.

In addition, the shielding member 146 of the opening member 142 is formed with a protrusion hook 144, which prevents the opening member 142 from being separated from a connection hole 154 formed in the passage frame 258.

A distal end of the shielding member 146 is formed of a resilient material such as urethane or silicone to resist passage of the content through the passage space 112*c*, thereby assisting in passage of a demand amount of the content.

On the other hand, a body 151 of the passage frame 258 is preferably formed with the connection hole 153, to which the distal end of each of the opening members 142 is latched while passing through the connection hole so as not to be separated therefrom, such that the opening members 142 can freely slide in the connection hole upon deformation thereof.

A body 162 of the movement securing portion 125*a* includes the connection via-hole 164 formed along the circumference thereof such that the distal end of the opening member 142 is latched thereto while passing therethrough so as not to be separated therefrom.

The body 162 of the movement securing portion 125*a* further includes a plurality of latch protrusions 166 formed along an outer circumference thereof to secure the body 162 to the inner wall of the housing 110 of the container mechanism 1.

The passage space 112*c* is further provided with a guide rod 170, which penetrates the passage frame 258 and is secured at one end thereof to a bottom surface of the housing 110 to guide variable movement of the passage frame 258.

The guide rod 170 includes a protruding portion 172, which is formed to support a lower side of the passage frame 258.

As the non-fixed sides of the opening members 142 are moved towards the temporary receiving portion 115 of the housing 110, the passage space 112*c* is widened to allow passage of the content therethrough.

In other words, as soon as the container mechanism 1 is shaken in a front direction by a user, the passage frame 258 advances in the front direction and the distal ends of the opening members 142, which have blocked the passage space of the passage frame 258, approach an outer diameter of the passage frame 258 to open an inner diameter of the passage frame 258 such that the content passes through the passage space 112*c*.

Particularly, each of the opening members 142 includes the shielding member 146 protruding towards one of an upper portion, a lower portion and an inner portion of the passage frame 258. Accordingly, as the length of the shielding member 146 is reduced by movement of the opening members 142, the content passes through the passage space 112*c*.

At this time, the opening members 142 may be directly connected to the passage frame 258. Alternatively, although not shown in the drawings, the opening members 142 may be indirectly connected to the passage frame 258 through a separate opening/closing guide.

Undescribed reference numerals are the same as those described above and detailed description thereof will be omitted herein.

Referring to FIGS. 36 and 37, a container mechanism according to an eighth embodiment of the invention includes an opening and closing mechanism 105 and a container body 200 opened or closed by the opening and closing mechanism 105.

In this embodiment, the opening and closing mechanism 105 is applied to the container mechanism 1 and forms a temporary receiving portion 115. The temporary receiving portion 115 is formed within the opening and closing mechanism 105 and is used as a temporary receiving space separate from the container body 200. To this end, the opening and closing mechanism 105 includes a housing in which the temporary receiving portion 115 is formed, and an operating mechanism for controlling passage of content 120.

A content separately received within the temporary receiving portion 115 can be taken out through an opening formed in the opening and closing mechanism 105. The container mechanism according to this embodiment is configured to allow the content received in the container body 200 to be put into the temporary receiving portion 115 through the operating mechanism for controlling passage of content 120. That is, a storage portion 113 and the temporary receiving portion 115 are partially communicated with each other through the operating mechanism for controlling passage of content 120 to allow the content in the storage portion 113 to be moved into the temporary receiving portion 115. Further, the operating mechanism for controlling passage of content 120 may be formed to prevent the content having moved into the temporary receiving portion 115 from being moved into the storage portion 113.

The opening and closing mechanism 105 is formed to have the temporary receiving portion 115 to receive a divided amount of the content in the container body 200 to be used by a user.

The opening and closing mechanism 105 is formed with an upper thread portion 111 on an upper outer circumference thereof and a lower thread portion 112 on a lower outer circumference thereof for screw coupling.

The opening and closing mechanism 105 includes a housing 110 formed to have the temporary receiving portion 115 defined to store content therein, a cover 30 fastened to an upper end of the housing 110, and the operating mechanism for controlling passage of content 120 defining a boundary between the temporary receiving portion 115 and the storage portion 113, which corresponds to a storage space of the container body 200, so as to form the temporary receiving portion 115 of the housing 110.

The container body 200 is formed on an upper outer circumferential surface thereof with a thread portion 201 through which the opening and closing mechanism 105 opens or closes the container body 200, and includes a sealed bottom 202 and defines the storage portion 113 which stores the content therein. Coupling between the container body 200 and the opening and closing mechanism 105 may be realized by various methods, such as screw coupling, fitting, and the like.

With the aforementioned structure, the opening and closing mechanism allows the content of the container body to be separately stored by a demand amount in the content standby space of the opening and closing mechanism, thereby preventing the entirety of the content in the container body from being easily exposed to contaminants or from being easily oxidized through contact with air while allowing only a demand amount of the content to be easily used.

Undescribed reference numerals are the same as those described above and detailed description thereof will be omitted herein.

Referring to FIGS. 38 to 39, a container mechanism 1 according to a ninth embodiment of the invention includes an opening and closing mechanism 105 and a container body 200 opened or closed by the opening and closing mechanism 105.

The container mechanism 1 according to this embodiment is the same as the container mechanism according to the first embodiment in that both container mechanisms include the opening and closing mechanism 105, and the same components will be indicated by the same reference numerals and detailed description thereof will be omitted.

The opening and closing mechanism 105 includes a housing 110 formed to have a temporary receiving portion 115 therein, a cover 30 fastened to an upper end of the housing 110, and an operating mechanism for controlling passage of content 120 defining a boundary between the temporary receiving portion 115 and a storage space of a container body 200 so as to form the temporary receiving portion 115 of the housing 110, wherein the operating mechanism for controlling passage of content 120 has an opening 141, which protrudes to a predetermined height.

Content received in the container body 200 can be moved from the storage portion 113 of the container body 200 to the temporary receiving portion 115, which corresponds to a storage portion of the housing 110, through the opening 141.

When the container mechanism is significantly tilted or shaken, the content received in the storage portion 113 is moved into the temporary receiving portion 115, which corresponds to the storage portion of the housing 110. Once the content is moved into the temporary receiving portion 115, the opening 141 having a predetermined height prevents the content from returning to the container body 200 through the opening 141 in daily use, and prevents the content in the storage portion 113 from being taken out when the container is tilted to take the content out of the opening and closing mechanism 105.

Particularly, referring to FIG. 40 to FIG. 43, a container mechanism 1 according to the present invention includes an opening and closing mechanism 105 and a container body 200 opened or closed by the opening and closing mechanism 105.

The opening and closing mechanism 105 includes a housing 110 formed to have a temporary receiving portion 115 defined to store content therein, a cover 30 fastened to an upper end of the housing 110, and a deformable content passage unit defining a boundary between the temporary receiving portion 115 and a storage space of the container body 200 so as to form the temporary receiving portion 115 of the housing 110, wherein the content of the container body 200 is allowed to move into the opening and closing mechanism 105 through deformation of the content passage unit.

On the other hand, unlike the structure wherein the content of the container body 200 is allowed to move into the opening and closing mechanism 105 through deformation of the content passage unit, a receiving portion may be disposed within the opening and closing mechanism 105 as in the second and fifth embodiments such that a demand amount of the content is moved from the container body 200 into the opening and closing mechanism 105 and remains therein.

The content passage unit includes a variable operation plate 140 composed of the opening members 142, which are secured at one side thereof to the stationary member 121 and are deformable at the other side thereof and arranged adjacent to each other to form a passage space 112*c*, which prevents the content from falling into the passage space while allowing the content to pass through a certain portion thereof, and a passage frame 258 having a loop shape and formed with an opening 251 open at the center thereof.

In addition, each of the opening members 142 is connected at the other side thereof, which is a free end of the opening member, to the passage frame 258 to form the passage space 112*c* in the opening 251 and is provided with a shielding member 146 inside the opening 251, and the content passes through the passage space 112*c* inside the opening 251 as the length of the shielding member 146 disposed within the opening 251 of the passage frame 258 is reduced due to deformation of the opening member 142.

In other words, the free end of each of the opening members 142 is connected to the passage frame 258; the passage space 112*c* for the content is formed in the opening 251; and, upon movement of the opening members 142, the variable operation plate 140 composed of the opening members 142 forms an inclined surface to guide the content to move towards a portion of the passage frame 258 having the passage space along an inclination trace. The opening member 142 includes the shielding member 146 facing the interior of the opening 251, and the content is allowed to pass through the opening 251 as the length of the shielding member 146 inside the passage frame 258 is reduced due to movement of the opening member 142.

In addition, the other side of the opening member 142, that is, the free end 242*a* of the opening member 142, is deformed by the weight thereof when the container body 200 is shaken or tilted by a user, and a free end 242*a* of the shielding member 146 is formed of a resilient material such as urethane or silicone and is configured to resist passage of the content through the passage space 112*c*, thereby assisting in passage of a demand amount of the content.

Further, a body 151 of the passage frame 258 may be formed with a connection hole 153, to which the distal end of each of the opening members 142 is latched while passing through the connection hole so as not to be separated therefrom, such that the opening members 142 can be freely slid in the connection hole upon deformation thereof, and the shielding member 146 of each of the opening members 142 may be further formed with a protrusion hook which prevents the opening member 142 from being separated from the connection hole 153 formed in the passage frame 258.

The passage frame 258 may have various shapes such as a rectangular shape, an octagonal shape as well as a circular loop shape. Further, the passage frame 258 may be suitably formed of a metal or synthetic resin so long as the material of the passage frame can be moved by the weight thereof.

On the other hand, the opening and closing mechanism 105 may further include a holding fixture 160 formed along a circumference thereof with connection via-holes 164 to which the distal ends of the opening members 142 are latched so as not to be separated therefrom, and having the circumference secured to an inner wall of the container body 200 such that the opening members 142 are secured to a circumferential inner wall of a partition or the inner wall of the container body 200; and a plurality of latch protrusions 166 formed along an outer circumference of the holding fixture 160 to secure the holding fixture 160 to the inner wall of the container body 200. As the free ends of the opening members 142 are deformed towards the temporary receiving portion 115 of the opening and closing mechanism 105, the passage space 112*c* is widened to allow passage of the content therethrough. In other words, as soon as the container mechanism is shaken in a front or rear direction by a user, the passage frame 258 in the container mechanism advances in the front direction and the distal ends of the opening members 142, which have blocked the opening 251 of the passage frame 258, approach an outer diameter of the passage frame 258 to open an inner diameter of the passage frame 258 such that the content is discharged through the opening 251 of the passage frame 258 by inertia of shaking operation. When a user becomes accustomed to shaking of the container, the container allows only a demand amount of the content to be easily discharged by adjusting shaking force and time of a user.

Undescribed reference numerals are the same as those described above and detailed description thereof will be omitted herein.

As shown in FIG. 44 to FIG. 46, in a container mechanism including an opening and closing mechanism 105 according to a tenth embodiment of the present invention, a lower portion of the opening and closing mechanism 105 may extend into a container body 200 to form a portion or the entirety of a temporary receiving space inside the container body. In addition, as shown in FIG. 45, the operating mechanism for controlling passage of content 120 may be releasably coupled to the container body 200, and as shown in FIG. 46, two or more opening and closing mechanisms 105 may be coupled to upper and lower portions of the container body 200, or a plurality of opening and closing mechanisms 105 may be consecutively coupled to the container body.

As shown in FIG. 44, when a portion or the entirety of the temporary receiving space is formed inside the container body 200, the container improves utility of the temporary receiving space, and when the operating mechanism for controlling passage of content 120 is configured to be detachable, it is possible to select a suitable operating mechanism for controlling passage of content 120 depending on the kind of content and to facilitate cleaning of the temporary receiving portion.

Undescribed reference numerals are the same as those described above and detailed description thereof will be omitted herein.

Although some embodiments have been disclosed above, it should be understood that these embodiments are given by way of illustration only, and that various modifications, variations, and alterations can be made without departing from the spirit and scope of the present invention. Therefore, the scope of the present invention should be limited only by the accompanying claims.

According to embodiments of the invention, the content receiving device, the opening and closing mechanism, and the container mechanism including the same include a content passage unit to block a content passage side of the container mechanism while allowing a demand amount of content having a solid, powder or liquid phase to be discharged from the container mechanism.

The present invention can improve opening/closing response by restricting a movement angle of the content passage unit opening a content passage side of the container mechanism.

The present invention can stably guide passage of the demand amount of the content by securing a passage space while changing the passage space.

The present invention can close the passage space in association with passage of the demand amount of the content to prevent the content from passing through the passage space.

What is claimed is:

1. A container mechanism comprising:

a content storage portion, an operating mechanism for controlling passage of content and configured to guide movement of the content comprised in the content storage portion, and a housing in which the operating mechanism for controlling the passage of the content is disposed, wherein the operating mechanism for controlling the passage of the content comprises a content passage unit allowing the content to move therethrough and an opening through which the content passes, wherein the housing, which is releasably coupled to the content storage portion or integrally formed with the content storage portion, is provided with a cavity that is open at opposite sides of the cavity, wherein the cavity of the housing is divided by a stationary member disposed on an inner surface of the cavity, wherein the stationary member integrally formed with the housing or releasably coupled to the housing has the opening, wherein the content passage unit, configured to guide the passage of the content through the opening, includes an opening member, a blocking plate corresponding to the opening member, and a moving member rotatably connected to the stationary member, wherein, when the container mechanism is tilted or directed downward to allow the content to move out of the container mechanism, the moving member is configured to be moved by a weight or pression of the content pushing a free end of the opening member in association with operation of the opening member to open the opening to form a passage space for the content and the blocking plate thereby blocks the opening in order to prevent the content from additionally flowing into the opening, wherein an inflow guide member is disposed inside the content storage or the housing, the inflow guide member configured to guide the content to move towards the operating mechanism for controlling passage of content wherein the inflow guide member forms a guide opening that opens toward the operating mechanism for controlling passage of content, wherein the guide opening and the opening are arranged in a line to form a linear passage for the contents towards an outside of the container mechanism when the container mechanism is tilted or directed downward, a side wall of the linear passage being formed by the blocking plate while the blocking plate does not block the opening, wherein the inflow guide member has an inclined surface to allow the content to be collected in the guide opening and is separated from the blocking plate to prevent interference with rotation of the blocking plate, and wherein the moving member comprises a first moving member and a second moving member configured to be rotatable in a direction opposite to each other so that the content is movable between the first moving member and the second moving member, wherein the blocking plate and the opening member protrude in radial directions different from each other from each of the first and second moving members configured to be rotatable in the direction opposite to each other.

* * * * *